US011712730B2

(12) United States Patent
Tabata et al.

(10) Patent No.: US 11,712,730 B2
(45) Date of Patent: Aug. 1, 2023

(54) MANUFACTURING METHOD AND MANUFACTURING DEVICE OF STRUCTURAL MEMBER

(71) Applicant: NIPPON STEEL CORPORATION, Tokyo (JP)

(72) Inventors: Ryo Tabata, Tokyo (JP); Yasuhiro Ito, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 13 days.

(21) Appl. No.: 17/623,559

(22) PCT Filed: Jul. 2, 2020

(86) PCT No.: PCT/JP2020/026000
§ 371 (c)(1),
(2) Date: Dec. 28, 2021

(87) PCT Pub. No.: WO2021/002425
PCT Pub. Date: Jan. 7, 2021

(65) Prior Publication Data

US 2022/0250132 A1 Aug. 11, 2022

(30) Foreign Application Priority Data

Jul. 4, 2019 (JP) ..... 2019-125318

(51) Int. Cl.
*B21D 22/26* (2006.01)
*B21D 53/88* (2006.01)

(52) U.S. Cl.
CPC ..... *B21D 22/26* (2013.01); *B21D 53/88* (2013.01)

(58) Field of Classification Search
CPC ..... B21D 22/26; B21D 24/00; B21D 53/88
See application file for complete search history.

(56) References Cited

U.S. PATENT DOCUMENTS 5,395,036 A * 3/1995 Sturrus ..... B60R 19/03 228/173.7
5,561,902 A * 10/1996 Jacobs ..... B21D 5/08 72/181

(Continued)

FOREIGN PATENT DOCUMENTS

DE 10 2010 016 960 A1 11/2011
JP 8-188022 A 7/1996

(Continued)

*Primary Examiner* — Jason L Vaughan
(74) *Attorney, Agent, or Firm* — Birch, Stewart, Kolasch & Birch, LLP

(57) ABSTRACT

This manufacturing method of a structural member includes an intermediate step and a bending step. A height difference is provided on a bottom wall of a groove part between an intermediate position and both end positions sandwiching the intermediate position therebetween in a longitudinal sectional view in an extending direction of the groove part by the pressing in the intermediate step, and thereby at least one of a first curved part which has a concave curved shape in a plan view and a convex curved shape in the longitudinal sectional view and a second curved part which has a convex curved shape in the plan view and a concave curved shape in the longitudinal sectional view is formed on the bottom wall.

16 Claims, 48 Drawing Sheets

(56) References Cited

U.S. PATENT DOCUMENTS

| | | | | |
|---|---|---|---|---|
| 5,934,544 | A * | 8/1999 | Lee | B60R 19/18 72/181 |
| 6,948,749 | B2 * | 9/2005 | Graber | B60R 19/18 296/187.03 |
| 7,197,824 | B1 * | 4/2007 | Graber | B21D 7/028 29/897.35 |
| 8,061,034 | B2 * | 11/2011 | Meilis | B21D 53/88 72/168 |
| 8,716,624 | B2 * | 5/2014 | Johnson | B21D 51/16 228/49.4 |
| 9,211,858 | B2 * | 12/2015 | Johnson | B21D 53/88 |
| 9,505,361 | B2 * | 11/2016 | Conrod | B60R 19/18 |
| 9,862,017 | B2 * | 1/2018 | Higai | B21D 9/08 |
| 10,464,404 | B2 * | 11/2019 | Noguchi | B60J 5/0402 |
| 10,920,847 | B2 * | 2/2021 | Mohammadi | F16F 9/3242 |
| 2015/0114070 | A1 | 4/2015 | Higai et al. | |
| 2015/0165511 | A1 | 6/2015 | Higai et al. | |
| 2021/0001675 | A1 | 1/2021 | Ito et al. | |

FOREIGN PATENT DOCUMENTS

| | | | |
|---|---|---|---|
| JP | 2012-152765 | A | 8/2012 |
| JP | 2013-244511 | A | 12/2013 |
| JP | 2013-244512 | A | 12/2013 |
| JP | 2017-127898 | A | 7/2017 |
| WO | WO 2010/089705 | A1 | 8/2010 |
| WO | WO 2019/103152 | A1 | 5/2019 |

* cited by examiner

FIRST STEP

SECOND STEP

THIRD STEP

MANUFACTURING METHOD AND MANUFACTURING DEVICE OF STRUCTURAL MEMBER

TECHNICAL FIELD

The present invention relates to a manufacturing method and a manufacturing device of a structural member.

Priority is claimed on Japanese Patent Application No. 2019-125318 filed in Japan on Jul. 4, 2019, the content of which is incorporated herein by reference.

BACKGROUND ART

A suspension part, which is a structural member of an automobile body, is an important part that affects the steering stability of an automobile. For example, a front lower arm (which may hereinafter be simply referred to as "lower arm") serves to maintain positions and orientations of tires, maintain a lateral force when a vehicle turns, block transmission of an impact input to a body side, maintain strength when the automobile rides up on a curb, and the like. As a result of studies conducted by the present inventors for realizing high performance in these roles, they have reached a conclusion that increasing strength of the curved edge part is particularly important among the parts of the lower arm.

Patent Documents 1 to 3 disclose processing technologies of processing a flat plate material to increase the strength.

That is, the technology described in Patent Document 1 is a method for forming a flat plate-shaped processed material into a closed cross-sectional structure including a bottom part formed on a central portion side in a width direction, left and right lateral wall parts positioned on both sides of the bottom part in a width direction, and a pair of flange parts formed at end portions in a width direction of the left and right lateral wall parts. The forming method of the closed cross-sectional structure employs steps including: a first step of press-forming the processed material into a curvature shape required for a final closed cross-sectional shape in a longitudinal direction and a width direction; a second step of bending and forming the processed material that has been formed in the first step so that the left and right lateral wall parts face each other by sandwiching the bottom part between a first punch and a pad from a plate thickness direction; and a third step in which the left and right lateral wall parts are moved toward each other and the pair of flange parts are made to abut each other by a pushing operation of a pair of pressing cams in a state in which the bottom part of the processed material that has been formed in the second step is disposed on the pad so that a die cavity having the same spatial shape as the final closed cross-sectional shape is defined by a support surface supporting the bottom part of the pad and a pushing surface on which the left and right lateral wall parts of the pair of pressing cams are pushed, and the pair of flange parts are pushed down toward the cavity side by a push-down part of a second punch disposed above the pair of flange parts so that the bottom part and the left and right lateral wall parts are pressed against the support surface and the pushing surface of the die cavity.

Also, the technology described in Patent Document 2 is a method of forming a flat plate-shaped processed material into a closed cross-sectional structure including a bottom part formed on a central portion side of the processed material in a width direction and left and right lateral wall parts positioned on both sides of the bottom part in a width direction by bending the flat plate-shaped processed material at positions corresponding to a plurality of bending lines extending in a longitudinal direction. The forming method of the closed cross-sectional structure employs steps including: a first step of forming the processed material into a curvature shape required for a final closed cross-sectional shape in a longitudinal direction and a width direction and applying a bending guide line to a position that will become a bending line in the final closed cross-sectional shape by press forming; a second step of bending and forming the processed material that has been formed in the first step to bring the left and right lateral wall parts toward each other by sandwiching the bottom part between a punch and a pad from a plate thickness direction and pushing the punch between a pair of dies; and a third step of bending and forming the bottom part and the left and right lateral wall parts with the bending guide line as a boundary by pressing the bottom part and the left and right lateral wall parts against an outer circumference of a plug in a state in which the plug having the same outer circumferential shape as the final closed cross-sectional shape is disposed on the bottom part of the processed material that has been formed in the second step.

Also, the technology described in Patent Document 3 is a method of manufacturing a closed cross-section structural member by forming a flat plate-shaped processed material into a closed cross-sectional structure in which a bottom surface part is curved in a longitudinal direction. The manufacturing method of the closed cross-section structural member employs steps including: a first forming step of forming a plurality of first out-of-plane deformed parts each having a concave shape or a convex shape in the longitudinal direction and forming a bent part with respect to at least a bottom surface part position of the processed material; and a second forming step in which the punch is pushed between dies with the bottom surface part position of the processed material sandwiched between a pad and the punch so that the first out-of-plane deformed part is pressed and crushed by the pad and the punch and the bent part is bent and formed.

Also, the technology described in Patent Document 4 is about a press device including a punch, a blank holder disposed adjacent to the punch, and a die which includes a die shoulder and a plate pressing surface and in which a region of a part of the die shoulder is curved in a concave shape in an extending direction of the die shoulder. Then, in this press device, a horizontal distance between a die shoulder boundary line defined by an R stop on the plate pressing surface side of the die shoulder in a region other than the region of the die shoulder curved in a concave shape and an edge of the blank holder is larger than a horizontal distance between the die shoulder boundary line in the region of the die shoulder curved in a concave shape and the edge of the blank holder.

Also, the technology described in Patent Document 5 is about a vehicle suspension arm including a plate-shaped main body part disposed substantially parallel to a load input plane and a reinforcing part having substantially a pipe shape provided to be connected along at least one side edge of the main body part.

Also, the technology described in Patent Document 6 is about a structural member including a top plate part having a first edge part and a second edge part facing the first edge part, a wall part extending in a direction intersecting the top plate part from the second edge part, and a closed cross-sectional part provided on the first edge part. In this structural member, the first edge part is curved toward the inside of the top plate part in a plan view with respect to the top plate part, and when a distance from the first edge part to the second edge part of the structural member is defined as a structural member width, the closed cross-sectional part is provided inside the curve of the top plate part to form a closed cross section in a vertical cross section of the structural member in a direction of the structural member width, a vertical cut surface of the structural member in the direction of the structural member width has an open cross section, and a shape of the vertical cut surface of the structural member including the closed cross-sectional part is asynmnetric with respect to a longitudinal center of the structural member width.

CITATION LIST

[Patent Document]
[Patent Document 1]
Japanese Unexamined Patent Application, First Publication No. 2013-244511
[Patent Document 2]
Japanese Unexamined Patent Application, First Publication No. 2013-244512
[Patent Document 3]
Japanese Unexamined Patent Application, First Publication No. 2012-152765
[Patent Document 4]
Japanese Unexamined Patent Application, First Publication No. 2017-127898
[Patent Document 5]
Japanese Unexamined Patent Application, First Publication No. H8-188022
[Patent Document 6]
PCT International Publication No. WO 2019/103152

SUMMARY OF THE INVENTION

Problems to be Solved by the Invention

However, none of the technologies disclosed in Patent Documents 1 to 5 is capable of forming a curved reinforcing part at a position away from a neutral axis such as a curved edge of the lower arm. The neutral axis referred to herein is an axis that passes through a central position between the curved edge and an edge on a side opposite to the curved edge of the lower arm.

Particularly, it has been difficult to form a reinforcing part having a bend with a small radius of curvature along an edge part of a top plate part while leaving the flat plate-shaped top plate part such as the curved edge of the lower arm. For example, when the technologies of Patent Documents 1 to 5 are attempted to be applied, it is also conceivable to manufacture a separate tubular part on the basis of the disclosed technologies and weld the separate part to the curved edge to form a reinforcing part. An example thereof is disclosed in Patent Document 6. However, welding a separate part to the curved edge to use it as a reinforcing part has a problem from the perspective of weldability and manufacturing costs. Originally, it is difficult to form a reinforcing part having a small radius of curvature by using the technologies disclosed in Patent Documents 1 to 6, and there is a high likelihood that partial crushing will occur in the cross-sectional shape when viewed in a longitudinal direction thereof. Also, even if a core is used to prevent the crushing, there is a high likelihood that the core will not come off after the forming.

The present invention has been made in view of the above-described circumstances, and an objective of the present invention is to provide a manufacturing method and a manufacturing device of a structural member capable of reinforcing a curved edge of a top plate part without using a separate part.

Means for Solving the Problem

In order to solve the above-described problems and achieve the objective, the present invention employs the following measures.

(1) A manufacturing method of a structural member according to one aspect of the present invention is a method for manufacturing a structural member including a top plate part having a curved edge and a curved reinforcing part which is formed integrally with the top plate part in an extending direction of the curved edge and in which a cross section perpendicular to the extending direction of the curved edge has a closed cross-sectional shape or an open cross-sectional shape from a flat plate material, and the manufacturing method of a structural member includes an intermediate step of forming a groove part and a vertical wall part which is continuous with the groove part along a portion of the flat plate material that will become the curved edge by pressing a second portion continuous with a first portion in a direction intersecting a surface of the flat plate material with the first portion of the flat plate material corresponding to the top plate part sandwiched, and a bending step of bending an upper end edge of the vertical wall part toward the top plate part by pushing down the upper end edge toward the groove part while movement thereof toward the top plate part is allowed after the intermediate step, in which a height difference is provided on a bottom wall of the groove part between an intermediate position and both end positions sandwiching the intermediate position therebetween in a longitudinal sectional view in an extending direction of the groove part by the pressing in the intermediate step, and thereby at least one of a first curved part which has a concave curved shape in a plan view and a convex curved shape in the longitudinal sectional view and a second curved part which has a convex curved shape in the plan view and a concave curved shape in the longitudinal sectional view is formed on the bottom wall.

According to the manufacturing method of a structural member according to the above-described (1), since at least one of the first curved part and the second curved part is provided on the bottom wall in a longitudinal sectional view in the extending direction by the pressing in the intermediate step, a bend in the same direction in which the curved reinforcing part of the structural member is bent can be applied to the bottom wall before the next step. In addition, when the bottom wall is bent to form at least one of the first curved part and the second curved part, the upper end edge of the vertical wall part that is continuous with the bottom wall can be subjected to stretch flange deformation or shrink flange deformation. Since the vertical wall part can be made to incline so that the upper end edge thereof comes closer to the first portion with the stretch flange deformation or the shrink flange deformation, the vertical wall part can be easily bent in the following bending step. Therefore, a curved reinforcing part having a closed cross-sectional shape or an open cross-sectional shape can be formed without using a core, and rigidity of the structural member can be increased. Here, the ability to form a shape of the curved reinforcing part without breakage and the fact that cracks are not caused can both be considered to be main features. In the above-described aspect, pre-deformation such as stretch flange deformation or shrink flange deformation is applied to the vertical wall part in the intermediate step, and thus a deformation range of the material is not locally limited but it is performed in a wide range. Thereby, the above-described two features can both be achieved.

Further, at the time of the press forming in the intermediate step, the first portion corresponding to the top plate part is not completely fixed but is in a sandwiched state. Therefore, movement and deformation of the first portion out of the plane is restricted, but a metal flow in which some of the first portion is directed toward the second portion is allowed.

When the first curved part having a concave curved shape in a plan view and a convex curved shape in the longitudinal sectional view is formed on the bottom wall by the pressing in the intermediate step, a concave portion in a plan view can be formed in the curved reinforcing part. Also, when the second curved part having a convex curved shape in a plan view and a concave curved shape in the longitudinal sectional view is formed on the bottom wall by the pressing in the intermediate step, a convex portion in a plan view can be formed in the curved reinforcing part. Here, the first curved part and the second curved part may each form a part or the whole of the bottom wall.

Then, when the upper end edge is joined to the top plate part after the bending step, the reinforcing part having a closed cross-sectional shape is formed. Further, when the upper end edge remains spaced apart from the top plate part after the bending step, the curved reinforcing part having an open cross-sectional shape is formed.

Further, the above-described "curved" shape is not limited to an arcuate shape having a constant radius of curvature and may include a curved shape that is not an arcuate shape such as, for example, an elliptical shape or a parabolic shape. Further, a linear shape may be partially included in the curve shape. Also, the "curved" shape may be either a symmetrical shape or an asymmetrical shape with a central position in the longitudinal direction as a boundary in a plan view.

(2) In the aspect of the above-described (1), when viewed along a cross-sectional line length of the groove part along an inner shape of a cross section perpendicular to the extending direction of the groove part, a ratio obtained by dividing the cross-sectional line length at the intermediate position by the cross-sectional line length at both of the end positions may fall within a range of 0.7 to 1.3 due to the pressing in the intermediate step.

In a case of the aspect described in (2) above, a size of the cross-sectional shape at any position in the extending direction of the curved reinforcing part can be made substantially equal. In addition, forming defects such as cracks and wrinkles can be prevented from occurring in a portion of the curved reinforcing part that overlaps the top plate part in a plan view.

(3) In the aspect of the above-described (1) or (2), an R/R1 ratio obtained by dividing a radius of curvature R (mm) of a center line passing through a central position in a width direction of the bottom wall in a plan view by a radius of curvature R1 (mm) of the bottom wall in the longitudinal sectional view in at least one of the first curved part and the second curved part may fall within a range of 0.2 to 1.2 due to the pressing in the intermediate step.

In a case of the aspect described in (3) above, the height difference in the first curved part or the second curved part after the intermediate step can be prevented from being excessively large or small. Thereby, occurrence of problems such as dimensional errors, constriction, or breakages in the curved reinforcing part can be avoided.

When a plurality of first curved parts or second curved parts are included, a combination of radii of curvature R and R1 at a position at which the radius of curvature R has a smallest value is employed as the radii of curvature R and R1.

(4) The aspect of any one of the above-described (1) to (3) may further include a joining step of, after the bending step, overlapping and joining at least a part of the upper end edge of the vertical wall part and the top plate part to form the curved reinforcing part having the closed cross-sectional shape.

In a case of the aspect described in (4) above, the curved reinforcing part having a closed cross-sectional shape can be formed along the curved edge of the top plate part.

(5) In the aspect of the above-described (4), movement of the upper end edge past a planned joining position on the top plate part may be restricted in the joining step.

In a case of the aspect described in (5) above, the upper end edge of the vertical wall part is subject to a force that restricts it not to move past the planned joining position. Since the vertical wall part that obtains the force as a reaction force is deformed so that a cross-sectional shape thereof bulges, an appropriate closed cross-sectional shape can be formed without using a core.

(6) The aspect of the above-described (4) or (5) may further include an upper end edge bending step of, before the joining step, forming a bent part at which the upper end edge is directed toward the top plate part at the time of the joining step.

In a case of the aspect described in (6) above, when the bent part is formed on the upper end edge in advance, a load on a surface that pressurizes the upper end edge (for example, a pressurizing surface of the die) can be reduced when the upper end edge is pushed down to bend the vertical wall part.

(7) In the aspect of any one of the above-described (1) to (3), the bending step may include a folding-back step of forming the curved reinforcing part having the open cross-sectional shape by further bending the vertical wall part to a state in which the upper end edge is spaced apart from the top plate part in a side view while at least a part of the upper end edge overlaps the top plate part in a plan view facing the top plate part.

In a case of the aspect described in (7) above, the curved reinforcing part having an open cross-sectional shape can be formed along the curved edge of the top plate part.

(8) In the aspect of the above-described (7), the movement of the upper end edge past a predetermined position may be restricted when the vertical wall part is further bent in the folding-back step.

In a case of the aspect described in (8) above, the upper end edge of the vertical wall part is subject to a force that restricts it not to move past a predetermined position. Since the vertical wall part that obtains the force as a reaction force is deformed so that a cross-sectional shape thereof bulges, an appropriate open cross-sectional shape can be formed without using a core.

(9) The aspect of the above-described (7) or (8) may further include an upper end edge bending step of, before the folding-back step, forming a bent part at which the upper end edge is directed toward the top plate part at the time of the folding-back step.

In a case of the aspect described in (9) above, when the bent part is formed on the upper end edge in advance, a load on a surface that pressurizes the upper end edge (for example, a pressurizing surface of the die) can be reduced when the upper end edge is pushed down to bend the vertical wall part.

(10) In the aspect of any one of the above-described (1) to (9), the curved reinforcing part including both a concave curved shape and a convex curved shape in a plan view facing the top plate part may be formed after the bending step by forming both the first curved part and the second curved part by the pressing in the intermediate step.

In a case of the aspect described in (10) above, a structural member having a plurality of curved shapes (concavo-convex shapes) in the same curved reinforcing part can be obtained.

(11) A manufacturing device of a structural member according to one aspect of the present invention is a device for manufacturing a structural member including a top plate part having a curved edge and a curved reinforcing part which is formed integrally with the top plate part in an extending direction of the curved edge and in which a cross section perpendicular to the extending direction of the curved edge has a closed cross-sectional shape from a flat plate material, and the manufacturing device of a structural member includes a first die on which a first die groove curved in a plan view is formed, a first punch which moves relatively closer to and further away from the first die groove, a second die having a second die groove which is thinner than the first die groove in a plan view, a first holder including a curved convex part having a shape corresponding to the second die groove, a second punch having a second vertical wall surface disposed to face a first vertical wall surface of the first holder at a distance of 5 mm or more and 50 mm or less in a horizontal direction in a plan view and configured to move relatively closer to and further away from the second die groove, a second holder disposed to overlap the second die, and a pad having a pressurizing surface which moves closer to and further away from the second die groove, in which a bottom surface of the first die groove has a height difference between an intermediate position and both end positions sandwiching the intermediate position therebetween in a longitudinal sectional view in an extending direction of the first die groove, a pressurizing surface of the first punch has a height difference corresponding to that of the bottom surface of the first die groove, the bottom surface of the first die groove includes at least one of a first die curved surface which has a concave curved shape in the plan view and a convex curved shape in the longitudinal sectional view and a second die curved surface which has a convex curved shape in the plan view and a concave curved shape in the longitudinal sectional view, and a gap at a bottom dead center of forming with respect to a first top plate support surface of the second die is larger on the pressurizing surface of the pad than on a pressurizing surface of the second holder.

According to the manufacturing device of a structural member according to the above-described (11), when the flat plate material is subjected to forming while sandwiched between the first die groove and the pressurizing surface of the first punch, a groove part having a bottom wall bent in the same direction in which the curved reinforcing part of the structural member is bent can be given to the flat plate material in advance. In addition, since the flat plate material can be bent so that a concavo-convex shape corresponding to the first die curved surface and the second die curved surface is given to the bottom wall of the groove part, the upper end edge of the vertical wall part that is continuous with the bottom wall can be subjected to stretch flange deformation or shrink flange deformation. Since the vertical wall part can be made to incline so that the upper end edge thereof comes closer to a portion that will become the top plate part with the stretch flange deformation or the shrink flange deformation, the vertical wall part can be easily bent in the next step. Further, the "corresponding height difference" on the pressurizing surface of the first punch means a height difference formed by the pressurizing surface of the first punch bent in the same direction as the bottom surface of the first die groove and is preferably the same as the height difference of the first die groove.

When the bottom surface of the first die groove includes the first die curved surface having a concave curved shape in a plan view and a convex curved shape in a longitudinal sectional view, a concave portion in a plan view can be formed in the curved reinforcing part. Also, when the bottom surface of the first die groove includes the second die curved surface having a convex curved shape in a plan view and a concave curved shape in a longitudinal sectional view, a convex portion in a plan view can be formed in the curved reinforcing part. Here, the first curved part and the second curved part, that is, the first die curved surface and the second die curved surface, may each form a part or the whole of the bottom wall of the first die groove.

Further, the manufacturing device of a structural member includes the second die, the first holder, and the second punch as described above. According to this configuration, the flat plate material is sandwiched between the second die and the first holder so that the groove part is sandwiched between the second die groove and the curved convex part after the groove part and the vertical wall part are formed in the flat plate material by the first die and the first punch. Then, a bend can be applied to the bottom wall of the groove part by bringing the second punch closer to the flat plate material. As a result, a part of the bottom wall becomes a part of the vertical wall part, and furthermore a bend to be used in the next step can be given in advance between the part of the bottom wall and the original vertical wall part.

The manufacturing device of a structural member further includes the second holder and the pad as described above. In addition, a gap at a bottom dead center of forming with respect to the first top plate support surface of the second die is larger on the pressurizing surface of the pad than on the pressurizing surface of the second holder. According to this configuration, the bottom wall that is partially bent by the second punch is incorporated in the second die groove and the third die groove, and then the flat plate material is sandwiched between the second die and the second holder. Then, when the pressurizing surface of the pad comes into contact with the upper end edge of the vertical wall part and pushes it down, the vertical wall part is bent and brought into contact with the top plate part in the gap between the second die and the pad, and thereby the curved reinforcing part having a closed cross-sectional shape can be formed. Here, a gap at a bottom dead center of forming with respect to the first top plate support surface of the second die is larger on the pressurizing surface of the pad than on the pressurizing surface of the second holder. Therefore, in the second holder, the top plate part can be firmly sandwiched, and in the pad, a joint margin for sandwiching the top plate part and the upper end edge of the vertical wall part can be obtained between the pad and the second die.

(12) In the aspect of the above-described (11), when viewed along a cross-sectional line length of the first die groove along an inner shape of a cross section perpendicular to the extending direction of the first die groove, a ratio obtained by dividing the cross-sectional line length at the intermediate position by the cross-sectional line length at both of the end positions may fall within a range of 0.7 to 1.3.

In a case of the aspect described in (12) above, a size of the cross-sectional shape at any position in the extending direction of the curved reinforcing part can be made substantially equal in the structural member obtained by the manufacturing device of the structural member. In addition, forming defects such as cracks and wrinkles can be prevented from occurring in a portion of the curved reinforcing part that overlaps the top plate part in a plan view.

(13) In the aspect of the above-described (11) or (12), an R/R1 ratio of the bottom surface of the first die groove obtained by dividing a radius of curvature R (mm) of a center line passing through a central position in a width direction in a plan view by a radius of curvature R1 (mm) in the longitudinal sectional view in at least one of the first die curved surface and the second die curved surface may fall within a range of 0.2 to 1.2.

In a case of the aspect described in (13) above, when the flat plate material is subjected to forming, the height difference formed by the first die curved surface or the second die curved surface can be prevented from being excessively large or small. Thereby, occurrence of problems such as dimensional errors, constriction, or breakage in the curved reinforcing part can be avoided.

When a plurality of first die curved surfaces and second die curved surfaces are included on the bottom surface of the first die groove, radii of curvature R and R1 at a position at which the radius of curvature R has a smallest value are employed as the radii of curvature R and R1.

(14) A manufacturing device of a structural member according to another aspect of the present invention is a device for manufacturing a structural member including a top plate part having a curved edge and a curved reinforcing part which is formed integrally with the top plate part in an extending direction of the curved edge and in which a cross section perpendicular to the extending direction of the curved edge has an open cross-sectional shape from a flat plate material, and the manufacturing device of a structural member includes a third die having a second top plate support surface which includes a first die curved edge curved in a plan view, a third holder which moves closer to and further away from the second top plate support surface, a fourth die including a fourth die groove which is disposed adjacent to the first die curved edge in a plan view, a fourth punch which moves closer to and further away from the fourth die groove, a fifth die having a third top plate support surface which includes a second die curved edge curved in a plan view, a fourth holder which moves closer to and further away from the third top plate support surface, a fifth punch having a fourth vertical wall surface disposed to face a third vertical wall surface of the fourth holder at a distance of 5 mm or more and 50 mm or less in a horizontal direction in a plan view, a sixth die having a fourth top plate support surface which includes a third die curved edge curved in a plan view, a fifth holder which moves closer to and further away from the fourth top plate support surface, and a sixth punch having a pressurizing surface which overlaps a top of the third die curved edge in a plan view and configured to move closer to and further away from the sixth die, in which a bottom surface of the fourth die groove has a height difference between an intermediate position and both end positions sandwiching the intermediate position therebetween in a longitudinal sectional view in an extending direction of the fourth die groove, a pressurizing surface of the fourth punch has a height difference corresponding to the bottom surface of the fourth die groove, the bottom surface of the fourth die groove includes at least one of a third die curved surface which has a concave curved shape in the plan view and a convex curved shape in the longitudinal sectional view and a fourth die curved surface which has a convex curved shape in the plan view and a concave curved shape in the longitudinal sectional view, and a gap at a bottom dead center of forming with respect to the fourth top plate support surface of the sixth die is larger on a pressurizing surface of the sixth punch than on a pressurizing surface of the fifth holder.

According to the manufacturing device of a structural member described in (14) above, when the flat plate material is subjected to forming while sandwiched between the fourth die groove and the pressurizing surface of the fourth punch, a groove part having a bottom wall bent in the same direction in which the curved reinforcing part of the structural member is bent can be given to the flat plate material in advance. In addition, since the flat plate material can be bent so that a concavo-convex shape corresponding to the third die curved surface and the fourth die curved surface is given to the bottom wall of the groove part, the upper end edge of the vertical wall part that is continuous with the bottom wall can be subjected to stretch flange deformation or shrink flange deformation. Since the vertical wall part can be made to incline so that the upper end edge thereof comes closer to a portion that will become the top plate part with the stretch flange deformation or the shrink flange deformation, the vertical wall part can be easily bent in the next step. Further, the "corresponding height difference" on the pressurizing surface of the fourth punch means a height difference formed by the pressurizing surface of the fourth punch bent in the same direction as the bottom surface of the fourth die groove and is preferably the same as the height difference of the fourth die groove.

When the bottom surface of the fourth die groove includes the third die curved surface having a concave curved shape in a plan view and a convex curved shape in a longitudinal sectional view, a concave portion in a plan view can be formed in the curved reinforcing part. Also, when the bottom surface of the fourth die groove includes the fourth die curved surface having a convex curved shape in a plan view and a concave curved shape in a longitudinal sectional view, a convex portion in a plan view can be formed in the curved reinforcing part.

Further, the manufacturing device of a structural member includes the fifth die, the fourth holder, and the fifth punch as described above. According to this configuration, the flat plate material is sandwiched between the fifth die and the fourth holder so that the groove part is sandwiched between the fifth die and the fourth holder after the groove part and the vertical wall part are formed in the flat plate material by the fourth die and the fourth punch. Then, a bend can be applied to the bottom wall of the groove part by bringing the fifth punch closer to the flat plate material. As a result, a part of the bottom wall becomes a part of the vertical wall part, and furthermore a bend to be used in the next step can be given in advance between the part of the bottom wall and the original vertical wall part.

Further, the manufacturing device of a structural member includes the sixth die, the fifth holder, and the sixth punch as described above. In addition, a gap at a bottom dead center of forming with respect to the fourth top plate support surface of the sixth die is larger on the pressurizing surface of the sixth punch than on the pressurizing surface of the fifth holder. According to this configuration, the upper end edge of the vertical wall part is pushed down by the pressurizing surface of the sixth punch in a state in which the flat plate material is sandwiched between the sixth die and the fifth holder after the vertical wall part has been formed. Thereby, bending processing of the vertical wall part is performed and the curved reinforcing part having an open cross-sectional shape is formed. Here, a gap at a bottom dead center of forming with respect to the fourth top plate support surface of the sixth die is larger on the pressurizing surface of the sixth punch than on the pressurizing surface of the fifth holder. Therefore, in the fifth holder, the top plate part can be firmly sandwiched, and in the sixth punch, the curved reinforcing part having an open cross-sectional shape can be obtained between the sixth punch and the sixth die.

(15) In the aspect of the above-described (14), when viewed along a cross-sectional line length of the fourth die groove along an inner shape of a cross section perpendicular to the extending direction of the fourth die groove, a ratio obtained by dividing the cross-sectional line length at the intermediate position by the cross-sectional line length at both of the end positions may fall within a range of 0.7 to 1.3.

In a case of the aspect described in (15) above, a size of the cross-sectional shape at any position in the extending direction of the curved reinforcing part can be made substantially equal in the structural member obtained by the manufacturing device of the structural member. In addition, forming defects such as cracks and wrinkles can be prevented from occurring in a portion of the curved reinforcing part that overlaps the top plate part in a plan view.

(16) In the aspect of the above-described (14) or (15), an R/R1 ratio of the bottom surface of the fourth die groove obtained by dividing a radius of curvature R (mm) of a center line passing through a central position in a width direction in a plan view by a radius of curvature R1 (mm) in the longitudinal sectional view in at least one of the third die curved surface and the fourth die curved surface may fall within a range of 0.2 to 1.2.

In a case of the aspect described in (16) above, when the flat plate material is subjected to forming, the height difference formed by the third die curved surface or the fourth die curved surface can be prevented from being excessively large or small. Thereby, occurrence of problems such as dimensional errors, constriction, or breakage in the curved reinforcing part can be avoided.

When a plurality of third die curved surfaces and fourth die curved surfaces are included on the bottom surface of the fourth die groove, radii of curvature R and R1 at a position at which the radius of curvature R has a smallest value are employed as the radii of curvature R and R1.

Effects of the Invention

According to the manufacturing method and the manufacturing device of a structural member according to the above-described aspects, a structural member having high rigidity can be manufactured by reinforcing the curved edge.

BRIEF DESCRIPTION OF DRAWINGS

FIG. 6(*b*) is a view for explaining a relative positional relationship in a horizontal direction between a holder and a punch used in the second step of the first embodiment and is a longitudinal sectional view at a central position in an extending direction of a die groove m1.

EMBODIMENTS FOR IMPLEMENTING THE INVENTION

Embodiments and examples of a manufacturing method and a manufacturing device of a structural member of the present invention will be described below with reference to the drawings.

First Embodiment

In the present embodiment, a manufacturing method and a manufacturing device for forming a structural member 1 shown in FIG. 1 from a flat plate material will be described. Further, FIG. 1 is a view showing the structural member 1 manufactured by the manufacturing method of a structural member according to the present embodiment, in which FIG. 1(*a*) is a perspective view and FIG. 1(*b*) is a plan view.

Figure 1:
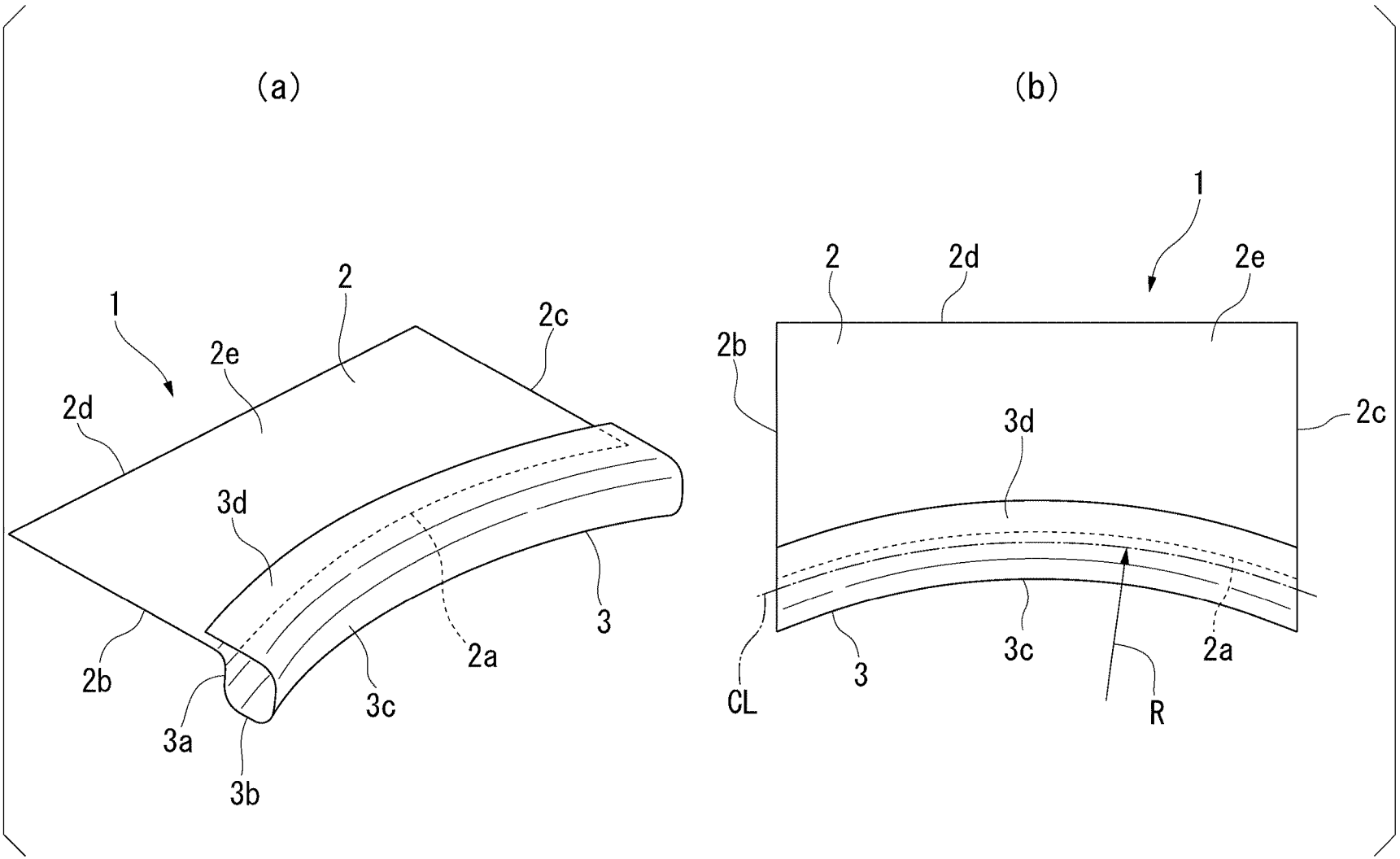
FIG. 1 is a view showing a structural member manufactured by a manufacturing method of a structural member according to a first embodiment of the present invention, in which FIG. 1(*a*) is a perspective view and FIG. 1(*b*) is a plan view.

The structural member 1 shown in FIG. 1 includes a top plate part 2 having a curved edge 2*a*, and a curved reinforcing part 3 that is formed integrally with the top plate part 2 in an extending direction of the curved edge 2*a* and in which a cross section perpendicular to the above-described extending direction has a closed cross-sectional shape. Further, in FIG. 1(*a*), a joint portion is shown to be slightly open so that shapes of the curved edge 2*a* and the curved reinforcing part 3 can be easily understood, but in practice, the joint portion is joined without gaps and the curved reinforcing part 3 forms a closed cross-sectional shape. The other drawings may also be shown in the same way.

The top plate part 2 is a flat plate defined by a pair of both lateral edges 2*b* and 2*c* parallel to each other, the curved edge 2*a* continuous between the lateral edges 2*b* and 2*c* and forming a front edge, and a rear edge 2*d* facing the curved edge 2*a* and continuous between the lateral edges 2*b* and 2*c*. Of these, the lateral edges 2*b* and 2*c* and the rear edge 2*d* each have a linear shape. On the other hand, the curved edge 2*a* has a concave curved shape whose center is closer to the rear edge 2*d* with respect to both ends thereof. As a radius of curvature R of the concave curved shape in a plan view, 100 mm to 400 mm may be exemplified. However, the radius of curvature R is not limited to this range.

The curved reinforcing part 3 includes an inner wall 3*a* continuous with the curved edge 2*a* of the top plate part 2 and directed vertically downward, a bottom wall 3*b* continuous with the inner wall 3*a* and directed in a direction horizontally away from the top plate part 2, an outer wall 3*c* continuous with the bottom wall 3*b* and directed vertically upward, and an upper wall 3*d* continuous with the outer wall 3*c* and joined to an upper surface 2*e* of the top plate part 2.

The inner wall 3*a* has a height dimension in a vertical direction that is the same at any position from one end to the other end in an extending direction of the curved reinforcing part 3. Further, the inner wall 3*a* has a concave curved shape having the same radius of curvature in the same direction as the curved edge 2*a* in a plan sectional view.

The bottom wall 3*b* has a width dimension in a horizontal direction that is the same at any position from one end to the other end in the extending direction of the curved reinforcing part 3. Further, the bottom wall 3*b* is parallel to the top plate part 2 in a side view and has a concave curved shape that is curved in the same direction as the curved edge 2*a* in a bottom view.

The outer wall 3*c* has a height dimension in a vertical direction that is the same at any position from one end to the other end in the extending direction of the curved reinforcing part 3. Further, the outer wall 3*c* has a concave curved shape that is curved in the same direction as the curved edge 2*a* in a plan sectional view.

The upper wall 3*d* has a width dimension in a horizontal direction that is the same at any position from one end to the other end in the extending direction of the curved reinforcing part 3, and furthermore, has a width larger than that of the bottom wall 3*b*. Further, the upper wall 3*d* is parallel to the top plate part 2 in a longitudinal sectional view and has a concave curved shape that is curved in the same direction as the curved edge 2*a* in a plan view. Further, the upper wall 3*d* is joined to the upper surface 2*e* of the top plate part 2 at a position past the curved edge 2*a* toward the rear edge 2*d*. As a joining method thereof, for example, welding, adhesion, bolt fixing, or the like can be appropriately used.

The inner wall 3*a* and the outer wall 3*c* are parallel to each other, and the upper wall 3*d* and the bottom wall 3*b* are parallel to each other. Further, a closed cross-sectional shape is formed by four wall parts of the inner wall 3*a*, the bottom wall 3*b*, the outer wall 3*c*, and the upper wall 3*d*. That is, in the present embodiment, a concave curved space is formed in the curved reinforcing part 3, and the space communicates with the outside only at two portions, one end and the other end of the curved reinforcing part 3 in the extending direction.

According to the structural member 1 having the configuration described above, out-of-plane deformation of the top plate part 2 can be prevented by rigidity of the curved reinforcing part 3 having the closed cross-sectional shape. Also, high rigidity can be exhibited against a compressive load or a tensile load in the extending direction of the curved edge 2*a*.

Next, a comparative example will be described first with reference to FIGS. 2 to 11 before describing the manufacturing method and the manufacturing device of the present embodiment.

In the present comparative example, the structural member 1 shown in FIG. 1 is attempted to be manufactured through first to third steps described below. First, the first step will be described with reference to FIGS. 2 to 5.

[Comparative Example/First Step]

Figure 2:
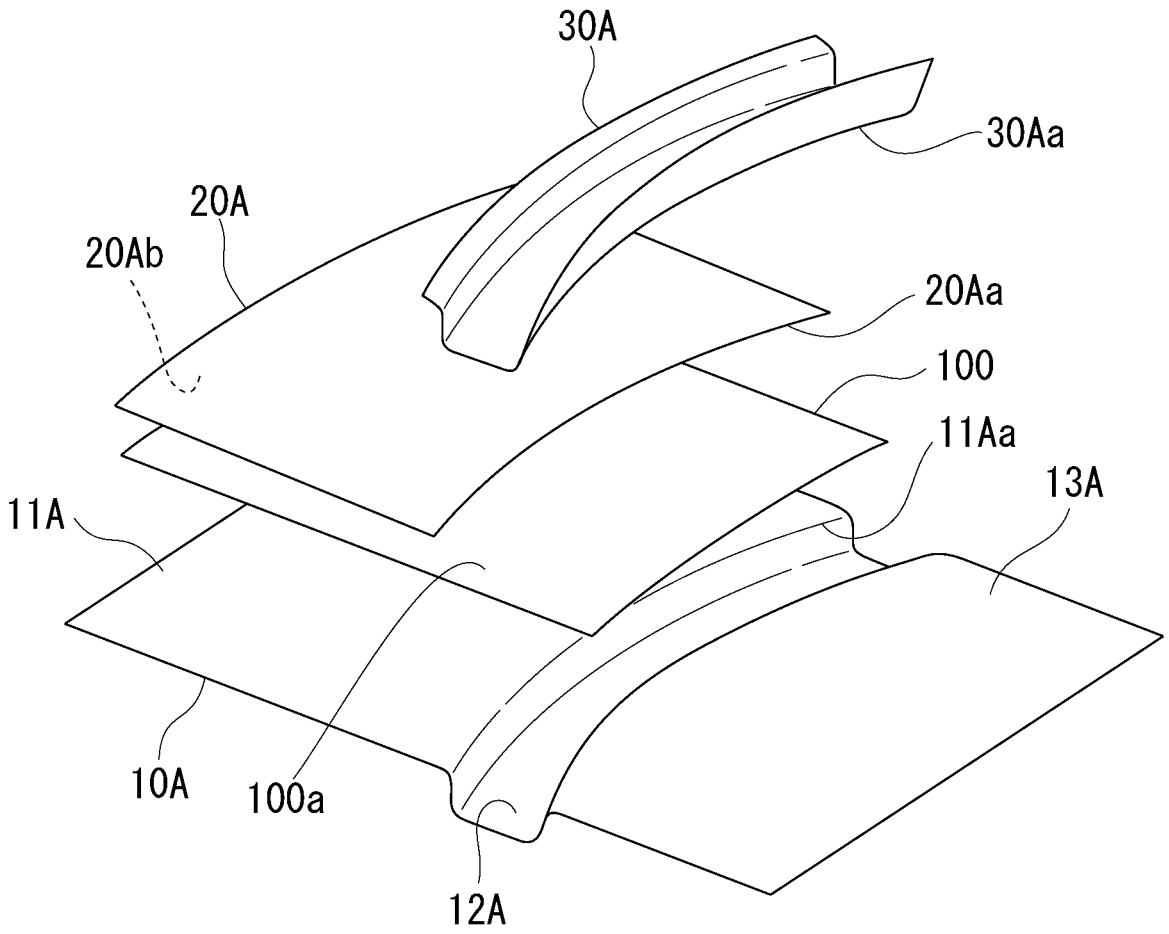
FIG. 2 is a view showing a comparative example to be compared when explaining effects of the first embodiment and is a perspective view of dies and a blank used in a first step.

FIG. 2 is a perspective view of each die and a blank 100 used in a first step of the present comparative example. As shown in FIG. 2, a manufacturing device of a structural member in the present comparative example includes a die 10A on which the blank 100 is placed, a holder 20A that presses down a portion of the blank 100 that will become the top plate part 2 from above, a punch 30A that forms a recessed groove on a portion of the blank 100 that will become the curved reinforcing part 3, and a drive unit (not shown) that drives the holder 20A and the punch 30A independently of each other.

The die 10A includes a top plate support surface 11A that supports a portion of the blank 100 that will become the top plate part 2, a die groove 12A that is continuous with the top plate support surface 11A, and a horizontal plane 13A that is continuous with the die groove 12A. The top plate support surface 11A is a horizontal plane including an edge 11Aa that is curved in the same direction as the curved edge 2*a* with the same radius of curvature.

Figure 3:
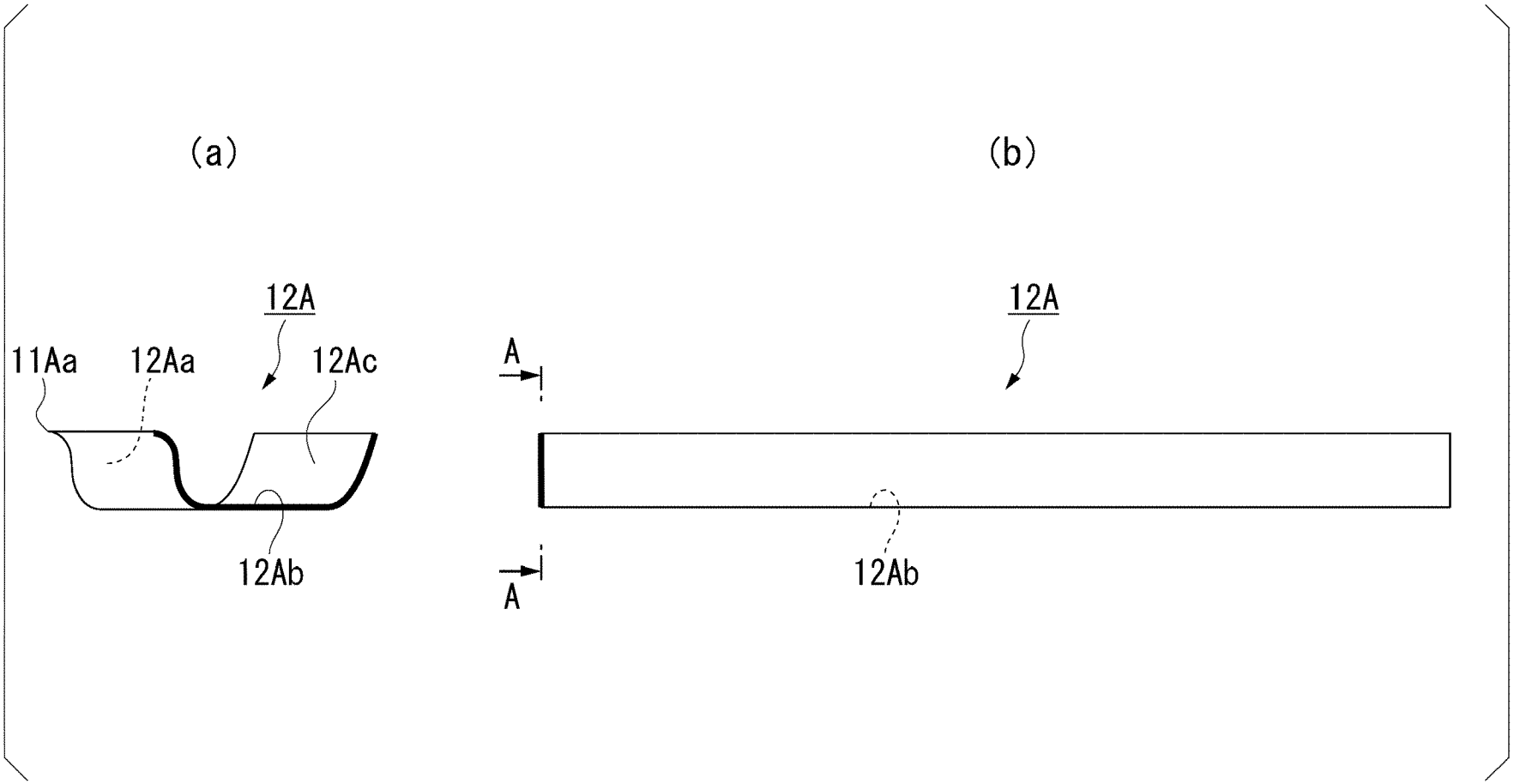
FIG. 3 is a view showing a shape of a die groove bottom surface of the die used in the comparative example, in which FIG. 3(*a*) is a view along line A-A indicated by the arrows in FIG. 3(*b*) and FIG. 3(*b*) is a side view from a direction perpendicular to a longitudinal direction.

The die groove 12A is continuous with the top plate support surface 11A at the edge 11Aa and has the shape shown in FIG. 3. FIG. 3 is a view showing a shape of the die groove 12A, in which FIG. 3(*a*) is a view along line A-A indicated by the arrows in FIG. 3(*b*) and FIG. 3(*b*) is a side view from a direction perpendicular to a longitudinal direction. In FIGS. 3(*a*) and 3(*b*), end edges are shown by a thick line to make a positional relationship of the end edges in both figures clear. Further, a thick line may be used to show a positional relationship similarly in the following drawings.

As shown in FIG. 3, the die groove 12A includes a die groove side surface 12Aa continuous with the edge 11Aa and directed vertically downward, a die groove bottom surface 12Ab continuous with the die groove side surface 12Aa and directed in a direction horizontally away from the top plate support surface 11A, and a die groove side surface 12Ac continuous with the die groove bottom surface 12Ab and directed vertically upward.

The die groove side surface 12Aa and the die groove side surface 12Ac have the same height dimension in a vertical direction at any position from one end to the other end in an extending direction thereof. The die groove side surface 12Aa and the die groove side surface 12Ac have a concave curved shape that is curved in the same direction as the edge 11Aa in a plan view.

The die groove bottom surface 12Ab has a width dimension in a horizontal direction that is the same at any position from one end to the other end in an extending direction thereof. Further, the die groove bottom surface 12Ab has a concave curved shape that is curved in the same direction as the edge 11Aa in a plan view. Further, as shown in FIG. 3(*b*), the die groove bottom surface 12Ab forms a horizontal plane without unevenness from one end to the other end of the die groove 12A.

Returning to FIG. 2, the holder 20A includes a concave curved edge 20Aa having the same radius of curvature in the same direction as the edge 11Aa, and a flat lower surface 20Ab that presses down an upper surface 100*a* of the blank 100.

The punch 30A has a pressurizing surface 30Aa having substantially the same shape as the die groove 12A. The pressurizing surface 30Aa has a shape slightly smaller than the shape of the die groove 12A in consideration of a plate thickness of the blank 100. A lowermost surface of the pressurizing surface 30Aa forms a horizontal plane without unevenness from one end to the other end thereof.

The drive unit includes a drive mechanism that brings the holder 20A closer to and further away from the die 10A, and another drive mechanism that brings the punch 30A closer to and further away from the die groove 12A. Therefore, the holder 20A and the punch 30A can be driven independently of each other.

In order for the manufacturing device of a structural member having the above-described configuration to perform the first step, first, the blank 100 is placed on the top plate support surface 11A of the die 10A, and then the holder 20A is lowered to sandwich the blank 100 between the holder 20A and the die 10A. At that time, an end portion of the blank 100 is disposed to reach the horizontal plane 13A of the die 10A and then fixed.

Next, when the punch 30A is lowered by the drive mechanism, the end portion of the blank 100 is sandwiched between the die groove 12A of the die 10A and the pressurizing surface 30Aa to be plastically deformed. Thereafter, the blank 100 after the first step is taken out from a top of the die 10A by raising the punch 30A and the holder 20A by the drive mechanism.

Figure 4:
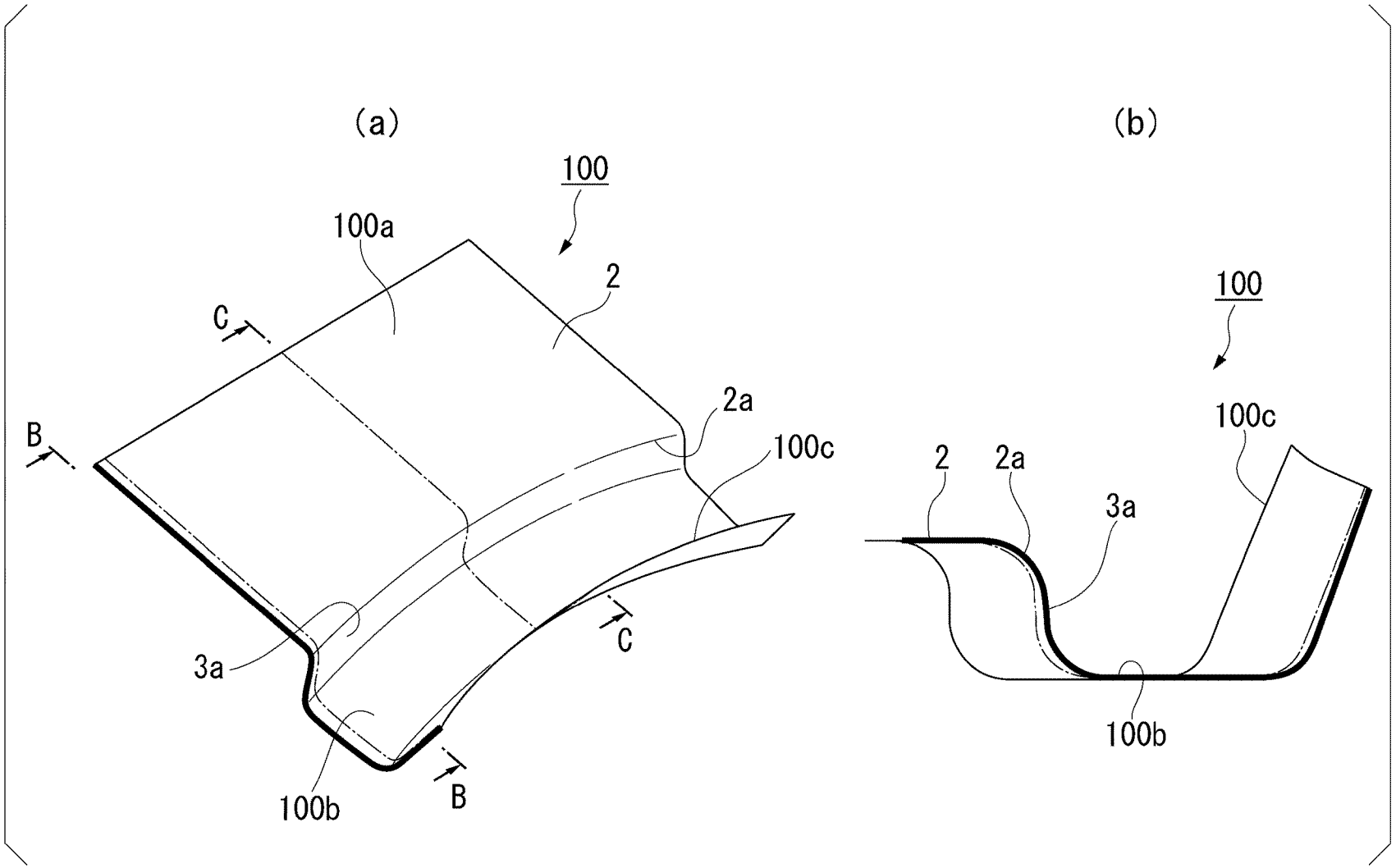
FIG. 4 is a view showing the blank formed in the first step of the comparative example, in which FIG. 4(*a*) is a perspective view and FIG. 4(*b*) is a view along line B-B indicated by the arrows in FIG. 4(*a*).
Figure 5:
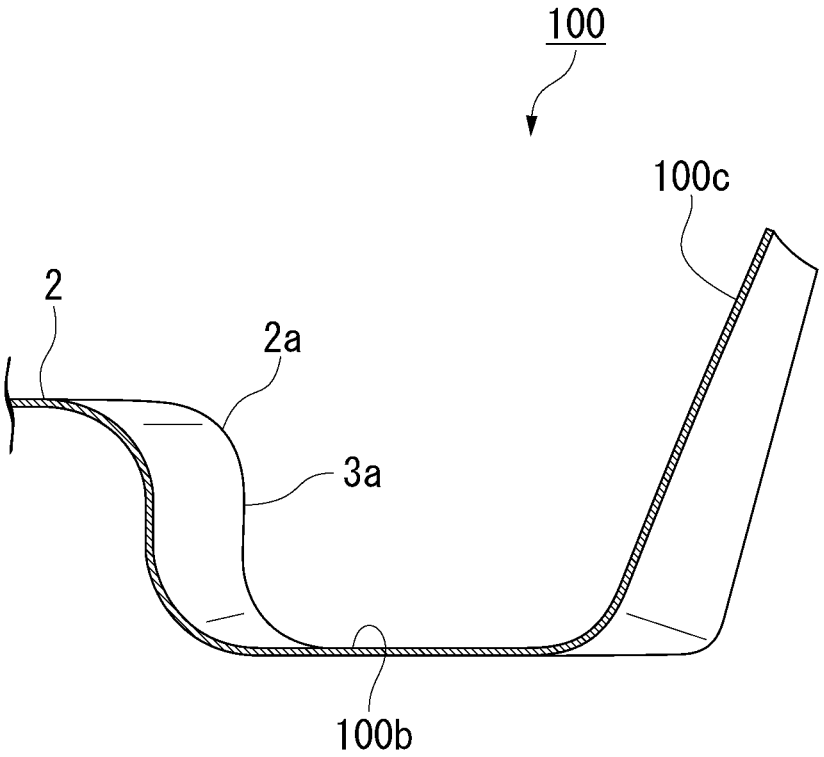
FIG. 5 is a view showing the blank after the first step of the comparative example and is a view along line C-C indicated by the arrows in FIG. 4(*a*).

The blank 100 that has been subjected to the press processing in this way is shown in FIGS. 4 and 5. In FIG. 4, FIG. 4(*a*) is a perspective view, and FIG. 4(*b*) is a view along line B-B indicated by the arrows in FIG. 4(*a*). FIG. 5 is a view along line C-C indicated by the arrows in FIG. 4(*a*). After the first step, the top plate part 2 and the inner wall 3*a* that is continuous with the top plate part 2 via the curved edge 2*a* are integrally formed. In the blank 100, an upper surface and a lower surface of a concave band-shaped arcuate wall part 100*b* pressurized by a lower end surface of the pressurizing surface 30Aa form a horizontal plane from one end to the other end in an extending direction thereof. The band-shaped arcuate wall part 100*b* is a portion that is designed to form the bottom wall 3*b*, the outer wall 3*c*, and the upper wall 3*d* through the following second and third steps.

Also, a vertical wall part 100*c* continuous with the band-shaped arcuate wall part 100*b* and rising upward is also formed in the blank 100. The vertical wall part 100*c* is sandwiched between the pressurizing surface 30Aa and the die groove 12A to be plastically deformed into a concave curved shape, but since stretch flange deformation at an upper end edge thereof is insufficient, the vertical wall part 100*c* obliquely retreats to become more distant from the curved edge 2*a* as shown in FIG. 5.

[Comparative Example/Second Step]

Figure 6:
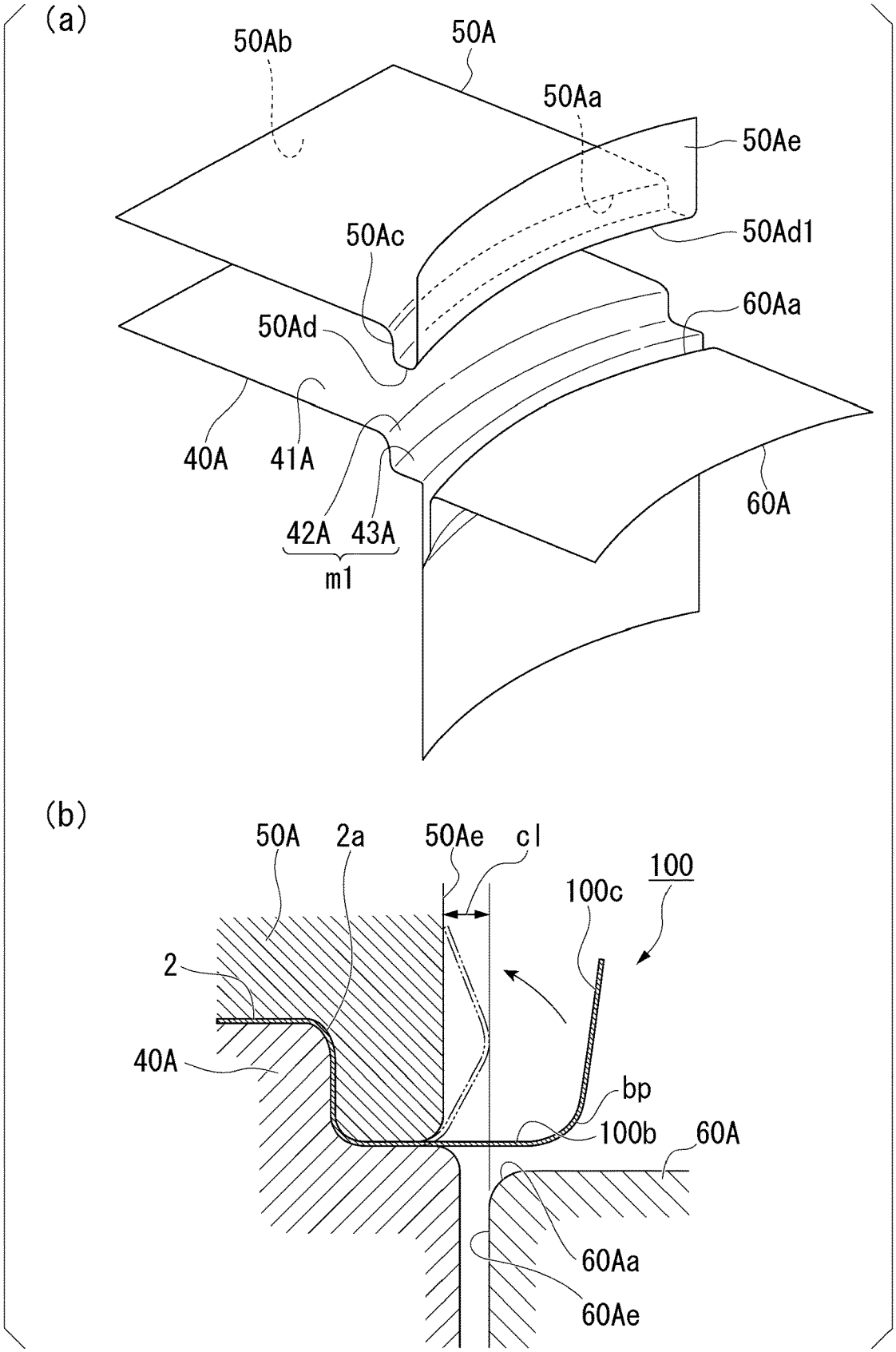
FIG. 6(*a*) is a perspective view of dies used in a second step of the comparative example and a second step of the first embodiment.
Figure 7:
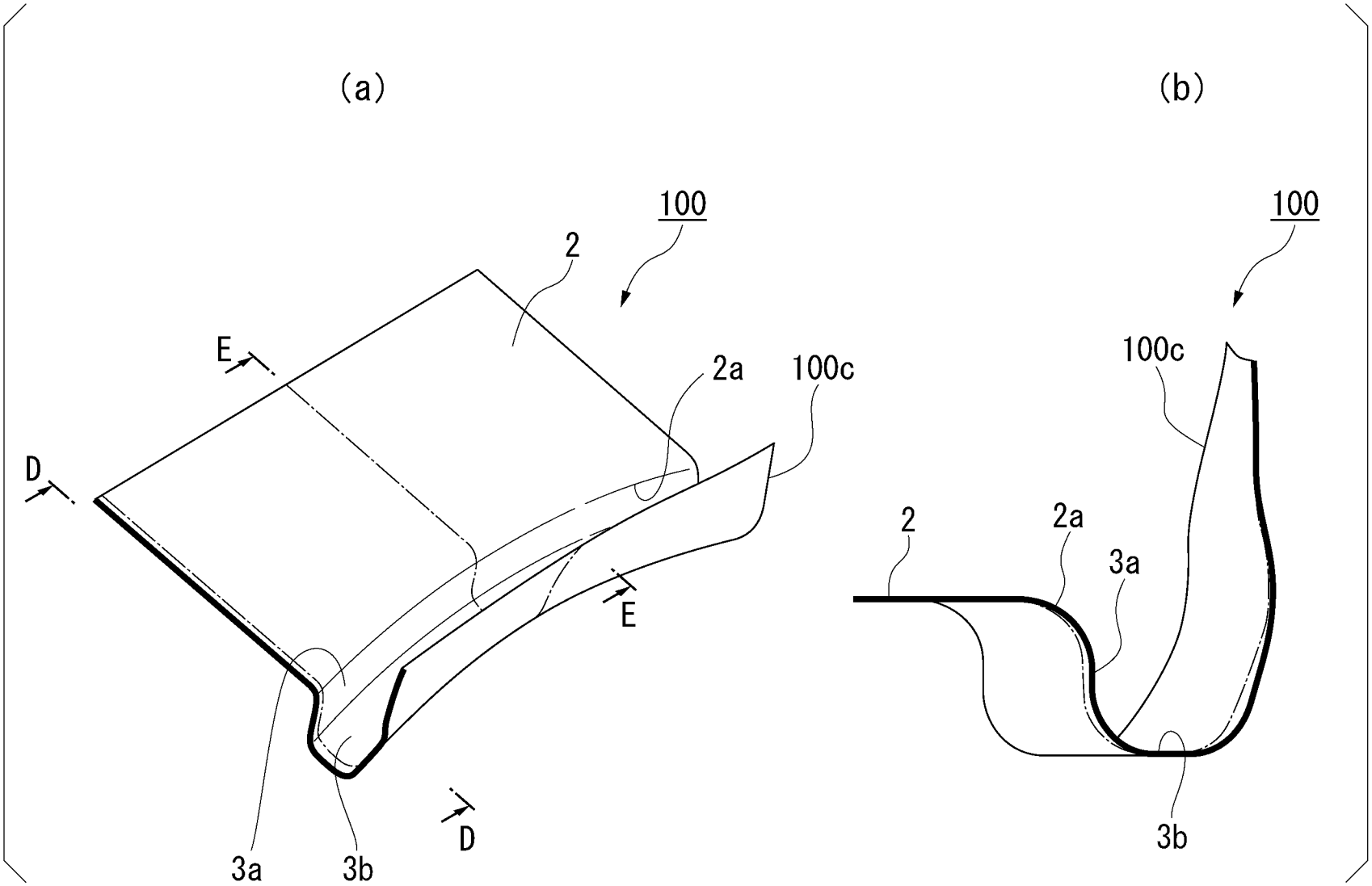
FIG. 7 is a view showing the blank after the second step of the comparative example, in which FIG. 7(*a*) is a perspective view and FIG. 7(*b*) is a view along line D-D indicated by the arrows in FIG. 7(*a*).

Next, a second step of the comparative example will be described with reference to FIGS. 6(*a*) and 7. FIG. 6(*a*) is a perspective view of dies used in the second step. FIG. 7 is a view showing the blank after the second step, in which FIG. 7(*a*) is a perspective view and FIG. 7(*b*) is a view along line D-D indicated by the arrows in FIG. 7(*a*).

The manufacturing device of a structural member of the present comparative example further includes dies shown in FIG. 6(*a*). These dies include a die 40A on which the blank 100 after the first step is placed, a holder 50A that presses down a portion of the blank 100 that will become the top plate part 2 and a portion thereof that will become the bottom wall 3*b* from above, a punch 60A that forms the outer wall 3*c* by partially pushing up and bending the band-shaped arcuate wall part 100*b*, a drive mechanism (not shown) that brings the holder 50A closer to and further away from the die 40A, and another drive mechanism (not shown) that brings the punch 60A closer to and further away from the blank 100.

The die 40A includes a top plate support surface 41A that supports a portion of the blank 100 that will become the top plate part 2, and a die groove (second die groove) m1 that is continuous with the top plate support surface 41A. The die groove m1 includes a die groove side surface 42A continuous with the top plate support surface 41A and formed vertically downward, and a die groove bottom surface 43A continuous with the die groove side surface 42A and directed in a direction horizontally away from the top plate support surface 41A.

The die groove side surface 42A has a height dimension in a vertical direction that is the same at any position from one end to the other end in an extending direction thereof. Then, the die groove side surface 42A has a concave curved shape having the same radius of curvature in the same direction as the edge 11Aa in a plan view.

The die groove bottom surface 43A has a width dimension in a horizontal direction that is the same at any position from one end to the other end in an extending direction thereof. Then, the die groove bottom surface 43A has a concave curved shape that is curved in the same direction as the edge 11Aa in a plan view. Further, the die groove bottom surface 43A forms a horizontal plane without unevenness from one end to the other end thereof.

The holder 50A includes a concave curved edge 50Aa having the same radius of curvature in the same direction as the edge 11Aa, a flat lower surface 50Ab that presses down the upper surface 100*a* of the blank 100, an inner wall surface 50Ac that is continuous with the lower surface 50Ab via the edge 50Aa, a lower surface 50Ad that is continuous with the inner wall surface 50Ac, and a vertical wall surface 50Ae continuous with the lower surface 50Ad and rising vertically upward.

The inner wall surface 50Ac and the vertical wall surface 50Ae are parallel to each other and have a concave curved shape that is curved in the same direction as the edge 50Aa.

Also, the lower surface 50Ad has a concave curved shape that is curved in the same direction as the edge 11Aa in a bottom view. Then, a width dimension of the lower surface 50Ad corresponds to the width dimension of the bottom wall 3*b* of the structural member 1. That is, the lower surface 50Ad has a smaller width than the band-shaped arcuate wall part 100*b* to pressurize only a portion of the band-shaped arcuate wall part 100*b* shown in FIG. 4 to be the bottom wall 3*b*. Therefore, a portion of the band-shaped arcuate wall part 100*b* that is not pressurized by the lower surface 50Ad bends vertically upward to become the outer wall 3*c* when the punch 60A pushes it upward. More specifically, the band-shaped arcuate wall part 100*b* bends in a state in which a ridge line 50Ad1 of the lower surface 50Ad shown in FIG.

6(*a*) hits a center of the band-shaped arcuate wall part 100*b* in a width direction. Therefore, the bottom wall 3*b* and the vertical wall part 100*c* which includes a portion to be the outer wall 3*c* in the next step are formed with this bending position as a boundary.

The punch 60A has a convex curved ridge line 60Aa that is curved in the same direction as the ridge line 50Ad1 of the holder 50A in a plan view. Then, when the punch 60A is raised, the ridge line 60Aa hits a back surface side of the band-shaped arcuate wall part 100*b* to apply a bend in cooperation with the ridge line 50Ad1.

In order to perform the second step using the dies described above, first, the blank 100 after the first step is placed on the top plate support surface 41A of the die 40A, and then the holder 50A is lowered to pressurize the blank 100 while sandwiching the blank 100 between the holder 50A and the die 40A. Thereby, the inner wall 3*a* of the blank 100 is sandwiched and fixed between the die groove side surface 42A and the inner wall surface 50Ac. Further, a part of the band-shaped arcuate wall part 100*b* of the blank 100 is sandwiched and fixed between the die groove bottom surface 43A and the lower surface 50Ad while leaving the other portion.

Next, when the punch 60A is raised by the drive mechanism, the other portion of the band-shaped arcuate wall part 100*b* is pushed upward from below. As a result, a fold line is formed between the portion of the band-shaped arcuate wall part 100*b* to be the bottom wall 3*b* and a portion thereof to be the vertical wall part 100*c*.

The blank 100 that has been subjected to the press processing in the second step in this way is shown in FIG. 7. After the second step, the top plate part 2, the inner wall 3*a* formed integrally with the top plate part 2 via the curved edge 2*a*, the bottom wall 3*b* that is continuous with the inner wall 3*a*, and the vertical wall part 100*c* that is continuous with the bottom wall 3*b* are formed. The vertical wall part 100*c* has an elongated height dimension in a vertical direction by applying a bend to a part of the band-shaped arcuate wall part 100*b* as can be found in comparison with that in FIG. 4(*b*). Also, a state of being retreated due to insufficient stretch flange deformation at the upper end edge of the vertical wall part 100*c* in the first step remains even after the second step.

[Comparative Example/Third Step]

Next, the third step of the present comparative example will be described below with reference to FIGS. 8 to 10.

Figure 8:
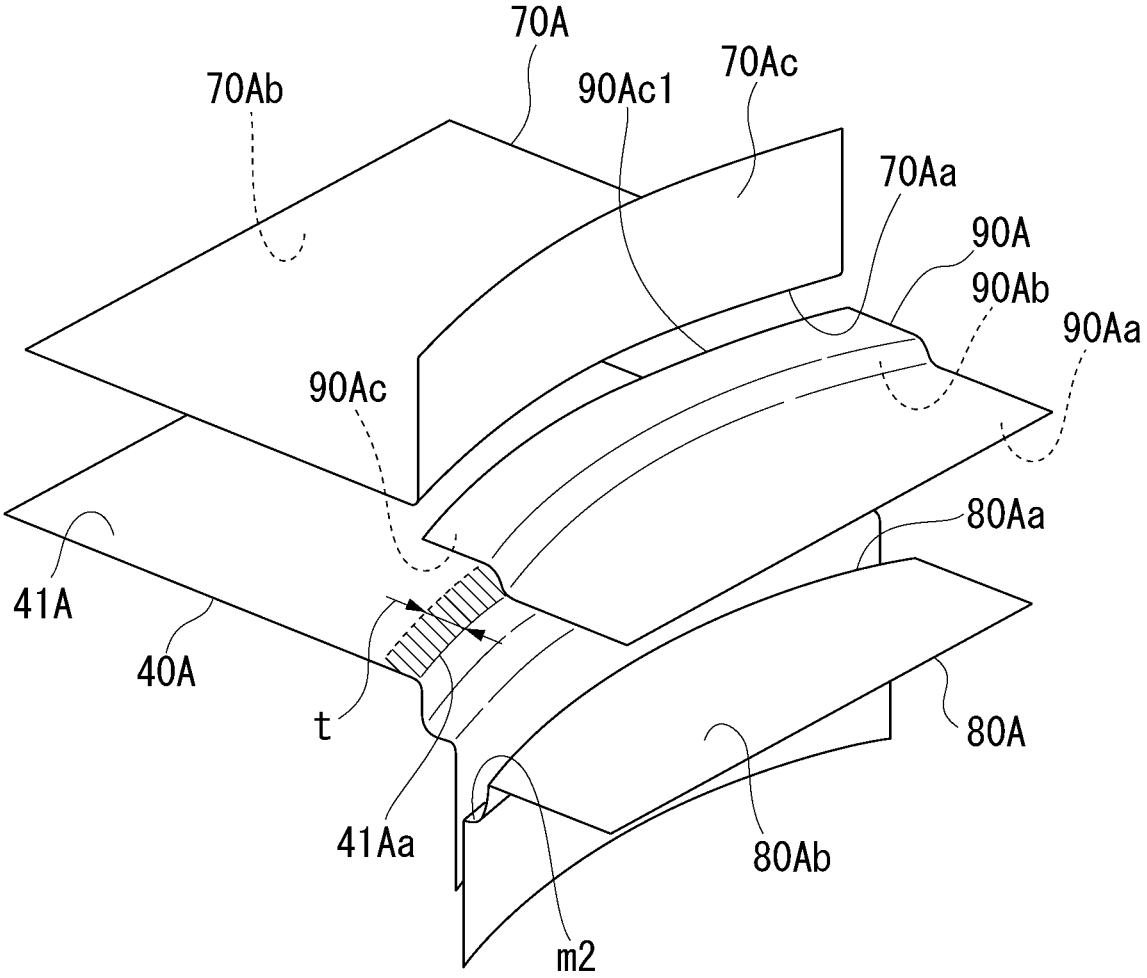
FIG. 8 is a perspective view of dies used in a third step of the comparative example and a third step of the first embodiment.

FIG. 8 is a perspective view of dies used in the third step. FIG. 9 is a view showing a shape of the blank 100 before the third step is started and is a view along line E-E indicated by the arrows in FIG. 7(*a*). FIG. 10 is a view showing the blank during the third step, in which FIG. 10(*a*) is a perspective view and FIG. 10(*b*) is a view along line F-F indicated by the arrows in FIG. 10(*a*).

The manufacturing device of a structural member of the present comparative example further includes dies shown in FIG. 8. These dies include the die 40A on which the blank 100 after the second step is continuously placed, a holder 70A disposed above the die 40A and configured to move vertically, a punch 80A disposed adjacent to the die 40A and configured to move vertically, a pad 90A disposed above the punch 80A and configured to move vertically, a drive mechanism (not shown) that brings the holder 70A closer to and further away from the die 40A, another drive mechanism (not shown) that brings the punch 80A closer to and further away from the blank 100, and still another drive mechanism (not shown) that brings the pad 90A closer to and further away from the punch 80A.

The holder 70A includes a concave curved ridge line 70Aa that is curved in the same direction as the edge 11Aa in a plan view, a flat lower surface 70Ab that presses down the upper surface 100*a* of the blank 100, and a vertical wall surface 70Ac continuous with the lower surface 70Ab via the ridge line 70Aa and rising vertically upward.

The punch 80A includes a die groove (third die groove) m2 having a convex curved edge 80Aa curved in the same direction as the ridge line 70Aa of the holder 70A and adjacent to the die 40A in a plan view, and a flat upper surface 80Ab that is continuous with the edge 80Aa. When the punch 80A is raised, the edge 80Aa thereof hits a lower end portion of the vertical wall part 100*c* of the blank 100 to apply a bend there.

The pad 90A includes a flat lower surface 90Aa, a convex curved inclined surface 90Ab that is continuous with the lower surface 90Aa, and a convex curved lower surface 90Ac that is continuous with the inclined surface 90Ab. A step is formed between the lower surface 90Aa and the lower surface 90Ac via the inclined surface 90Ab. Also, an edge 90Ac1 of the lower surface 90Ac has a convex curved shape having the same radius of curvature in the same direction as the ridge line 70Aa.

In order to perform the third step using the dies described above, first, while the blank 100 after the second step remains placed on the top plate support surface 41A of the die 40A, the holder 70A is used instead of the holder 50A and the top plate part 2 is sandwiched between the holder 70A and the top plate support surface 41A.

Figure 9:
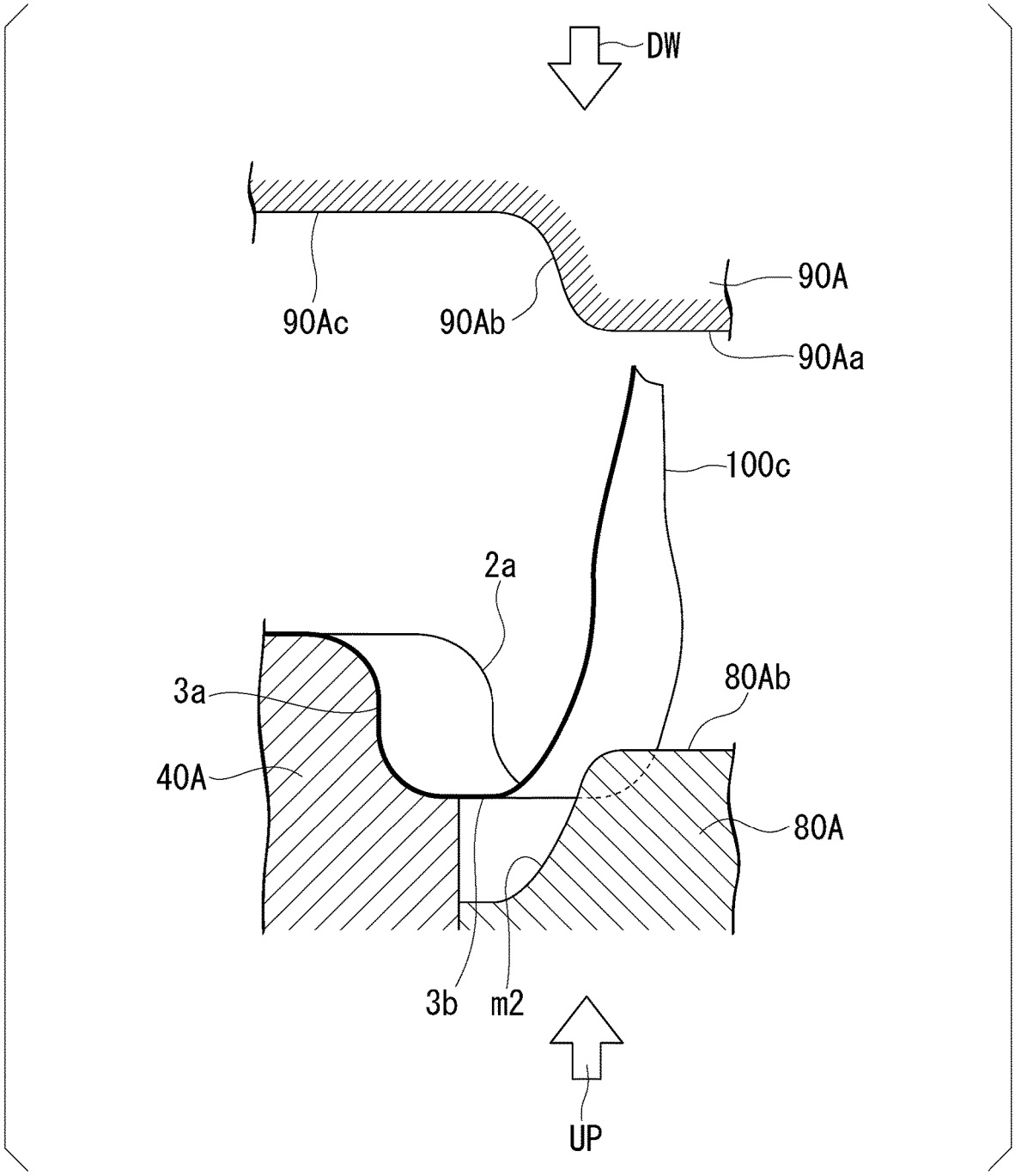
FIG. 9 is a view showing a shape of the blank before the third step of the comparative example is started and is a view along line E-E indicated by the arrows in FIG. 7(*a*).

Next, in FIG. 9, the punch 80A is raised in a direction of an arrow UP to support the bottom wall 3*b* of the blank 100 and a portion of the vertical wall part 100*c* to be the outer wall 3*c* from outer peripheries thereof.

Thereafter, in FIG. 9, the pad 90A is lowered in a direction of an arrow DW to bring the lower surface 90Aa of the pad 90A into contact with the upper surface 80Ab of the punch 80A. At this time, when the upper end edge of the vertical wall part 100*c* of the blank 100 is all positioned below the inclined surface 90Ab or the lower surface 90Ac, the vertical wall part 100*c* can be bent toward the top plate part 2. However, in the present comparative example, after the first step and the second step, since the vertical wall part 100*c* has remained inclined in a direction of retreating from the top plate part 2, the upper end edge of the vertical wall part 100*c* comes into contact with the lower surface 90Aa when the pad 90A is lowered in the third step. Then, the vertical wall part 100*c* receives pressure of the pad 90A that is pushed down, is collapsed in a direction opposite to the original direction, and is finally sandwiched and crushed between the lower surface 90Aa and the upper surface 80Ab.

Figure 10:
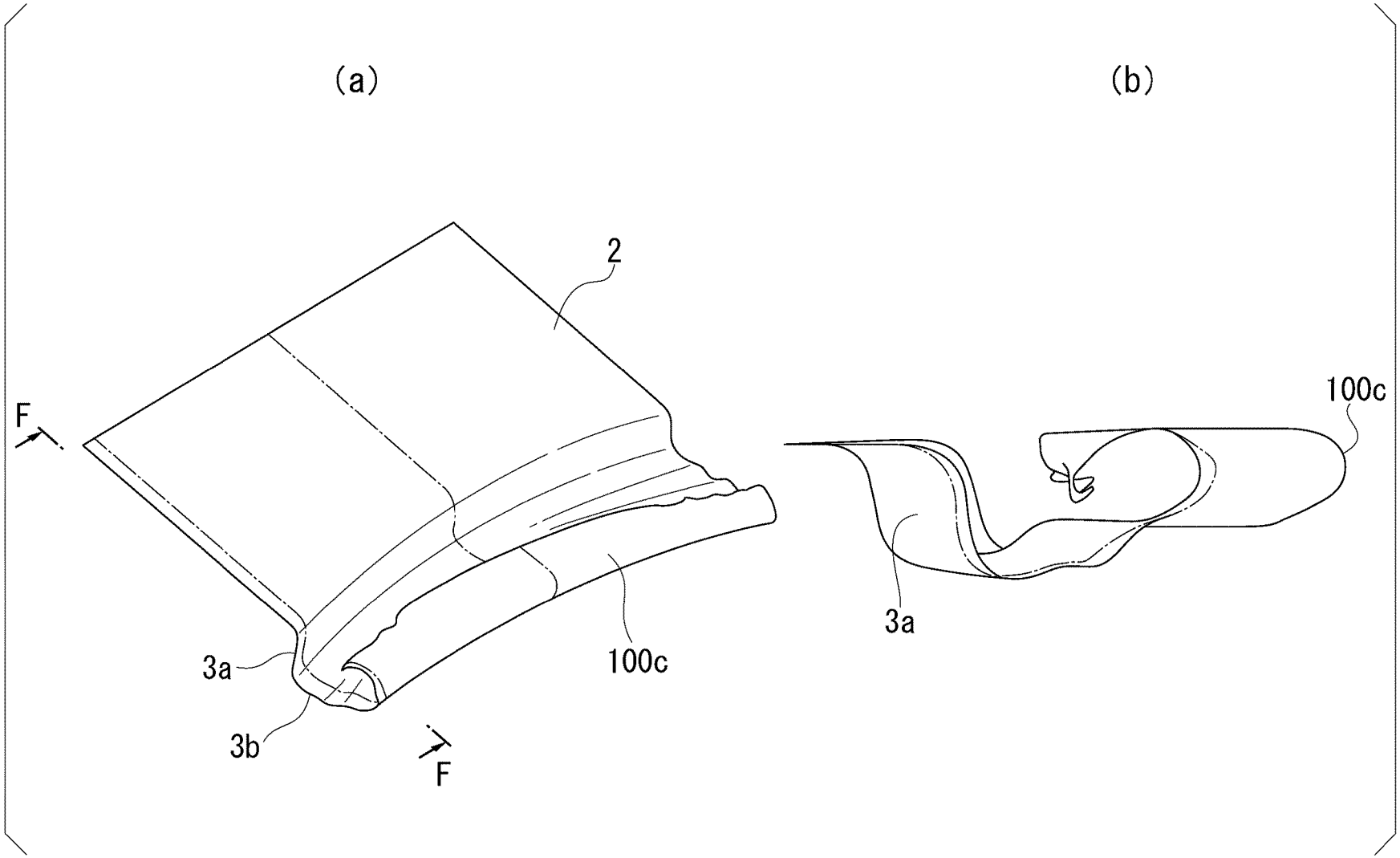
FIG. 10 is a view showing the blank during the third step of the comparative example, in which FIG. 10(*a*) is a perspective view and FIG. 10(*b*) is a view along line F-F indicated by the arrows in FIG. 10(*a*).

As a result, as shown in FIG. 10, since the curved reinforcing part 3 having a closed cross-sectional shape is not formed on a lateral side of the top plate part 2, the part shape shown in FIG. 1 cannot be obtained.

Figure 11:
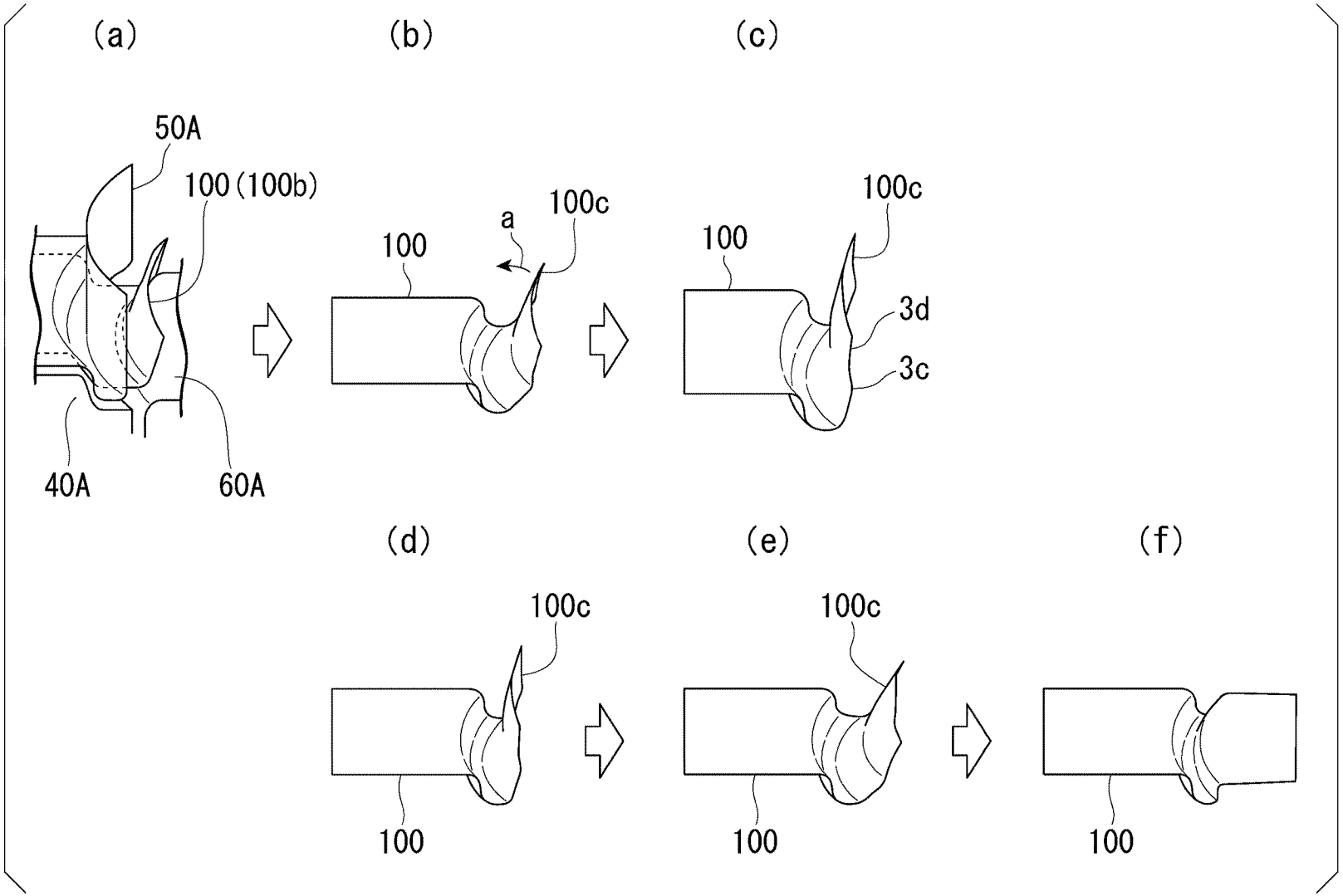
FIG. 11 is a perspective view in which changes in shape of the blank from the second step to the third step of the comparative example are arranged in a time series in order from (a) to (f).

Of the steps described above, a perspective view in which changes in shape of the blank 100 from the second step to the third step are arranged in a time series in order from (a) to (f) is shown in FIG. 11. Further, in FIG. 11, FIG. 11(*a*) to FIG. 11(*c*) indicate the second step, and FIG. 11(*d*) to FIG. 11(*f*) indicate the third step.

First, in FIG. 11(*a*), the blank 100 after the first step is sandwiched between the die 40A and the holder 50A. Then, when the punch 60A is raised, the state shown in FIG. 11(*b*) is obtained. At this time, the upper end edge of the vertical wall part 100*c* attempts the stretch flange deformation in an extending direction thereof, but a sufficient amount of deformation cannot be obtained. Therefore, the vertical wall part

100*c* cannot collapse in a direction indicated by an arrow a. As a result, since a fold line at a boundary between the portion to be the outer wall 3*c* and a portion to be the upper wall 3*d* in the vertical wall part 100*c* is not easily made even when the punch 60A is further raised, the upper end edge of the vertical wall part 100*c* remains spaced apart from the top plate part 2.

In the following third step, since the upper end edge of the vertical wall part 100*c* is pushed down by the pad 90A in a state in which the vertical wall part 100*c* of the blank 100 is not sufficiently collapsed, as shown in FIGS. 11(*d*) to 11(*e*), the vertical wall part 100*c* is collapsed in an opposite direction to the original direction and is pressed and crushed as shown in FIG. 11(*f*).

As described above, it was not easy to form the curved reinforcing part 3 along the curved edge 2*a* for the flat plate-shaped blank 100 having the curved edge 2*a*, and as a result of intensive research by the present inventors on the reason, it was found that the cause was insufficient stretch flange deformation in FIG. 11(*b*) in the second step. A first embodiment which improved this point will be described below with reference to FIGS. 12 to 20.

[First Embodiment/First Step]

Figure 12:
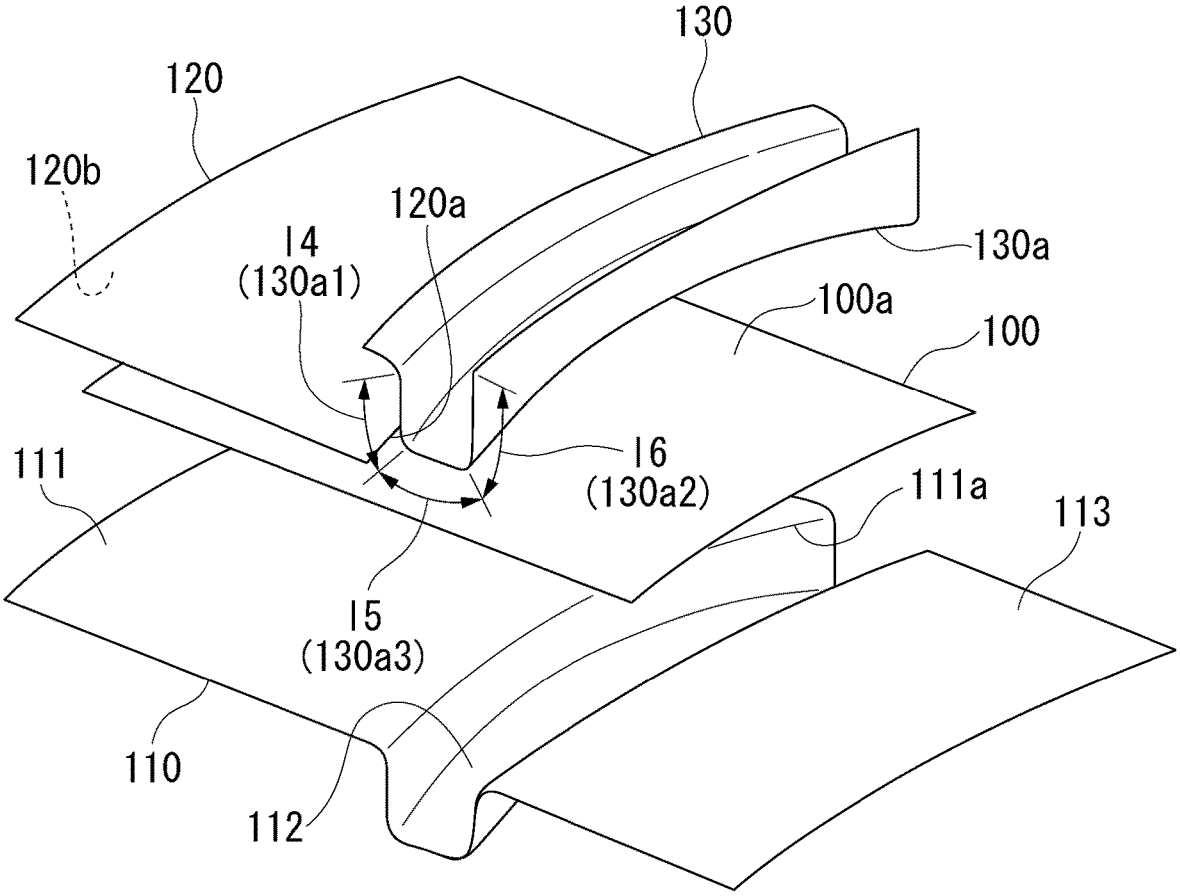
FIG. 12 is a perspective view of dies and a blank used in a first step of the first embodiment of the present invention.

FIG. 12 is a perspective view of dies and a blank 100 used in a first step of the present embodiment. As shown in FIG. 12, a manufacturing device of a structural member of the present embodiment includes a die 110 on which the blank 100 is placed, a holder 120 that presses down a portion of the blank 100 that will become the top plate part 2 from above, a punch 130 that forms a recessed groove on a portion of the blank 100 forming the curved reinforcing part 3, and a drive unit (not shown) that drives the holder 120 and the punch 130 independently of each other.

The die 110 includes a top plate support surface 111 that supports a portion of the blank 100 that will become the top plate part 2, a die groove 112 that is continuous with the top plate support surface 111, and a horizontal plane 113 that is continuous with the die groove 112. The top plate support surface 111 is a horizontal plane having an edge 111*a* that is curved in the same direction as the curved edge 2*a* with the same radius of curvature.

Figure 13:
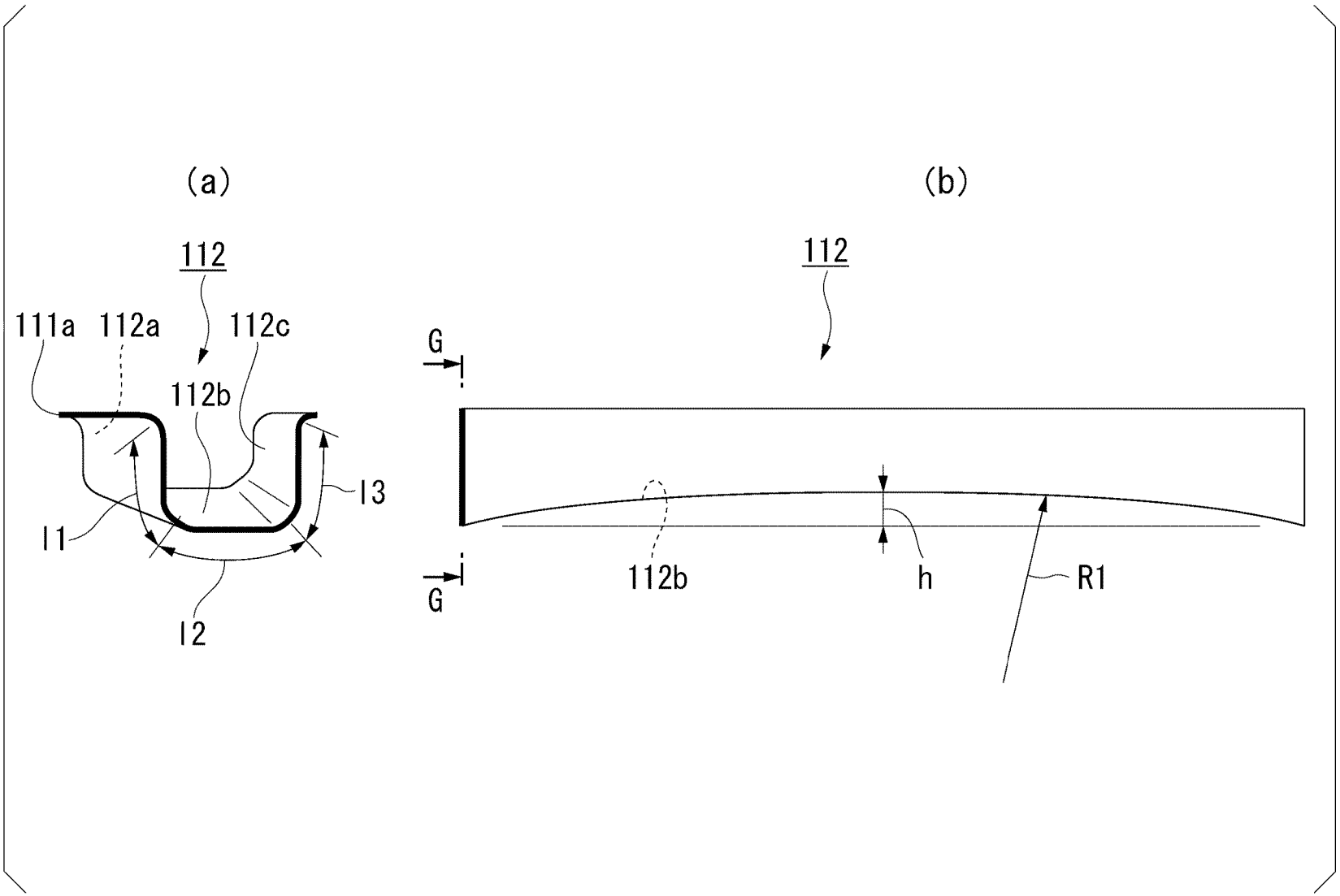
FIG. 13 is a view showing a shape of a die groove bottom surface of the die used in the first embodiment, in which FIG. 13(*a*) is a view along line G-G indicated by the arrows in FIG. 13(*b*), and FIG. 13(*b*) is a side view from a direction perpendicular to a longitudinal direction.

The die groove 112 is continuous with the top plate support surface 111 at the edge 111*a* and has the shape shown in FIG. 13. Further, FIG. 13 is a view showing the shape of the die groove 112, in which FIG. 13(*a*) is a view along line G-G indicated by the arrows in FIG. 13(*b*), and FIG. 13(*b*) is a side view from a direction perpendicular to a longitudinal direction. In FIGS. 13(*a*) and 13(*b*), end edges are shown by a thick line to make a positional relationship of the end edges in both figures clear. Further, a thick line may be used to show a positional relationship similarly in the following drawings.

As shown in FIG. 13, the die groove 112 includes a die groove side surface 112*a* continuous with the edge 111*a* and directed vertically downward, a die groove bottom surface 112*b* continuous with the die groove side surface 112*a* and directed in a direction horizontally away from the top plate support surface 111, and a die groove side surface 112*c* continuous with the die groove bottom surface 112*b* and directed vertically upward.

The die groove side surface 112*a* and the die groove side surface 112*c* have a difference in height dimension in a vertical direction between a central position and both end positions in an extending direction thereof. That is, in a side view, the die groove side surface 112*a* and the die groove side surface 112*c* have upper end edges formed in a linear shape while having lower end edges formed in a curved line shape that is convex vertically upward. A radius of curvature R1 of the curved line shape is preferably larger than the radius of curvature R of the curved edge 2*a* in the structural member 1 shown in FIG. 1. The reason will be described later.

The die groove side surface 112*a* and the die groove side surface 112*c* having such lower end edges of an arcuate shape have a height dimension in a vertical direction that is larger at both of the end positions than at the central position in an extending direction thereof.

The die groove side surface 112*a* and the die groove side surface 112*c* have a curved shape that is curved in the same direction as the edge 111*a* in a plan view. Also, a radius of curvature of the die groove side surface 112*a* in a plan view is the same as the radius of curvature R of the curved edge 2*a* in the structural member 1. Further, a radius of curvature of the die groove side surface 112*c* in a plan view is larger than the radius of curvature of the die groove side surface 112*a*. Due to the difference in radius of curvature, the difference in height dimension in the extending direction of the die groove side surface 112*a* and the die groove side surface 112*c* is absorbed. In other words, a sum of perimeters, which is a sum of lengths 11, 12, and 13 shown in FIG. 13(*a*), is the same at any position in an extending direction of the die groove 112. Thereby, a size of a cross-sectional shape of the curved reinforcing part 3 after forming can be made uniform at any position in the extending direction thereof.

The die groove bottom surface 112*b* has a concave curved shape that is curved in the same direction as the edge 111*a* in a plan view. Further, as shown in FIG. 13(*b*), the die groove bottom surface 112*b* has a height difference h in a longitudinal sectional view between a central position and an end portion position in an extending direction thereof. That is, the die groove bottom surface 112*b* has a convex curved shape that is curved so that both of the end positions are at a low position relative to the central position in the extending direction thereof.

Returning to FIG. 12, the holder 120 includes a concave curved edge 120*a* having the same radius of curvature in the same direction as the edge 111*a*, and a flat lower surface 120*b* that presses down an upper surface 100*a* of the blank 100.

The punch 130 includes a pressurizing surface 130*a* having substantially the same shape as the die groove 112. The pressurizing surface 130*a* has a shape slightly smaller than that of the die groove 112 in consideration of a plate thickness of the blank 100.

The pressurizing surface 130*a* has a pair of punch outer surfaces 130*a*1 and 130*a*2, and a punch lower end surface 130*a*3 that connects lower end edges thereof. The punch outer surfaces 130*a*1 and 130*a*2 and the punch lower end surface 130*a*3 have a curved shape that is curved in the same direction as the edge 111*a* in a plan view.

The punch outer surfaces 130*a*1 and 130*a*2 have a difference in height dimension in a vertical direction between a central position and both end positions in an extending direction thereof. That is, in a side view, the punch outer surfaces 130*a*1 and 130*a*2 have the lower end edges formed in a curved line shape that is convex vertically upward while having upper end edges formed in a linear shape.

The punch outer surfaces 130*a*1 and 130*a*2 having the lower end edges of such an arcuate shape have a height dimension in a vertical direction that is larger at both of the end positions than at the central position in the extending direction.

The punch outer surfaces 130*a*1 and 130*a*2 have a concave curved shape that is curved in the same direction as the edge 111*a* in a plan view. Also, a radius of curvature of the punch outer surface 130*a*1 in a plan view is the same as a radius of curvature R of the curved edge 2*a* in the structural member 1. Further, a radius of curvature of the punch outer surface 130*a*2 in a plan view is larger than the radius of curvature of the punch outer surface 130*a*1. Due to the difference in radius of curvature, the difference in height dimension in the extending direction of the punch outer surfaces 130*a*1 and 130*a*2 is absorbed. In other words, a sum of perimeters, which is a sum of lengths 14, 15, and 16 shown in FIG. 12, is the same at any position in an extending direction of the punch 130.

The drive unit includes a drive mechanism that brings the holder 120 closer to and further away from the die 110, and another drive mechanism that brings the punch 130 closer to and further away from the die groove 112. Therefore, the holder 120 and the punch 130 can be driven independently of each other.

The blank 100 is a flat plate material having a substantially rectangular shape. As a plate thickness thereof, 0.8 mm to 6.0 mm is exemplified, but the present invention is not limited to the thickness range. As a material of the blank 100, a metal material such as steel, an aluminum alloy, or a magnesium alloy, or a resin material such as glass fibers or carbon fibers can be used. Further, a composite material of a metal material and a resin material may be used as a material of the blank 100.

In order for the manufacturing device of a structural member having the above-described configuration to perform the first step, first, the blank 100 is placed on the top plate support surface 111 of the die 110, and then the holder 120 is lowered to sandwich the blank 100 between the holder 120 and the die 110. At that time, an end portion of the blank 100 is disposed to also overlap the horizontal plane 113 of the die 110 and then fixed.

Next, when the punch 130 is lowered by the drive mechanism, the blank 100 is sandwiched between the die groove 112 of the die 110 and the pressurizing surface 130*a* to be plastically deformed. Thereafter, the punch 130 is raised and then the holder 120 is raised by the drive mechanisms. Then, the blank 100 after the first step is taken out from a top of the die 110.

Figure 14:
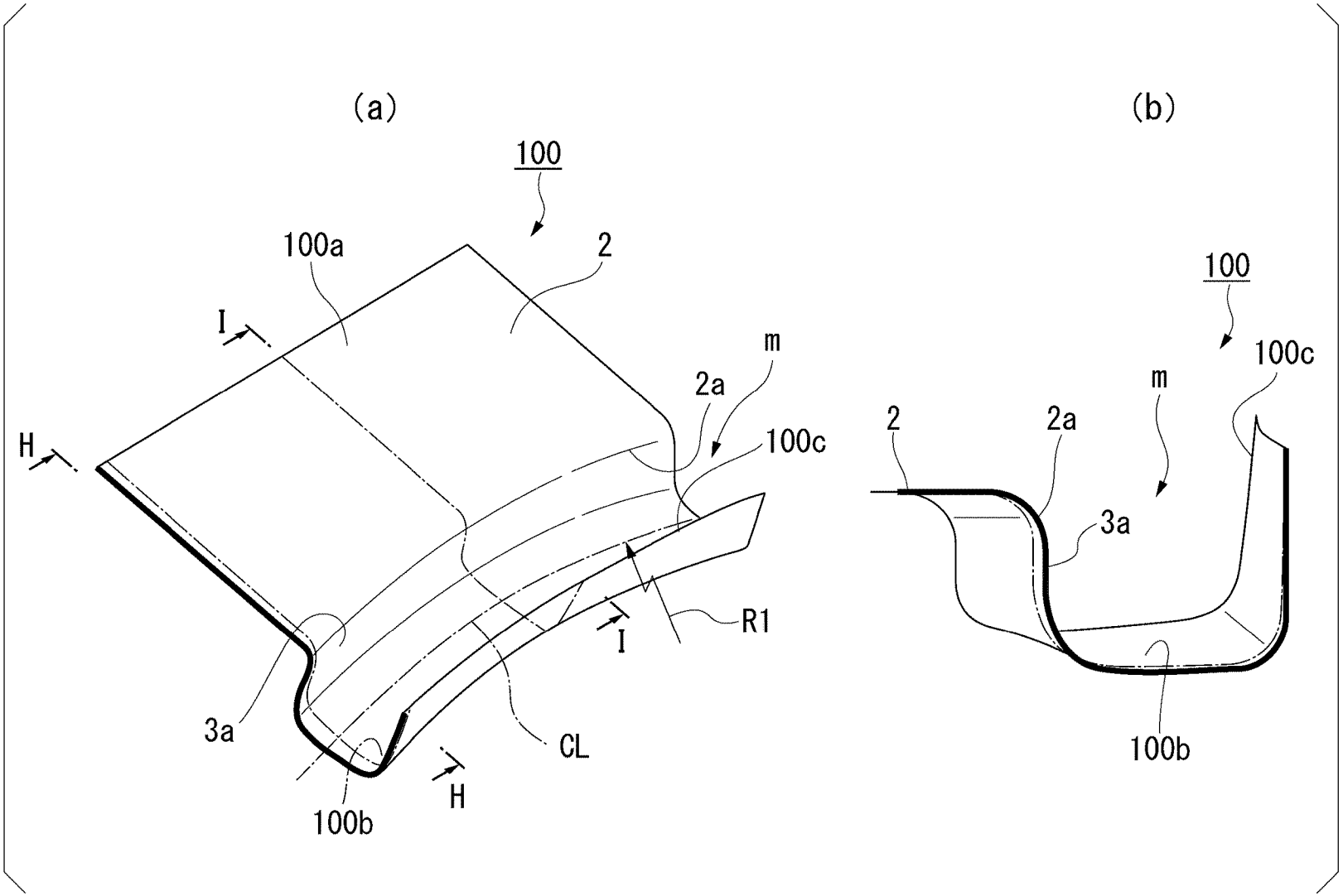
FIG. 14 is a view showing the blank formed in the first step of the first embodiment, in which FIG. 14(*a*) is a perspective view and FIG. 14(*b*) is a view along line H-H indicated by the arrows in FIG. 14(*a*).
Figure 15:
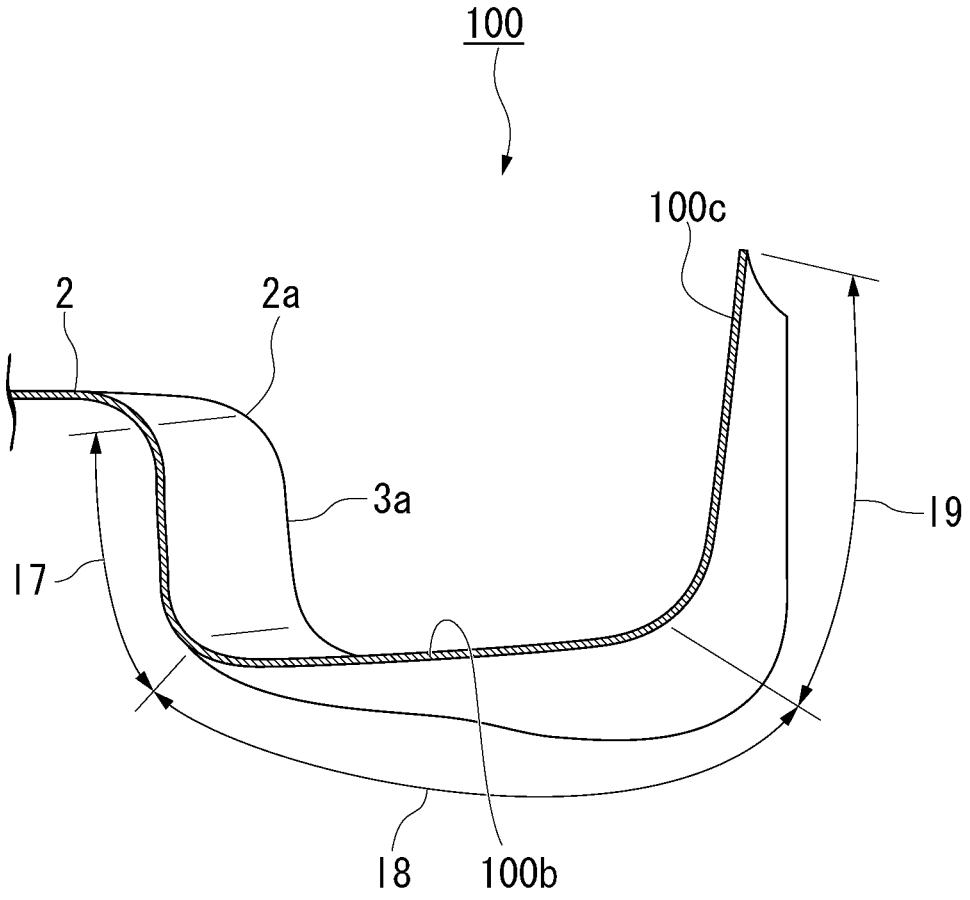
FIG. 15 is a view showing the blank after the first step of the first embodiment and is a view along line I-I indicated by the arrows in FIG. 14(*a*).

The blank 100 that has been subjected to the press processing in this way is shown in FIGS. 14 and 15. In FIG. 14, FIG. 14(*a*) is a perspective view, and FIG. 14(*b*) is a view along line H-H indicated by the arrows in FIG. 14(*a*). FIG. 15 is a view along line I-I indicated by the arrows in FIG. 14(*a*). After the first step, the top plate part 2 and the inner wall 3*a* that is continuous with the top plate part 2 via the curved edge 2*a* are integrally formed.

The blank 100 after the first step has a groove part m including the inner wall 3*a* and a vertical wall part 100*c*, and a band-shaped arcuate wall part 100*b* connecting lower end edges of them. The inner wall 3*a*, the vertical wall part 100*c*, and the band-shaped arcuate wall part 100*b* have curved shapes that are curved in the same direction as each other in a plan view.

The inner wall 3*a* and the vertical wall part 100*c* have a difference in height dimension on the lower end edges thereof between a central position and both end positions in an extending direction thereof. That is, the inner wall 3*a* and the vertical wall part 100*c* have the lower end edges formed in a curved line shape that is convex vertically upward in a side view.

In a plan view, a radius of curvature of the vertical wall part 100*c* is larger than a radius of curvature of the inner wall 3*a*. Due to the difference in radius of curvature, the difference in height dimension in the extending direction of the inner wall 3*a* and the vertical wall part 100*c* is absorbed. In other words, a sum of perimeters, which is a sum of lengths 17, 18, and 19 shown in FIG. 15, is the same at any position in an extending direction of the band-shaped arcuate wall part 100*b*.

The band-shaped arcuate wall part 100*b* has a curved shape that is curved in the same direction as the edge 111*a* in a plan view. Further, the band-shaped arcuate wall part 100*b* has a height difference between a central position and an end portion position in an extending direction thereof in a longitudinal sectional view. That is, the band-shaped arcuate wall part 100*b* has a convex curved shape that is curved so that both of the end positions are at a low position relative to the central position in the extending direction thereof. Then, a radius of curvature of the band-shaped arcuate wall part 100*b* in a longitudinal sectional view is larger than a radius of curvature of a center line CL passing through a central position in a width direction of the band-shaped arcuate wall part 100*b* in a plan view. Thereby, a height of the blank 100 from becoming too large and thus becoming unstable can be prevented when the blank 100 is placed by changing the die in the next step.

The band-shaped arcuate wall part 100*b* is the portion that will become the bottom wall 3*b* and the outer wall 3*c* through the following second and third steps. As described above, a height difference is provided in the band-shaped arcuate wall part (bottom wall) 100*b* of the groove part m between the central position (intermediate position) and both of the end positions (positions on both sides) sandwiching the central position therebetween in a longitudinal sectional view in an extending direction of the groove part m by the pressing in the first step (intermediate step). Thereby, a curved part (first curved part) having a concave curved shape in a plan view and a convex curved shape in a longitudinal sectional view is formed in the band-shaped arcuate wall part 100*b*. In the present embodiment, the band-shaped arcuate wall part 100*b* is all formed as a curved part, but the present invention is not limited only to this form, and only a part of the band-shaped arcuate wall part 100*b* may be formed as a curved part.

The vertical wall part 100*c* continuous with the band-shaped arcuate wall part 100*b* and rising upward is also formed in the blank 100. In the above-described comparative example, as described with reference to FIG. 5, since stretch flange deformation at the upper end edge of the vertical wall part 100*c* was insufficient, the vertical wall part 100*c* was obliquely retreated to become more distant from the curved edge 2*a*. On the other hand, in the present embodiment, since a bend has been applied to the band-shaped arcuate wall part 100*b* to form a curved shape that is convex vertically upward in the present first step, the stretch flange deformation at the upper end edge of the vertical wall part 100*c* can be given before the second step. That is, the vertical wall part 100*c* is bent and deformed in an in-plane direction so that the upper end edge has a width larger than that of the lower end edge of the vertical wall part 100*c*. As a result, in FIG. 15 of the present embodiment, the vertical wall part 100*c* can be brought closer to the curved edge 2*a* in advance as compared with FIG. 5 of the comparative example.

[First Embodiment/Second Step]

Figure 16:
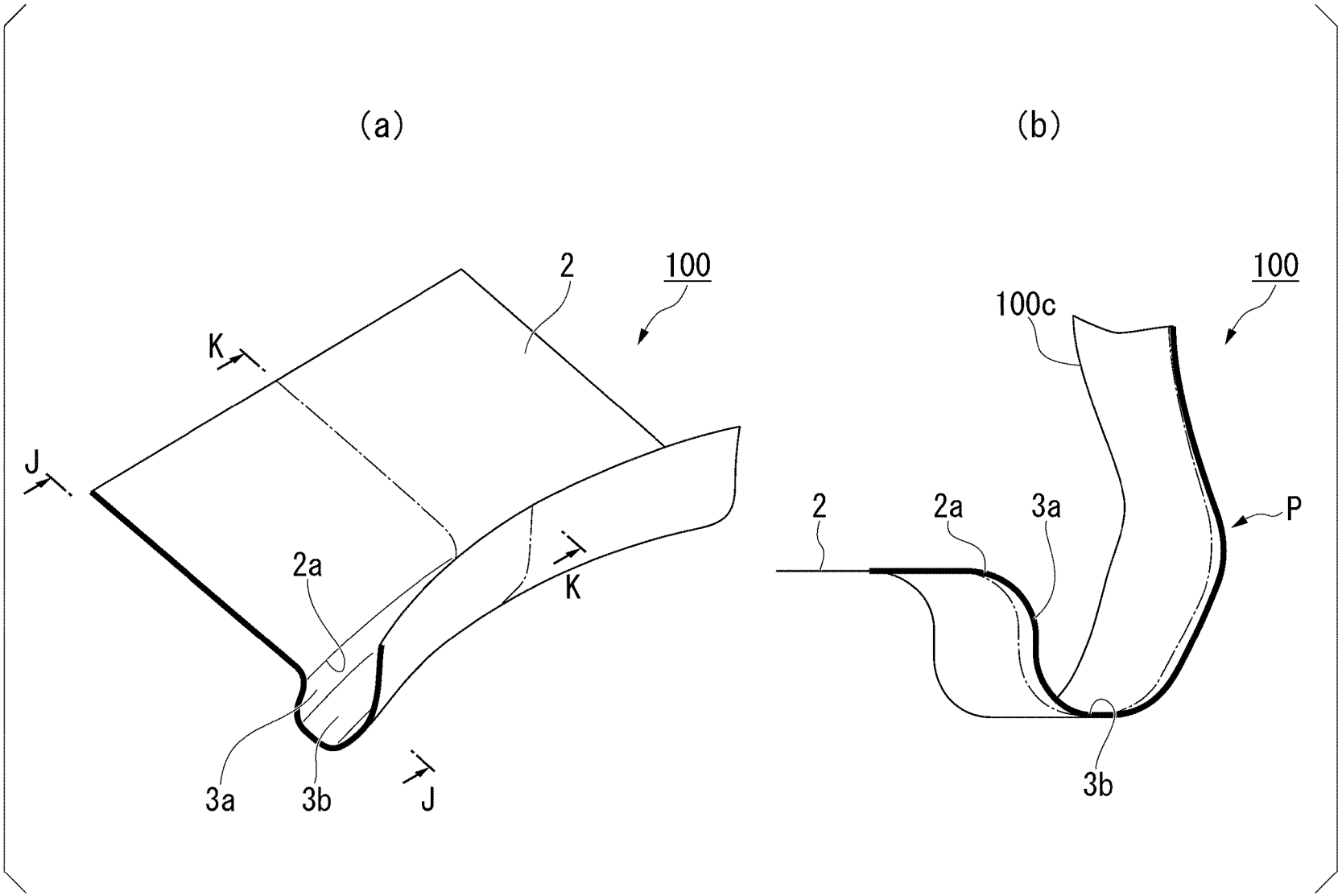
FIG. 16 is a view showing the blank after the second step of the first embodiment, in which FIG. 16(*a*) is a perspective view and FIG. 16(*b*) is a view along line J-J indicated by the arrows in FIG. 16(*a*).

Next, a second step of the present embodiment will be described with reference to FIGS. 6 and 16. FIG. 16 is a view showing the blank after the second step, in which FIG. 16(*a*) is a perspective view and FIG. 16(*b*) is a view along line J-J indicated by the arrows in FIG. 16(*a*). Further, since dies the same as those shown in FIG. 6(*a*) are used in the present step, description of these dies will be omitted.

In order to perform the second step using the die 40A, the holder 50A, and the punch 60A shown in FIG. 6(*a*), first, the blank 100 after the first step is placed on the top plate support surface 41A of the die 40A. At that time, the bottom wall 3*b* is disposed on the die groove bottom surface 43A, and furthermore, the inner wall 3*a* is disposed to be in surface contact with the die groove side surface 42A. At this time, the bottom wall 3*b* has a curved shape and thus is slightly raised from the die groove bottom surface 43A except for both ends thereof.

Next, when the holder 50A is lowered, the flat lower surface 50Ad thereof comes into contact with a topmost part of the convex curved bottom wall 3*b* at a central position in an extending direction of the bottom wall 3*b*. When the holder 50A is further lowered, the bottom wall 3*b* is bent back so that a curvature thereof is gradually reduced. Then, when the holder 50A reaches a bottom dead center, the bottom wall 3*b* is sandwiched between the lower surface 50Ad and the die groove bottom surface 43A and plastically deformed into a completely flat shape. In this process, since a force for bending back the curvature of the bottom wall 3*b* is transferred to the vertical wall part 100*c*, the vertical wall part 100*c* is plastically deformed to stand upright more than that in the original state.

As described above, the inner wall 3*a* of the blank 100 is sandwiched and fixed between the die groove side surface 42A and the inner wall surface 50Ac. Further, a part of the band-shaped arcuate wall part 100*b* of the blank 100 is sandwiched and fixed between the die groove bottom surface 43A and the lower surface 50Ad while leaving the other portion.

Next, when the punch 60A is raised by the drive mechanism, the other portion of the band-shaped arcuate wall part 100*b* is pushed upward from below. As a result, a fold line is formed between the portion of the band-shaped arcuate wall part 100*b* to be the bottom wall 3*b* and the portion thereof to be the vertical wall part 100*c*.

At this time, in order for the vertical wall part 100*c* to be inclined toward the curved edge 2*a*, stretch flange deformation in an extending direction of the upper end edge of the vertical wall part 100*c* is required. In the above-described comparative example, since the stretch flange deformation was insufficient, the upper end edge of the vertical wall part 100*c* could not be inclined. On the other hand, in the present embodiment, since stretch flange deformation has been given in advance at the stage of the first step, the upper end edge of the vertical wall part 100*c* can be sufficiently collapsed toward the curved edge 2*a* while leaving a bend at an intermediate position in a height direction of the vertical wall part 100*c*.

Further, as shown in FIG. 6(*b*), it is preferable that a vertical wall surface 60Ae of the punch 60A be disposed to face the vertical wall surface 50Ae of the holder 50A at a distance cl of 5 mm or more and 50 mm or less in a horizontal direction. In this case, the upper end edge of the vertical wall part 100*c* can be more reliably inclined to come closer to the top plate part 2 in the manner of leaning forward while leaving a bent part bp formed in the first step at the intermediate position of the vertical wall part 100*c* in the height direction. On the other hand, when the distance cl is smaller than 5 mm, the bent part bp may be crushed because the distance between the vertical wall surface 50Ae and the vertical wall surface 60Ae is too small, and there is a likelihood that the vertical wall part 100*c* cannot be properly bent in the next step. Also, when the distance cl is larger than 50 mm, although the bent part bp remains, since the upper end edge of the vertical wall part 100*c* remains retreated to become more distant from the top plate part 2, there is a likelihood that the vertical wall part 100*c* cannot be bent at the bent part bp in the next step.

For the above-described reasons, in a plan view, it is preferable to dispose the punch 60A (second punch) so that the vertical wall surface 60Ae (second vertical wall surface) is disposed to face the vertical wall surface 50Ae (first vertical wall surface) of the holder 50A (first holder) at a distance cl of 5 mm or more and 50 mm or less in a horizontal direction.

The blank 100 that has been subjected to press processing in the second step in this way is shown in FIG. 16. After the second step, the top plate part 2, the inner wall 3*a* formed integrally with the top plate part 2 via the curved edge 2*a*, the flat bottom wall 3*b* that is continuous with the inner wall 3*a*, and the vertical wall part 100*c* that is continuous with the bottom wall 3*b* are formed. The vertical wall part 100*c* has an elongated dimension in a vertical direction by applying a bend to a part of the band-shaped arcuate wall part 100*b* as can be found in comparison with that in FIG. 14(*b*). Also, the bend between the band-shaped arcuate wall part 100*b* and the vertical wall part 100*c* applied in the first step remains at a position indicated by reference sign P in FIG. 16(*b*) in the vertical wall part 100*c* after the second step. Therefore, the upper end edge of the vertical wall part 100*c* is brought closer to the curved edge 2*a* than in a case of the second step of the comparative example.

[First Embodiment/Third Step]

Figure 17:
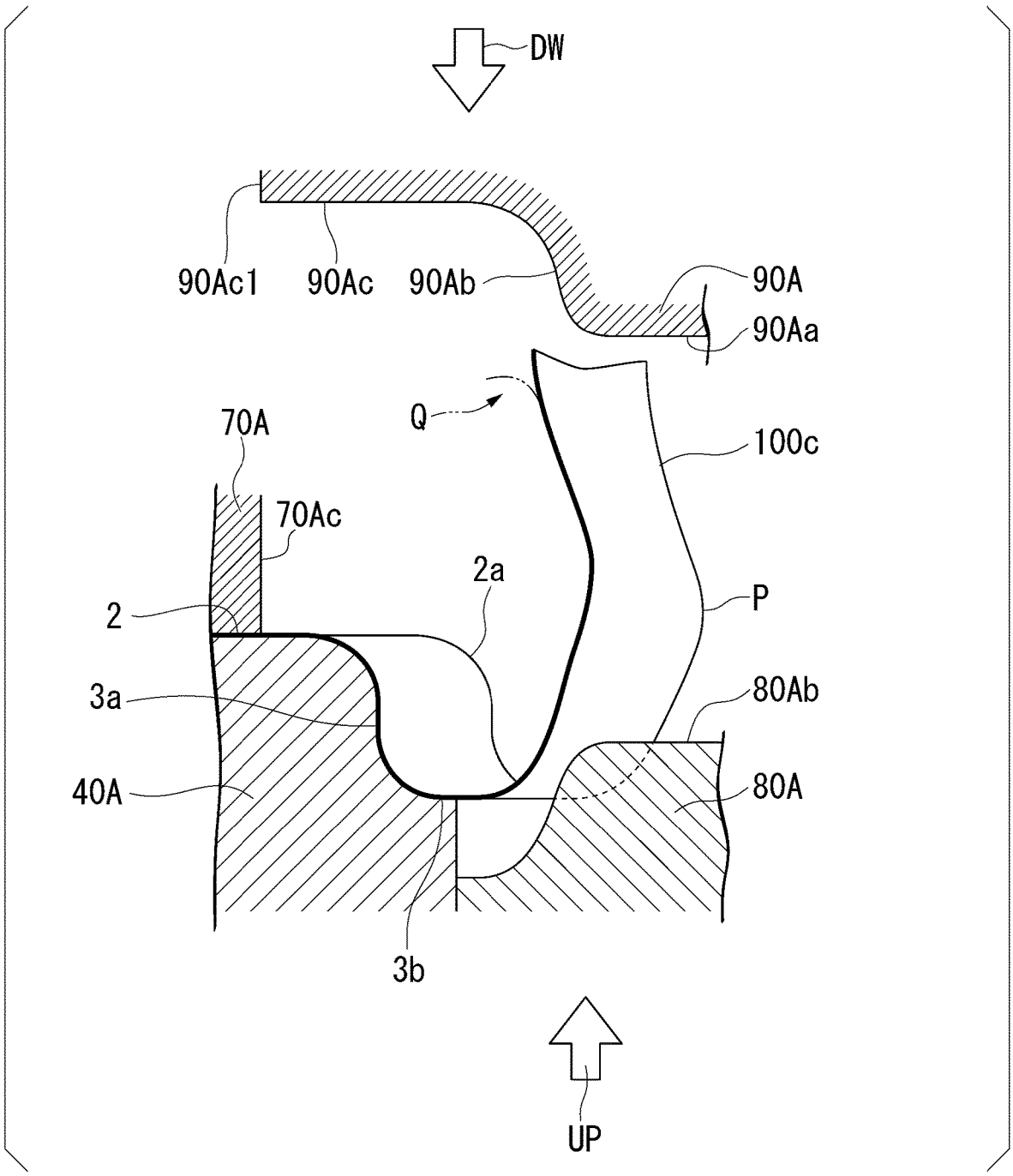
FIG. 17 is a view showing a shape of the blank before the third step of the first embodiment is started and is a view along line K-K indicated by the arrows in FIG. 16(*a*).
Figure 18:
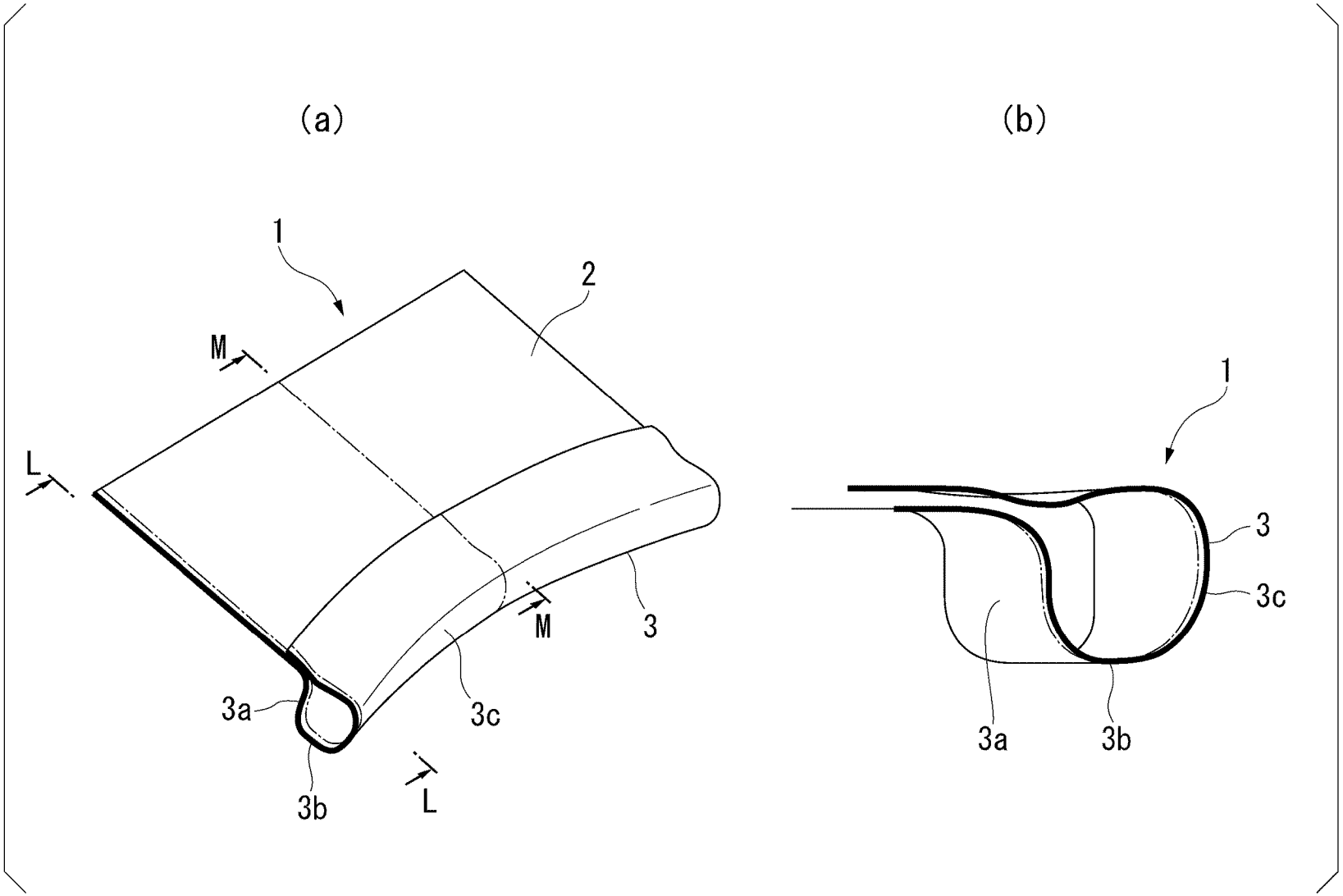
FIG. 18 is a view showing the blank after the third step of the first embodiment, in which FIG. 18(*a*) is a perspective view and FIG. 18(*b*) is a view along line L-L indicated by the arrows in FIG. 18(*a*).

Next, a third step of the present embodiment will be described with reference to FIGS. 8, 17, and 18. FIG. 17 is a view showing a shape of the blank 100 before the third step is started and is a view along line K-K indicated by the arrows in FIG. 16(*a*). FIG. 18 is a view showing the blank after the third step, in which FIG. 18(*a*) is a perspective view and FIG. 18(*b*) is a view along line L-L indicated by the arrows in FIG. 18(*a*). Further, since dies the same as those shown in FIG. 8 are used in the present step, description thereof will be omitted.

In order to perform the third step using the die 40A, the holder 70A, the punch 80A, and the pad 90A shown in FIG. 8, first, while the blank 100 after the second step remains placed on the top plate support surface 41A of the die 40A, the holder 70A is used instead of the holder 50A and the top plate part 2 is sandwiched between the holder 70A and the top plate support surface 41A. At this time, the holder 70A is disposed so that the vertical wall surface 70Ac thereof is retreated from the edge 41Aa of the die 40A by a predetermined width dimension t. Thereby, a region of the width dimension t shown by hatching in FIG. 8 serves as a joint margin in a horizontal direction when the vertical wall part 100*c* is bent to form a closed cross section in the third step.

Next, in FIG. 17, the punch 80A is raised in a direction of an arrow UP to support the bottom wall 3*b* of the blank 100 and a portion of the vertical wall part 100*c* to be the outer wall 3*c* from outer peripheries thereof.

Thereafter, in FIG. 17, the pad 90A is lowered in a direction of an arrow DW to bring the lower surface 90Aa of the pad 90A into contact with the upper surface 80Ab of the punch 80A. At this time, the upper end edge of the vertical wall part 100*c* of the blank 100 is all below the inclined surface 90Ab or the lower surface 90Ac. Therefore, when the pad 90A is lowered, the inclined surface 90Ab and the lower surface 90Ac thereof can push down the upper end edge of the vertical wall part 100*c* while guiding it toward a joining position on the top plate part 2. At that time, the bend (the bent part bp) indicated by reference sign P of the vertical wall part 100*c* gradually increases, and as a result, a boundary between the outer wall 3*c* and the upper wall 3*d* is formed.

Moreover, even when the upper end edge of the vertical wall part 100*c* tries to pass the joining position with the top plate part 2 before the pad 90A reaches the bottom dead center, movement thereof is blocked by the vertical wall surface 70Ac. Since a force applied to the vertical wall surface 70Ac by the vertical wall part 100*c* whose upper end edge is blocked returns to itself as a reaction force, the vertical wall part 100*c* forms a closed cross-sectional shape to be in close contact with an inner wall surface of a closed space formed by the die 40A, the punch 80A, and the pad 90A.

Here, a gap at the bottom dead center of forming with respect to the top plate support surface 41A (first top plate support surface) of the die 40A is larger on the pressurizing surface of the pad 90A than on the pressurizing surface of the holder 70A. More specifically, when the holder 70A reaches the bottom dead center, a gap between the pressurizing surface of the holder 70A and the top plate support surface 41A of the die 40A is defined as g1. Further, when the pad 90A reaches the bottom dead center, a gap between the pressurizing surface of the pad 90A and the top plate support surface 41A of the die 40A is defined as g2. In this case, the gap g1 is substantially equal to a plate thickness of the top plate part 2, and the gap g2 is substantially equal to a dimension obtained by adding a plate thickness of the upper end edge of the vertical wall part 100*c* to the plate thickness of the top plate part 2. That is, gap g2>gap g1 is established. Therefore, in the holder 70A, the top plate part 2 can be firmly sandwiched between the holder 70A and the die 40A, and in the pad 90A, a joint margin for sandwiching the top plate part 2 and the upper end edge of the vertical wall part 100*c* can be obtained between the pad 90A and the die 40A.

Finally, when the upper wall 3*d* is joined to the joining position of the top plate part 2 using an appropriate joining method, the curved reinforcing part 3 shown in FIG. 18 is formed. The curved reinforcing part 3 has a uniform cross-sectional shape at any position in the extending direction thereof.

Figure 19:
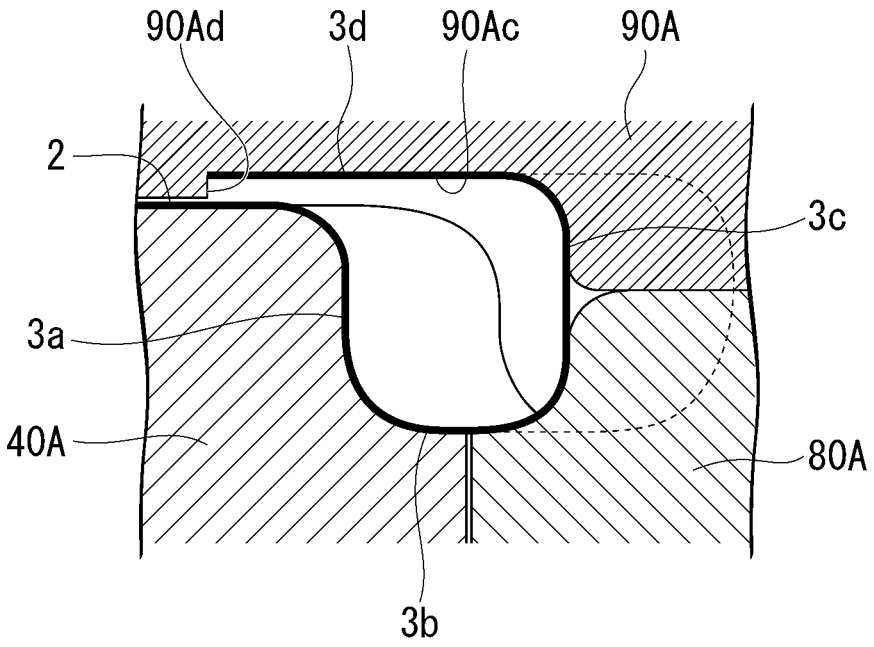
FIG. 19 is a view showing a modified example of the first embodiment and is a cross-sectional view of the blank in the third step along line M-M shown in FIG. 18(*a*).

Further, in the present step, excessive movement of the upper end edge of the vertical wall part 100*c* is restricted by the vertical wall surface 70Ac, but the present invention is not limited only to this form, and for example, a restricting surface 90Ad continuous with the lower surface 90Ac and formed downward from an end portion of the lower surface 90Ac may be provided to the pad 90A as shown in a modified example in FIG. 19. In this case, since the movement of the upper end edge of the vertical wall part 100*c* is blocked by the restricting surface 90Ad, the vertical wall surface 70Ac can be omitted from the holder 70A.

Also, in the present step, the third step is performed following the second step, but the present invention is not limited to this mode. For example, as shown in FIG. 17, an upper end edge bending step of forming a bent part Q by bending the upper end edge of the vertical wall part 100*c* toward the top plate part 2 may be further provided after the second step and before the third step. In this case, wear of the lower surface 90Ac of the pad 90A due to a sliding contact with the upper end edge of the vertical wall part 100*c* can be suppressed. In addition, when the pad 90A reaches the bottom dead center, since the lower surface 90Ac thereof presses and crushes the bent part Q flat, the bent part Q is not left in the following step.

Further, instead of providing the bent part Q, a coating agent that imparts wear resistance to the inclined surface 90Ab and the lower surface 90Ac of the pad 90A may be applied in advance. Moreover, both the formation of the bent part Q and the application of a coating agent may be employed.

Figure 20:
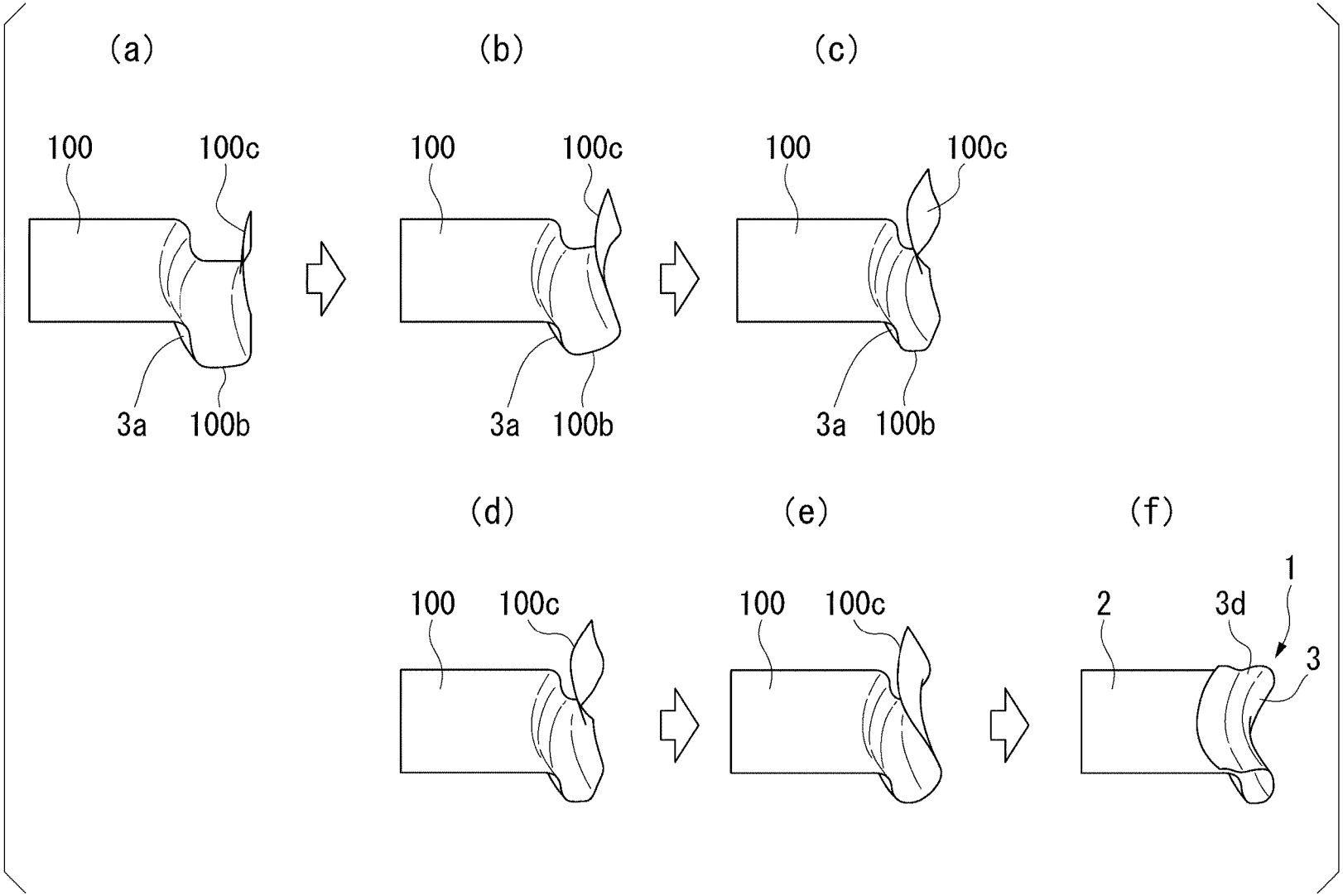
FIG. 20 is a perspective view in which changes in shape of the blank from the second step to the third step of the comparative example are arranged in a time series in order from (a) to (f).

Of the steps described above, a perspective view in which changes in shape of the blank 100 from the second step to the third step are arranged in a time series in order from (a) to (f) is shown in FIG. 20. Further, in FIG. 20, FIG. 20(*a*) to FIG. 20(*c*) indicate the second step, and FIG. 20(*d*) to FIG. 20(*f*) indicate the third step. First, in FIG. 20(*a*), the blank 100 after the first step is sandwiched between the die 40A and the holder 50A. Then, when the punch 60A is raised, the state shown in FIG. 20(*b*) is obtained. At this time, in order to incline the upper end edge of the vertical wall part 100*c* toward the top plate part 2, stretch flange deformation in the extending direction thereof is required, but since the stretch flange deformation has already been applied in the first step, the upper end edge of the vertical wall part 100*c* can be inclined with a margin. Therefore, a fold line at the boundary between the portion of the vertical wall part 100*c* to be the outer wall 3*c* and the portion thereof to be the upper wall 3*d* is maintained even when the punch 60A is further raised to be the state shown in FIG. 20(*b*).

In the following third step, since the upper end edge of the vertical wall part 100*c* is pushed down by the pad 90A in a state in which the vertical wall part 100*c* of the blank 100 is sufficiently collapsed, the vertical wall part 100*c* properly collapses toward the joining position with the top plate part 2 as shown in FIGS. 20(*d*) to 20(*e*). Then, when the upper wall 3*d* is fixed at the joining position using an appropriate joining method as shown in FIG. 20(*f*), the structural member 1 having the curved reinforcing part 3 is completed.

An outline of the present embodiment described above is summarized below.

The manufacturing method of a structural member of the present embodiment is a method of manufacturing the structural member 1 including the top plate part 2 having the curved edge 2*a*, and the curved reinforcing part 3 that is formed integrally with the top plate part 2 in an extending direction of the curved edge 2*a* and in which a cross section perpendicular to the extending direction of the curved edge 2*a* has a closed cross-sectional shape from the blank (flat plate material) 100.

Then, the manufacturing method includes the first step (intermediate step) of forming the groove part m extending in an extending direction of the curved edge 2*a* and having a U-shaped cross section perpendicular to the above-described extending direction and the vertical wall part 100*c* that is continuous with the groove part m in a state in which a portion (first portion) of the blank 100 corresponding to the top plate part 2 is sandwiched by pressing the other portion (second portion including the inner wall 3*a*, the band-shaped arcuate wall part 100*b*, and the vertical wall part 100*c*) of the blank 100 that is continuous with the curved edge 2*a* of the top plate part 2 in a depth direction with respect to a surface of the blank 100, and the third step (joining step) of forming the curved reinforcing part 3 by overlapping and joining an upper end edge of the vertical wall part 100*c* to the top plate part 2.

Then, in the pressing of the first step, a height difference is provided between a central position and an end portion position of the band-shaped arcuate wall part 100*b* (bottom wall) of the groove part m in a longitudinal sectional view in the extending direction.

That is, as shown in FIG. 14, the band-shaped arcuate wall part 100*b* is formed in a concave curved shape in a plan view and a convex curved shape in a longitudinal sectional view by the pressing in the first step.

Further, the portion corresponding to the top plate part 2 is not completely fixed but is in a sandwiched state at the time of the press forming in the first step. Therefore, movement and deformation of the sandwiched portion out of the plane is restricted, but a metal flow in which some of the sandwiched portion is directed toward another portion such as the inner wall 3*a* is allowed.

In the third step, the upper end edge of the vertical wall part 100*c* is bent toward the top plate part 2 by pushing down the upper end edge toward the groove part m while movement thereof toward the top plate part 2 is allowed. Then, movement of the upper end edge past a planned joining position on the top plate part 2 is restricted.

An upper end edge bending step of forming the bent part Q by bending the upper end edge toward the top plate part 2 may be further provided before the third step.

When a cross-sectional line length (a sum of perimeters which is a sum of lengths 17, 18, and 19 shown in FIG. 15) of an inner shape of the U-shape in a cross section perpendicular to the extending direction of the groove part m is viewed, a ratio obtained by dividing the cross-sectional line length at the central position by the cross-sectional line length at the end portion position is preferably within a range of 0.7 to 1.3 by the pressing in the first step. Further, it is more preferable that the cross-sectional line lengths at the central position and the end portion position be the same as each other. Further, it is most preferable that the cross-sectional line length at any position in the extending direction of the groove part m be all made equal.

When the ratio of the cross-sectional line lengths is less than 0.7 or more than 1.3, a difference in the cross-sectional line length between the central position and the end portion position becomes too large. In this case, when the curved reinforcing part having substantially the same cross-sectional area at any position in the extending direction of the groove part m is formed, the difference in the cross-sectional line length may cause forming defects such as cracks or wrinkles at an end edge of the upper wall 3*d*. Therefore, the ratio of the cross-sectional line lengths is preferably in the range of 0.7 to 1.3.

Also, an R/R1 ratio obtained by dividing the radius of curvature R (mm) of the center line passing through the central position in a width direction of the band-shaped arcuate wall part 100*b* in a plan view by the radius of curvature R1 (mm) of the band-shaped arcuate wall part 100*b* in a longitudinal sectional view may be set within a range of 0.2 to 1.2 by the pressing in the first step. In this case, a suitable forming result without constriction or dimensional errors can be obtained even when a high-strength steel sheet of 780 MPa class is used as the blank 100. Further, when a high-strength steel sheet of 980 MPa class or higher is used, the R/R1 ratio is more preferably within a range of 0.3 to 0.9, and in this case, a suitable forming result without constriction or dimensional errors can be obtained even if a high-strength steel sheet of 980 MPa class is used. Further, it is most preferable to set the R/R1 ratio to 0.5, and in this case, a suitable forming result without constriction or dimensional errors can be obtained even when a high-strength steel sheet of 1180 MPa class is used.

On the other hand, when this is viewed from another perspective, it is preferable that the radius of curvature R1 of the band-shaped arcuate wall part 100*b* in a longitudinal sectional view be made larger than the radius of curvature R of the center line CL passing through the central position in a width direction of the band-shaped arcuate wall part 100*b* in a plan view by the pressing in the first step (R1>R). In this case, it is possible to avoid unstable positioning when the structural member is transferred to another die in the next step.

The structural member 1 may be an automobile body part. More specifically, the present invention may be applied in manufacturing lower arms.

The manufacturing device of a structural member of the present embodiment can be suitably used in the above-described manufacturing method, and the structural member 1 is manufactured from the blank 100.

Then, the manufacturing device uses the die (first die) 110 in which the die groove (first die groove) 112 curved in a plan view is formed and the punch (first punch) 130 that moves relatively closer to and further away from the die groove 112 in the first step. Then, the die groove bottom surface (bottom surface) 112*b* of the die groove 112 has a height difference in a longitudinal sectional view between the central position and the end portion position in an extending direction of the die groove bottom surface 112*b*.

Further, the punch lower end surface 130*a*3 of the pressurizing surface 130*a* of the punch 130 has a height difference corresponding to that of the die groove bottom surface 112*b*. Further, the "corresponding height difference" in the punch lower end surface 130*a*3 means a height difference formed by the punch lower end surface 130*a*3 curved in the same direction as the die groove bottom surface 112*b* and is preferably the same as the height difference of the die groove bottom surface 112*b*.

The die groove bottom surface 112*b* of the die groove 112 has a concave curved shape in a plan view and a convex curved shape in a longitudinal sectional view. That is, the die groove bottom surface 112*b* has a height difference between the central position (intermediate position) and both of the end positions (positions on both sides) sandwiching the central position therebetween in a longitudinal sectional view in an extending direction of the die groove (first die groove) 112. Then, the pressurizing surface 130*a* of the punch (first punch) 130 has a height difference corresponding to that of the die groove bottom surface 112*b*. Further, the die groove bottom surface 112*b* forms a curved surface (first die curved surface) having a concave curved shape in a plan view and a convex curved shape in a longitudinal sectional view. In the present embodiment, the die groove bottom surface 112*b* is all formed as a curved surface, but the present invention is not limited only to this form, and only a part of the die groove bottom surface 112*b* may be formed as a curved surface.

When viewed along a cross-sectional line length of the U-shape which is a cross section perpendicular to the extending direction of the die groove 112, a ratio obtained by dividing the cross-sectional line length at the central position by the cross-sectional line length at the end portion position is preferably within a range of 0.7 to 1.3. Further, it is more preferable that the cross-sectional line lengths at the central position and the end portion position be the same as each other. Further, it is most preferable that the cross-sectional line length at any position in the extending direction of the die groove 112 be all made equal. In this case, forming defects can be more reliably prevented.

An R/R1 ratio of the die groove bottom surface 112*b* obtained by dividing a radius of curvature R (mm) of a center line passing through a central position in a width direction in a plan view by a radius of curvature R1 (mm) in a longitudinal sectional view may be set within a range of 0.2 to 1.2. In this case, a suitable forming result without constriction or dimensional errors can be obtained even when a high-strength steel sheet of 780 MPa class is used as the blank 100. Further, when a high-strength steel sheet of 980 MPa class or higher is used, the R/R1 ratio is more preferably within a range of 0.3 to 0.9, and in this case, a suitable forming result without constriction or dimensional errors can be obtained even if a high-strength steel sheet of 980 MPa class is used. Further, it is most preferable to set the R/R1 ratio to 0.5, and in this case, a suitable forming result without constriction or dimensional errors can be obtained even when a high-strength steel sheet of 1180 MPa class is used.

On the other hand, when this is viewed from another perspective, it is preferable that the radius of curvature R1 in a longitudinal sectional view of the die groove bottom surface 112*b* be made larger than the radius of curvature R of the center line passing through the central position in a width direction of the die groove bottom surface 112*b* in a plan view (R1>R). In this case, it is possible to avoid unstable positioning when the structural member is transferred to another die in the next step.

Further, the manufacturing device further includes the following dies used in the second step including the die (second die) 40A having the die groove bottom surface (second die groove) 43A that is thinner than the die groove 112, the holder (first holder) 50A having the lower surface (curved convex part) 50Ad having a shape corresponding to the die groove bottom surface 43A, and the punch (second punch) 60A disposed adjacent to the die groove bottom surface 43A and configured to move relatively closer to and further away from the die groove bottom surface 43A.

Further, the manufacturing device further includes the following dies used in the third step including the holder (second holder) 70A disposed to overlap the die 40A, the punch (third punch) 80A having a third die groove that is adjacent to the die groove bottom surface 43A, and the pad 90A having the lower surface (pressurizing surface) 90Ac which moves relatively closer to and further away from both the die groove bottom surface 43A and the third die groove.

The holder 70A has the vertical wall surface (first restricting surface) 70Ac adjacent to the lower surface 90Ac of the pad 90A and intersecting the lower surface 90Ac. Alternatively, the pad 90A may have a restricting surface (second restricting surface) 90Ad continuous with the lower surface 90Ac and intersecting the lower surface 90Ac as shown in FIG. 19.

Second Embodiment

In the present embodiment, a manufacturing method and a manufacturing device for forming a structural member 201 shown in FIG. 21 from a flat plate material will be described. Further, FIG. 21 is a view showing the structural member 201 manufactured by the manufacturing method of a structural member according to the present embodiment, in which FIG. 21(*a*) is a perspective view and FIG. 21(*b*) is a plan view.

Figure 21:
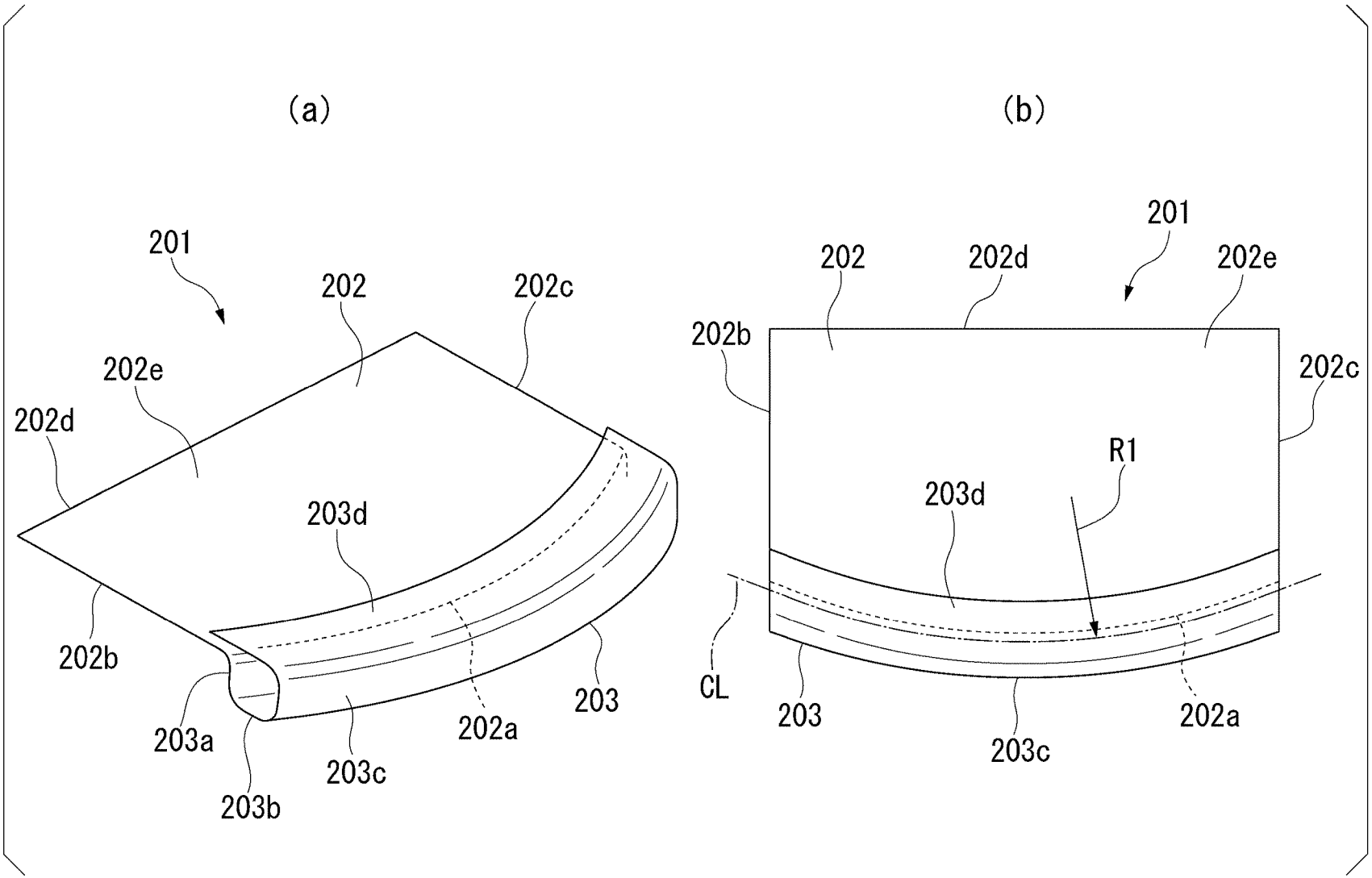
FIG. 21 is a view showing a structural member manufactured by a manufacturing method of a structural member according to a second embodiment of the present invention, in which FIG. 21(*a*) is a perspective view and FIG. 21(*b*) is a plan view.

The structural member 201 shown in FIG. 21 includes a top plate part 202 having a convex curved edge 202*a* in a plan view, and a curved reinforcing part 203 that is formed integrally with the top plate part 202 in an extending direction of the curved edge 202*a* and in which a cross section perpendicular to the above-described extending direction has a closed cross-sectional shape. Further, in FIG. 21(*a*), a joint portion is shown to be slightly open so that shapes of the curved edge 202*a* and the curved reinforcing part 203 can be easily understood, but in practice, the joint portion is joined without gaps and the curved reinforcing part 203 forms a closed cross-sectional shape. The other drawings may also be shown in the same way.

The top plate part 202 is a flat plate defined by a pair of both lateral edges 202*b* and 202*c* parallel to each other, the curved edge 202*a* continuous between the lateral edges 202*b* and 202*c* and forming a front edge, and a rear edge 202*d* facing the curved edge 202*a* and continuous between the lateral edges 202*b* and 202*c*. Of these, the lateral edges 202*b* and 202*c* and the rear edge 202*d* each have a linear shape. On the other hand, the curved edge 202*a* has a convex curved shape whose center is farther from the rear edge 202*d* with respect to both ends thereof. As a radius of curvature R1 of the convex curved shape in a plan view, 100 mm to 400 mm may be exemplified. However, the radius of curvature R1 is not limited to this range.

The curved reinforcing part 203 includes an inner wall 203*a* continuous with the curved edge 202*a* of the top plate part 202 and directed vertically downward, a bottom wall 203*b* continuous with the inner wall 203*a* and directed in a direction horizontally away from the top plate part 202, an outer wall 203*c* continuous with the bottom wall 203*b* and directed vertically upward, and an upper wall 203*d* continuous with the outer wall 203*c* and joined to an upper surface 202*e* of the top plate part 202.

The inner wall 203*a* has a height dimension in a vertical direction that is the same at any position from one end to the other end in an extending direction of the curved reinforcing part 203. Then, the inner wall 203*a* has a convex curved shape having the same radius of curvature in the same direction as the curved edge 202*a* in a plan sectional view.

The bottom wall 203*b* has a width dimension in a horizontal direction that is the same at any position from one end to the other end in the extending direction of the curved reinforcing part 203. Then, the bottom wall 203*b* is parallel to the top plate part 202 in a side view and has a convex curved shape that is curved in the same direction as the curved edge 202*a* in a bottom view.

The outer wall 203*c* has a height dimension in a vertical direction that is the same at any position from one end to the other end in the extending direction of the curved reinforcing part 203. Then, the outer wall 203*c* has a convex curved shape that is curved in the same direction as the curved edge 202*a* in a plan sectional view.

The upper wall 203*d* has a width dimension in a horizontal direction that is the same at any position from one end to the other end in the extending direction of the curved reinforcing part 203, and furthermore, has a width larger than that of the bottom wall 203*b*. Then, the upper wall 203*d* is parallel to the top plate part 202 in a longitudinal sectional view and has a convex curved shape that is curved in the same direction as the curved edge 202*a* in a plan view. Further, the upper wall 203*d* is joined to the upper surface 202*e* of the top plate part 202 at a position past the curved edge 202*a* toward the rear edge 202*d*. As a joining method thereof, for example, welding, adhesion, bolt fixing, or the like can be appropriately used.

The inner wall 203*a* and the outer wall 203*c* are parallel to each other, and the upper wall 203*d* and the bottom wall 203*b* are parallel to each other. Then, a closed cross-sectional shape is formed by four wall parts of the inner wall

203*a*, the bottom wall 203*b*, the outer wall 203*c*, and the upper wall 203*d*. That is, in the present embodiment, a convex curved space is formed in the curved reinforcing part 203, and the space communicates with the outside only at two portions, one end and the other end of the curved reinforcing part 203 in the extending direction.

According to the structural member 201 having the configuration described above, out-of-plane deformation of the top plate part 202 can be prevented by rigidity of the curved reinforcing part 203 having the closed cross-sectional shape. Also, high rigidity can be exhibited against a compressive load or a tensile load in the extending direction of the curved edge 202*a*.

Next, the manufacturing method and the manufacturing device of the present embodiment will be described below with reference to FIGS. 22 to 32.

[Second Embodiment/First Step]

Figure 22:
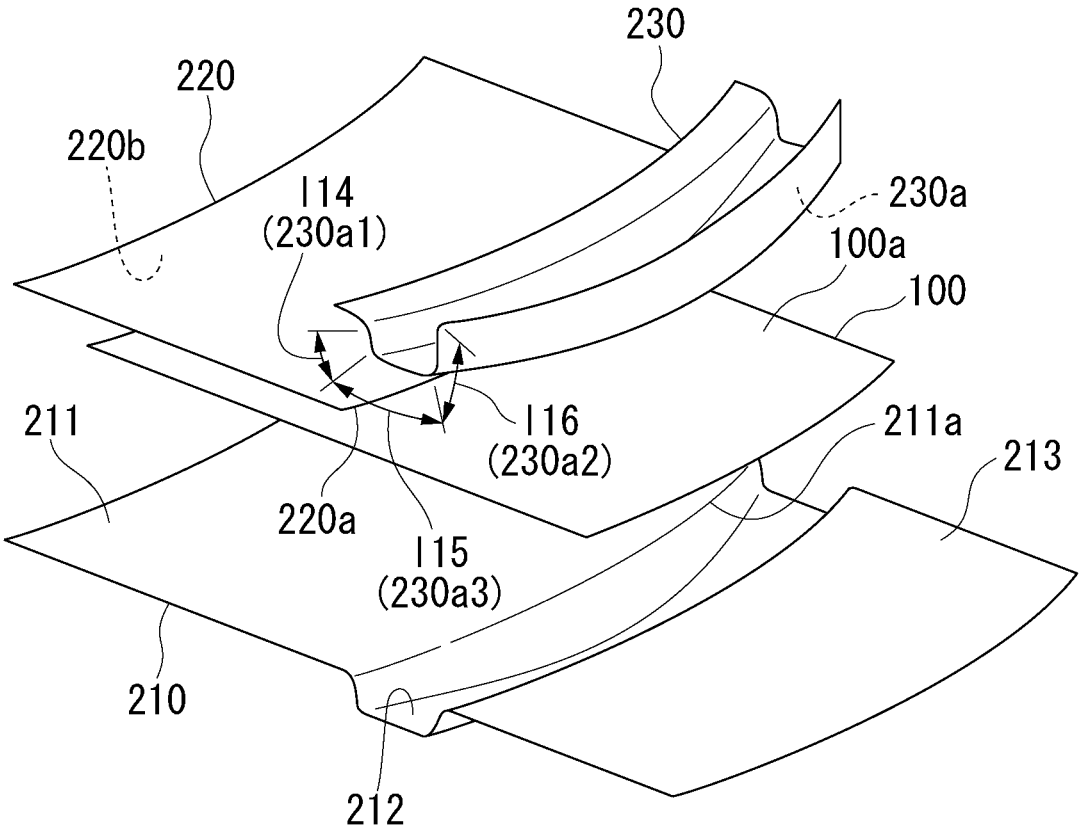
FIG. 22 is a perspective view of dies and a blank used in a first step in the second embodiment.

FIG. 22 is a perspective view of dies and a blank 100 used in a first step of the present embodiment. As shown in FIG. 22, the manufacturing device of a structural member of the present embodiment includes a die 210 on which the blank 100 is placed, a holder 220 that presses down a portion of the blank 100 that will become the top plate part 202 from above, a punch 230 that forms a recessed groove on a portion of the blank 100 forming the curved reinforcing part 203, and a drive unit (not shown) that drives the holder 220 and the punch 230 independently of each other.

The die 210 includes a top plate support surface 211 that supports a portion of the blank 100 that will become the top plate part 202, a die groove 212 that is continuous with the top plate support surface 211, and a horizontal plane 213 that is continuous with the die groove 212. The top plate support surface 211 is a horizontal plane having an edge 211*a* that is curved in the same direction as the curved edge 202*a* with the same radius of curvature.

Figure 23:
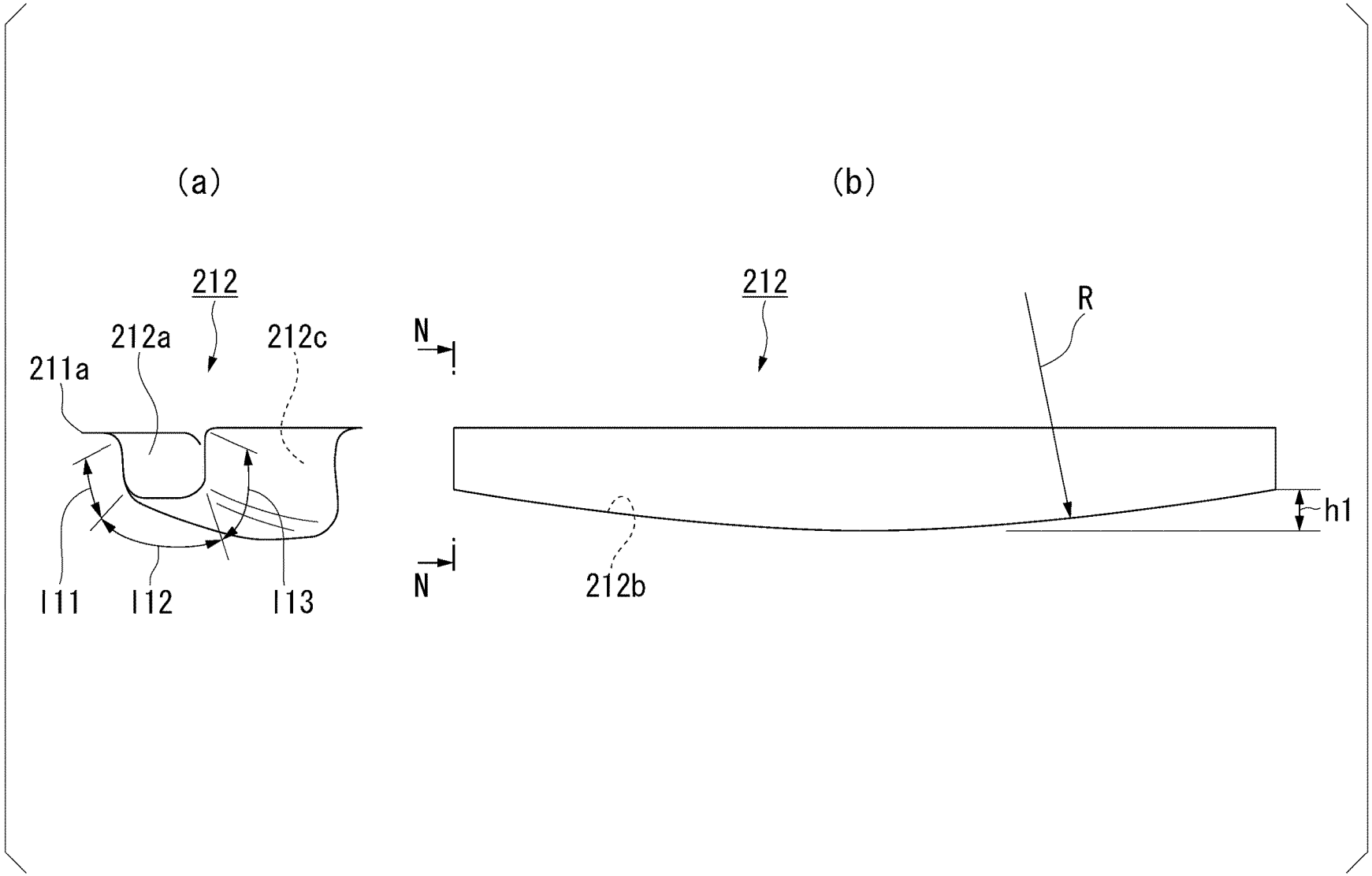
FIG. 23 is a view showing a shape of a die groove bottom surface of the die used in the second embodiment, in which FIG. 23(*a*) is a view along line N-N indicated by the arrows in FIG. 23(*b*) and FIG. 23(*b*) is a side view from a direction perpendicular to a longitudinal direction.

The die groove 212 is continuous with the top plate support surface 211 at the edge 211*a* and has the shape shown in FIG. 23. Further, FIG. 23 is a view showing a shape of the die groove 212, in which FIG. 23(*a*) is a view along line N-N indicated by the arrows in FIG. 23(*b*), and FIG. 23(*b*) is a side view from a direction perpendicular to a longitudinal direction. In FIGS. 23(*a*) and 23(*b*), end edges are shown by a thick line to make a positional relationship of the end edges in both figures clear. Further, a thick line may be used to show a positional relationship similarly in the following drawings.

As shown in FIG. 23, the die groove 212 includes a die groove side surface 212*a* continuous with the edge 211*a* and directed vertically downward, a die groove bottom surface 212*b* continuous with the die groove side surface 212*a* and directed in a direction horizontally away from the top plate support surface 211, and a die groove side surface 212*c* continuous with the die groove bottom surface 212*b* and directed vertically upward.

The die groove side surface 212*a* and the die groove side surface 212*c* have a difference in height dimension in a vertical direction between a central position and both end positions in an extending direction thereof. That is, in a side view, the die groove side surface 212*a* and the die groove side surface 212*c* have upper end edges formed in a linear shape while having lower end edges formed in a curved line shape that is convex vertically downward. A radius of curvature R of the curved line shape is preferably larger than the radius of curvature R1 of the curved edge 202*a* in the structural member 201 shown in FIG. 21. The reason will be described later.

The die groove side surface 212*a* and the die groove side surface 212*c* having such lower end edges of an inverted arcuate shape have a height dimension in a vertical direction that is larger at the central position than at both of the end positions in an extending direction thereof.

The die groove side surface 212*a* and the die groove side surface 212*c* have a convex curved shape that is curved in the same direction as the edge 211*a* in a plan view. Also, a radius of curvature of the die groove side surface 212*a* in a plan view is the same as the radius of curvature R1 of the curved edge 202*a* in the structural member 201. Further, a radius of curvature of the die groove side surface 212*c* in a plan view is larger than the radius of curvature of the die groove side surface 212*a*. Due to the difference in radius of curvature, a length 112 shown in FIG. 23(*a*) is larger at the end portion position than at the central position in a longitudinal direction of the die groove bottom surface 212*b*. Thereby, the difference in height dimension in the extending direction of the die groove side surface 212*a* and the die groove side surface 212*c* is absorbed. In other words, a sum of perimeters, which is a sum of lengths 111, 112, and 113 shown in FIG. 23(*a*), is the same at any position in an extending direction of the die groove 212. Thereby, a size of a cross-sectional shape of the curved reinforcing part 203 after forming can be made uniform at any position in the extending direction thereof.

The die groove bottom surface 212*b* has a convex curved shape that is curved in the same direction as the edge 211*a* in a plan view. Further, as shown in FIG. 23(*b*), the die groove bottom surface 212*b* has a height difference h1 in a longitudinal sectional view between the central position and the end portion position in an extending direction thereof. That is, the die groove bottom surface 212*b* has a concave curved shape that is curved so that the central position is at a lower position relative to both of the end positions in an extending direction thereof.

That is, the die groove bottom surface 212*b* has a height difference between the central position (intermediate position) and both of the end positions (positions on both sides) sandwiching the central position therebetween in a longitudinal sectional view in an extending direction of the die groove (first die groove) 212. Then, a pressurizing surface 230*a* of the punch (first punch) 230 has a height difference corresponding to that of the die groove bottom surface 212*b*. Further, the die groove bottom surface 212*b* forms a curved surface (second die curved surface) having a convex curved shape in a plan view and a concave curved shape in a longitudinal sectional view. In the present embodiment, the die groove bottom surface 212*b* is all formed as a curved surface, but the present invention is not limited only to this form, and only a part of the die groove bottom surface 212*b* may be formed as a curved surface.

Returning to FIG. 22, the holder 220 includes a convex curved edge 220*a* having the same radius of curvature in the same direction as the edge 211*a*, and a flat lower surface 220*b* that presses down an upper surface 100*a* of the blank 100.

The punch 230 includes the pressurizing surface 230*a* having substantially the same shape as the die groove 212. The pressurizing surface 230*a* has a shape slightly smaller than that of the die groove 212 in consideration of a plate thickness of the blank 100.

The pressurizing surface 230*a* has a pair of punch outer surfaces 230*a*1 and 230*a*2, and a punch lower end surface 230*a*3 that connects lower end edges thereof. The punch outer surfaces 230*a*1 and 230*a*2 and the punch lower end surface 230*a*3 have a convex curved shape that is curved in the same direction as the edge 211*a* in a plan view.

The punch outer surfaces 230*a*1 and 230*a*2 have a difference in height dimension in a vertical direction between a central position and both end positions in an extending direction thereof. That is, in a side view, the punch outer surfaces 230*a*1 and 230*a*2 have the lower end edges formed in a curved line shape that is convex vertically downward while having upper end edges formed in a linear shape.

The punch outer surfaces 230*a*1 and 230*a*2 having the lower end edges of such an inverted arcuate shape have a height dimension in a vertical direction that is larger at the central position than at both of the end positions in the extending direction.

The punch outer surfaces 230*a*1 and 230*a*2 have a convex curved shape that is curved in the same direction as the edge 211*a* in a plan view. Also, a radius of curvature of the punch outer surface 230*a*1 in a plan view is the same as the radius of curvature R1 of the curved edge 202*a* in the structural member 201. Further, a radius of curvature of the punch outer surface 230*a*2 in a plan view is larger than the radius of curvature of the punch outer surface 230*a*1. Due to the difference in radius of curvature, a length 115 shown in FIG. 22 is larger at the end portion position than at the central position in a longitudinal direction of the punch lower end surface 230*a*3. Thereby, the difference in height dimension in the extending direction of the punch outer surfaces 230*a*1 and 230*a*2 is absorbed. In other words, a sum of perimeters, which is a sum of lengths 114, 115, and 116 shown in FIG. 22, is the same at any position in an extending direction of the punch 230.

The drive unit includes a drive mechanism that brings the holder 220 closer to and further away from the die 210, and another drive mechanism that brings the punch 230 closer to and further away from the die groove 212. Therefore, the holder 220 and the punch 230 can be driven independently of each other.

Details of the blank 100 are as described above, and duplicate description thereof will be omitted here.

In order for the manufacturing device of a structural member having the above-described configuration to perform the first step, first, the blank 100 is placed on the top plate support surface 211 of the die 210, and then the holder 220 is lowered to sandwich the blank 100 between itself and the die 210. At that time, an end portion of the blank 100 is disposed to also overlap the horizontal plane 213 of the die 210 and then fixed.

Next, when the punch 230 is lowered by the drive mechanism, the blank 100 is sandwiched between the die groove 212 of the die 210 and the pressurizing surface 230*a* to be plastically deformed. Thereafter, the punch 230 is raised by the drive mechanism and then the holder 220 is raised by the drive mechanism. Then, the blank 100 after the first step is taken out from a top of the die 210.

Figure 24:
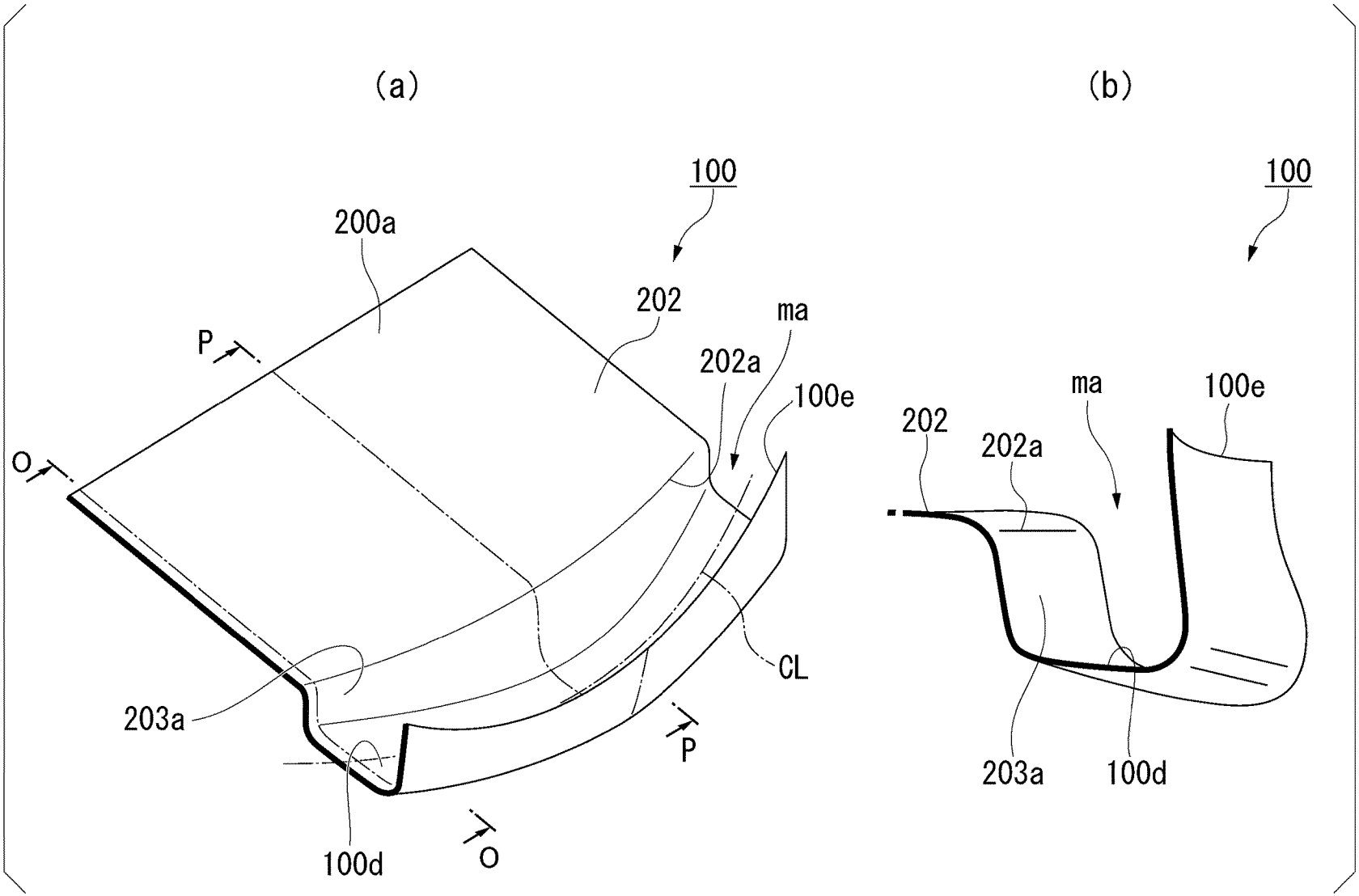
FIG. 24 is a view showing the blank formed in the first step of the second embodiment, in which FIG. 24(*a*) is a perspective view and FIG. 24(*b*) is a view along line O-O indicated by the arrows in FIG. 24(*a*).
Figure 25:
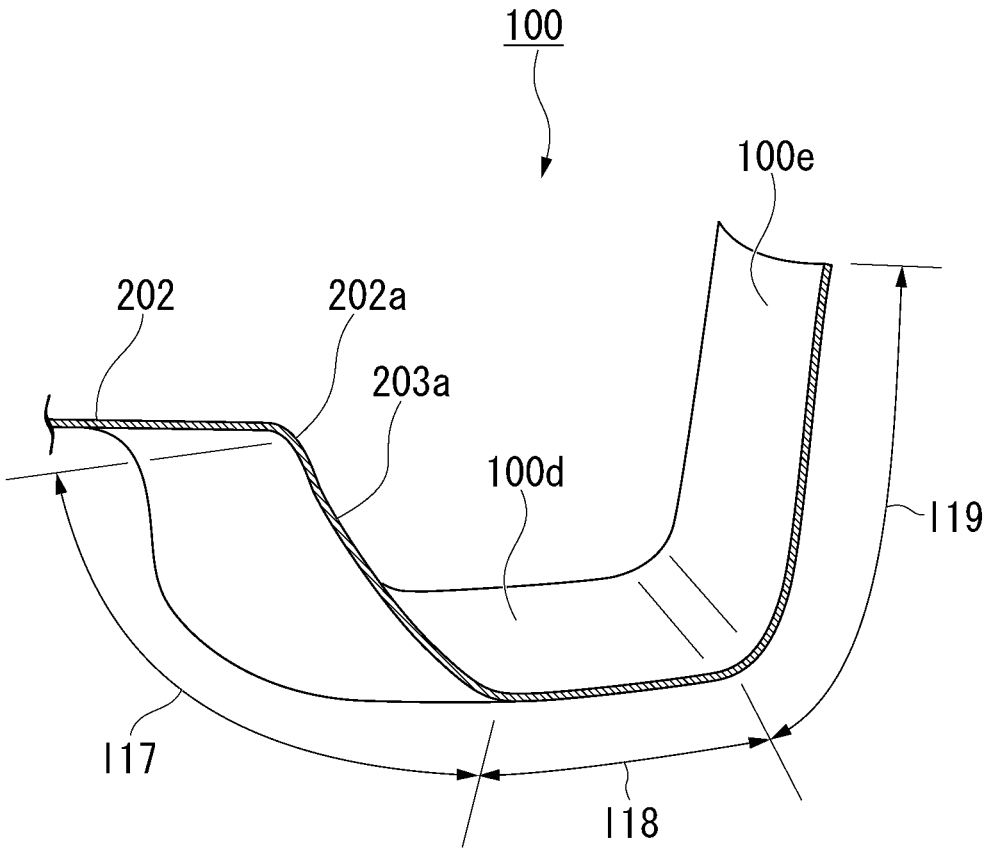
FIG. 25 is a view showing the blank after the first step of the second embodiment and is a view along line P-P indicated by the arrows in FIG. 24(*a*).

The blank 100 that has been subjected to the press processing in this way is shown in FIGS. 24 and 25. In FIG. 24, FIG. 24(*a*) is a perspective view, and FIG. 24(*b*) is a view along line O-O indicated by the arrows in FIG. 24(*a*). FIG. 25 is a view along line P-P indicated by the arrows in FIG. 24(*a*). After the first step, the top plate part 202 and the inner wall 203*a* that is continuous with the top plate part 202 via the curved edge 202*a* are integrally formed.

The blank 100 after the first step includes a groove part ma having the inner wall 203*a* and a vertical wall part 100*e*, and a band-shaped arcuate wall part 100*d* connecting lower end edges of them. The inner wall 203*a*, the vertical wall part 100*e*, and the band-shaped arcuate wall part 100*d* have convex curved shapes that are curved in the same direction as each other in a plan view.

The inner wall 203*a* and the vertical wall part 100*e* have a difference in height dimension of the lower end edges thereof between a central position and both end positions in an extending direction thereof. That is, the inner wall 203*a* and the vertical wall part 100*e* have the lower end edges formed in a curved line shape that is convex vertically downward in a side view.

In a plan view, a radius of curvature of the vertical wall part 100*e* is larger than a radius of curvature of the inner wall 203*a*. Due to the difference in radius of curvature, a length 118 shown in FIG. 25 is larger at the end portion position than at the central position in a longitudinal direction of the band-shaped arcuate wall part 100*d*. Thereby, the difference in height dimension in the extending direction of the inner wall 203*a* and the vertical wall part 100*e* is absorbed. In other words, a sum of perimeters, which is a sum of lengths 117, 118, and 119 shown in FIG. 25, is the same at any position in an extending direction of the band-shaped arcuate wall part 100*d*.

The band-shaped arcuate wall part 100*d* has a convex curved shape that is curved in the same direction as the edge 211*a* in a plan view. Further, the band-shaped arcuate wall part 100*d* has a height difference between a central position and an end portion position in an extending direction thereof in a longitudinal sectional view. That is, the band-shaped arcuate wall part 100*d* has a concave curved shape that is curved so that the central position is at a lower position relative to both of the end positions in the extending direction thereof. Then, a radius of curvature of the band-shaped arcuate wall part 100*d* in a longitudinal sectional view is larger than a radius of curvature of a center line CL passing through a central position in a width direction of the band-shaped arcuate wall part 100*d* in a plan view. Thereby, a height of the blank 100 from becoming too large and thus becoming unstable can be prevented when the blank 100 is placed by changing the die in the next step.

The band-shaped arcuate wall part 100*d* is a portion that will become the bottom wall 203*b* and the outer wall 203*c* through the following second and third steps. As described above, a height difference is provided in the band-shaped arcuate wall part (bottom wall) 100*d* of the groove part m between the central position (intermediate position) and both of the end positions (positions on both sides) sandwiching the central position therebetween in a longitudinal sectional view in an extending direction of the groove part ma by the pressing in the first step (intermediate step). Thereby, a curved part (second curved part) having a convex curved shape in a plan view and a concave curved shape in a longitudinal sectional view is formed in the band-shaped arcuate wall part 100*d*. Further, in the present embodiment, the band-shaped arcuate wall part 100*d* is all formed as a curved part, but the present invention is not limited only to this form, and only a part of the band-shaped arcuate wall part 100*d* may be formed as a curved part.

In the first step, when the band-shaped arcuate wall part 100*d* is subjected to press processing to form a curved shape that is convex vertically downward in a side view, it is simultaneously deformed into a convex curved shape in a plan view. Thereby, since an upper portion of the vertical wall part 100*e* is subject to shrink flange deformation and comes closer to the top plate part 202, the upper portion of the vertical wall part 100*e* can be brought closer to the curved edge 202*a* in advance.

[Second Embodiment/Second Step]

Figure 26:
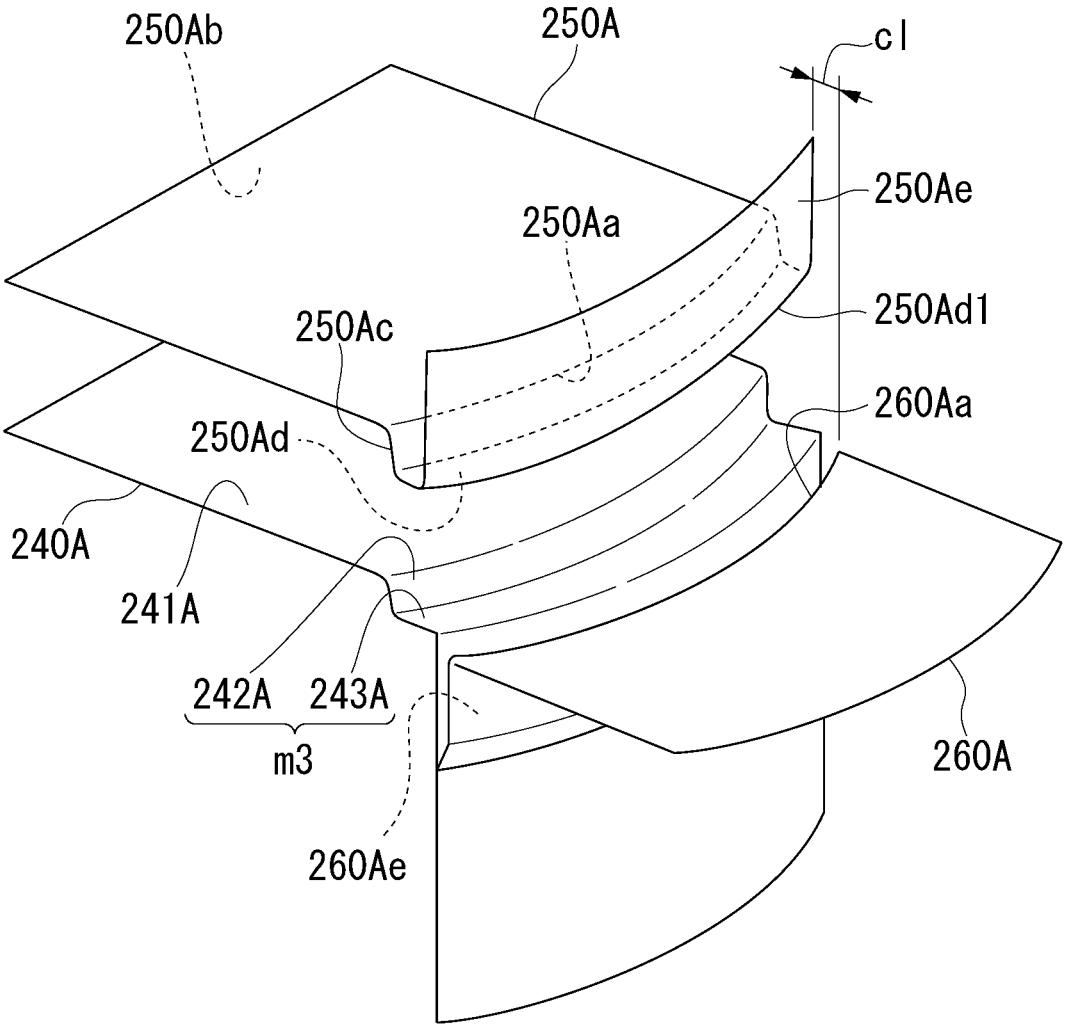
FIG. 26 is a perspective view of dies used in a second step of the second embodiment.
Figure 27:
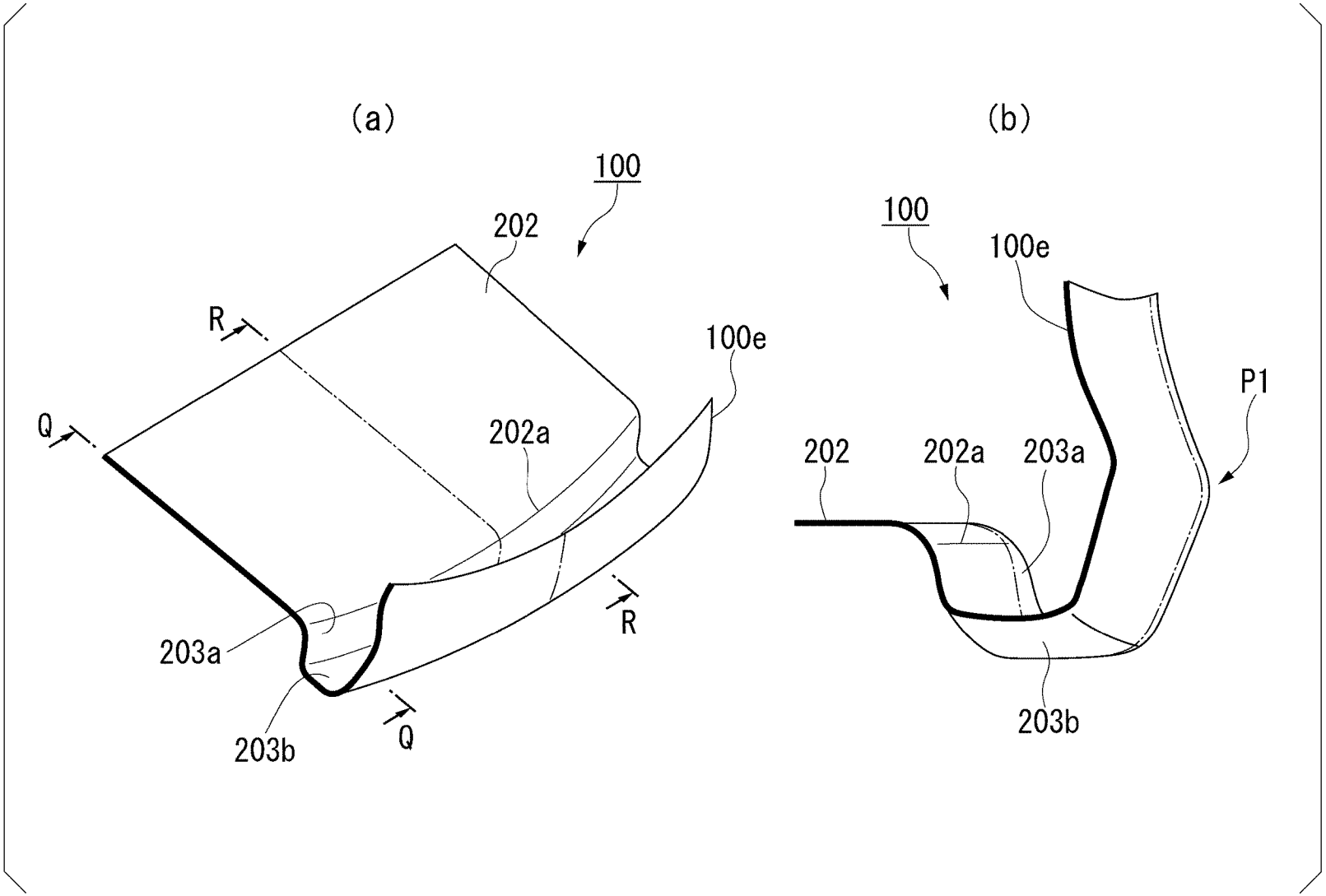
FIG. 27 is a view showing the blank after the second step of the second embodiment, in which FIG. 27(*a*) is a perspective view and FIG. 27(*b*) is a view along line O-Q indicated by the arrows in FIG. 27(*a*).

Next, a second step of the present embodiment will be described with reference to FIGS. 26 and 27. FIG. 26 is a perspective view of dies used in the second step. FIG. 27 is a view showing a blank after the second step, in which FIG. 27(*a*) is a perspective view and FIG. 27(*b*) is a view along line O-Q indicated by the arrows in FIG. 27(*a*).

Before explanation of the present step, the dies shown in FIG. 26 will be described below.

The manufacturing device of a structural member of the present embodiment further includes the dies shown in FIG. 26. These dies include a die 240A on which the blank 100 after the first step is placed, a holder 250A that presses down a portion of the blank 100 that will become the top plate part 202 and a portion thereof that will become the bottom wall 203*b* from above, a punch 260A that forms the outer wall 203*c* by partially pushing up and bending the band-shaped arcuate wall part 100*d*, a drive mechanism (not shown) that brings the holder 250A closer to and further away from the die 240A, and another drive mechanism (not shown) that brings the punch 260A closer to and further away from the blank 100.

The die 240A includes a top plate support surface 241A that supports a portion of the blank 100 that will become the top plate part 202, and a die groove (second die groove) m3 that is continuous with the top plate support surface 241A. The die groove m3 includes a die groove side surface 242A continuous with the top plate support surface 241A and formed vertically downward, and a die groove bottom surface 243A continuous with the die groove side surface 242A and directed in a direction horizontally away from the top plate support surface 241A.

The die groove side surface 242A has a height dimension in a vertical direction that is the same at any position from one end to the other end in an extending direction thereof. Then, the die groove side surface 242A has a convex curved shape having the same radius of curvature in the same direction as the edge 211*a* in a plan view.

The die groove bottom surface 243A has a width dimension in a horizontal direction that is the same at any position from one end to the other end in an extending direction thereof. Then, the die groove bottom surface 243A has a convex curved shape that is curved in the same direction as the edge 211*a* in a plan view. Further, the die groove bottom surface 243A forms a horizontal plane without unevenness from one end to the other end thereof.

The holder 250A includes a convex curved edge 250Aa having the same radius of curvature in the same direction as the edge 211*a*, a flat lower surface 250Ab that presses down the upper surface 200*a* of the blank 100, an inner wall surface 250Ac that is continuous with the lower surface 250Ab via the edge 250Aa, a lower surface 250Ad that is continuous with the inner wall surface 250Ac, and a vertical wall surface 250Ae continuous with the lower surface 250Ad and rising vertically upward.

The inner wall surface 250Ac and the vertical wall surface 250Ae are parallel to each other and have a convex curved shape that is curved in the same direction as the edge 250Aa.

Also, the lower surface 250Ad has a convex curved shape that is curved in the same direction as the edge 211*a* in a bottom view. Then, a width dimension of the lower surface 250Ad corresponds to the width dimension of the bottom wall 203*b* of the structural member 201. That is, the lower surface 250Ad has a smaller width than the band-shaped arcuate wall part 100*d* to pressurize only the portion of the band-shaped arcuate wall part 100*d* shown in FIG. 24 to be the bottom wall 203*b*. Therefore, a portion of the band-shaped arcuate wall part 100*d* that is not pressurized by the lower surface 250Ad bends vertically upward to become the outer wall 203*c* when the punch 260A pushes it upward. More specifically, the band-shaped arcuate wall part 100*d* bends in a state in which a ridge line 250Ad1 of the lower surface 250Ad shown in FIG. 26 hits a center of the band-shaped arcuate wall part 100*d* in a width direction. Therefore, the bottom wall 203*b* and the vertical wall part 100*e* which includes the portion to be the outer wall 203*c* in the next step are formed with this bending position as a boundary.

The punch 260A has a concave curved ridge line 260Aa that is curved in the same direction as the ridge line 250Ad1 of the holder 250A in a plan view. Then, when the punch 260A is raised, the ridge line 260Aa hits a back surface side of the band-shaped arcuate wall part 100*d* to apply a bend in cooperation with the ridge line 250Ad1.

In order to perform the second step using the dies described above, first, the blank 100 after the first step is placed on the top plate support surface 241A of the die 240A. At that time, the bottom wall 203*b* of the blank 100 is disposed on the die groove bottom surface 243A, and furthermore, the inner wall 203*a* is disposed to be in surface contact with the die groove side surface 242A. At this time, the bottom wall 203*b* has a curved shape and thus is slightly raised from the die groove bottom surface 243A except for a center thereof.

Next, when the holder 250A is lowered, the flat lower surface 250Ad thereof comes into contact with two topmost parts at both end positions in an extending direction of the concave curved bottom wall 203*b*. When the holder 250A is further lowered, the bottom wall 203*b* is bent back so that a curvature thereof is gradually reduced. Then, when the holder 250A reaches a bottom dead center, the bottom wall 203*b* is sandwiched between the lower surface 250Ad and the die groove bottom surface 243A and plastically deformed into a completely flat shape. In this process, since a force for bending back the curvature of the bottom wall 203*b* is transferred to the vertical wall part 100*e*, the vertical wall part 100*e* is plastically deformed to stand upright more than that in the original state.

As described above, the inner wall 203*a* of the blank 100 is sandwiched and fixed between the die groove side surface 242A and the inner wall surface 250Ac. Further, a part of the band-shaped arcuate wall part 100*d* of the blank 100 is sandwiched and fixed between the die groove bottom surface 243A and the lower surface 250Ad while leaving the other portion.

Next, when the punch 260A is raised by the drive mechanism, the other portion of the band-shaped arcuate wall part 100*d* is pushed upward from below. As a result, a fold line is formed between the portion of the band-shaped arcuate wall part 100*d* to be the bottom wall 203*b* and a portion thereof to be the vertical wall part 100*e*.

At this time, as described above, since the upper portion of the vertical wall part 100*e* has been brought closer to the curved edge 202*a* in advance at the time of the first step, an upper end edge of the vertical wall part 100*e* can be sufficiently collapsed toward the curved edge 202*a* while leaving a bend at an intermediate position of the vertical wall part 100*e* in a height direction.

Further, as shown in FIG. 26, it is preferable that a vertical wall surface 260Ae (second vertical wall surface) of the punch 260A be disposed to face the vertical wall surface 250Ae (first vertical wall surface) of the holder 250A at a distance cl of 5 mm or more and 50 mm or less in a horizontal direction. In this case, the upper end edge of the vertical wall part 100*e* can be more reliably inclined to come closer to the top plate part 202 in the manner of leaning forward while leaving the bent portion formed in the first step at the intermediate position of the vertical wall part 100*c* in the height direction. The reason is the same as the reason described with reference to FIG. 6(*b*) in the first embodiment described above, and description thereof will be omitted here.

The blank 100 that has been subjected to press processing in the second step in this way is shown in FIG. 27. After the second step, the top plate part 202, the inner wall 203*a* formed integrally with the top plate part 202 via the curved edge 202*a*, the flat bottom wall 203*b* that is continuous with the inner wall 203*a*, and the vertical wall part 100*e* that is continuous with the bottom wall 203*b* are formed. The vertical wall part 100*e* has an elongated dimension in a vertical direction by applying a bend to a part of the band-shaped arcuate wall part 100*d* as can be found in comparison with that in FIG. 24(*b*). Also, the bend between the band-shaped arcuate wall part 100*d* and the vertical wall part 100*e* applied in the first step remains at a position indicated by reference sign P1 in FIG. 27(*b*) in the vertical wall part 100*e* after the second step. Therefore, the upper end edge of the vertical wall part 100*e* is brought close to the curved edge 202*a*.

[Second Embodiment/Third Step]

Next, a third step of the present embodiment will be described below with reference to FIGS. 28 to 30.

Figure 28:
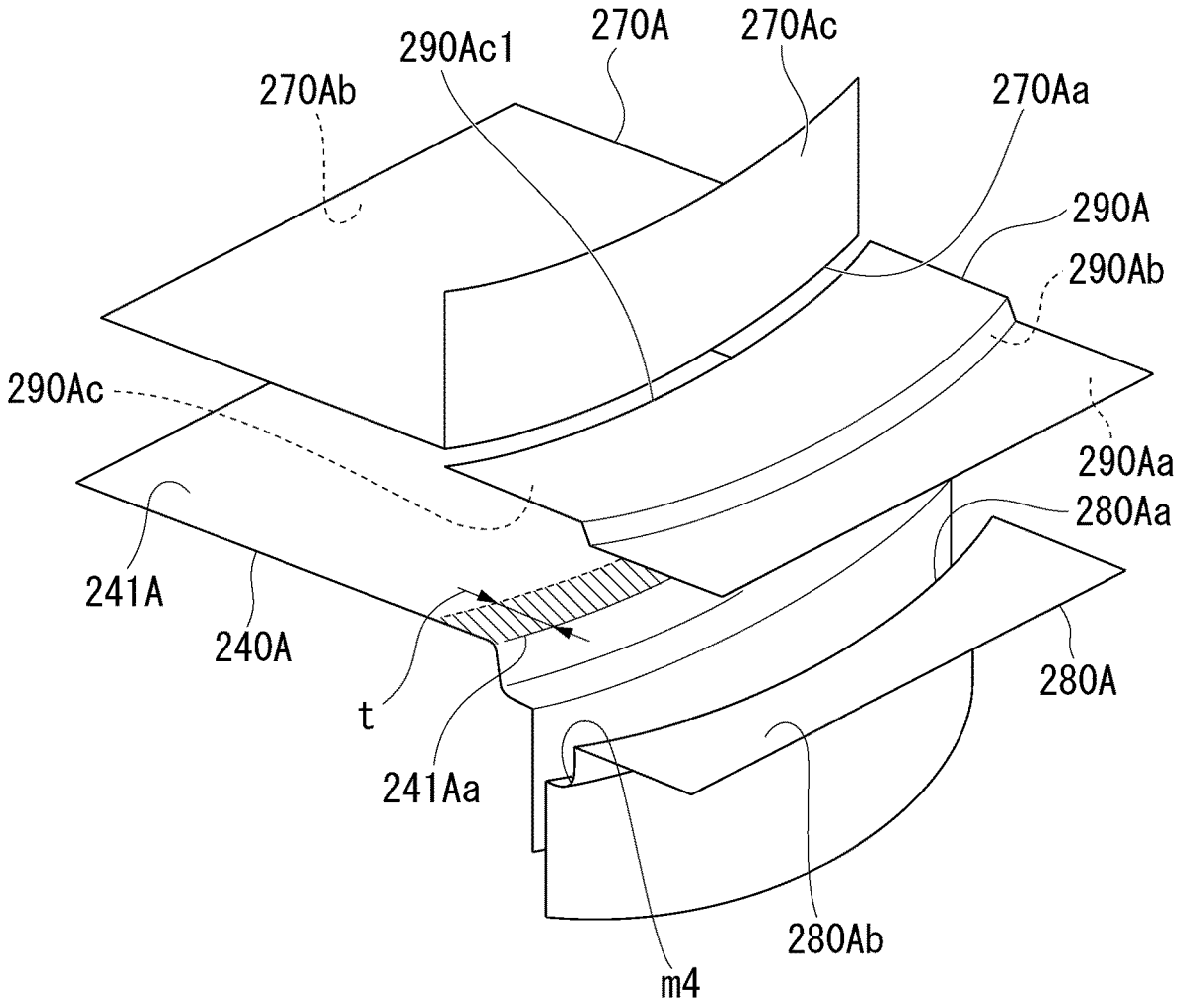
FIG. 28 is a perspective view of dies used in a third step of the second embodiment.

FIG. 28 is a perspective view of dies used in the third step. FIG. 29 is a view showing a shape of the blank 100 before starting the third step and is a view along line R-R indicated by the arrows in FIG. 27(*a*). FIG. 30 is a view showing the blank during the third step, in which FIG. 30(*a*) is a perspective view and FIG. 30(*b*) is a view along line T-T indicated by the arrows in FIG. 30(*a*).

The manufacturing device of a structural member of the present embodiment further includes dies shown in FIG. 28. These dies include the die 240A on which the blank 100 after the second step is continuously placed, a holder 270A disposed above the die 240A and configured to move vertically, a punch 280A disposed adjacent to the die 240A and configured to move vertically, a pad 290A disposed above the punch 280A and configured to move vertically, a drive mechanism (not shown) that brings the holder 270A closer to and further away from the die 240A, another drive mechanism (not shown) that brings the punch 280A closer to and further away from the blank 100, and still another drive mechanism (not shown) that brings the pad 290A closer to and further away from the punch 280A.

The holder 270A includes a convex curved ridge line 270Aa that is curved in the same direction as the edge 211Aa in a plan view, a flat lower surface 270Ab that presses down the upper surface 100*a* of the blank 100, and a vertical wall surface 270Ac continuous with the lower surface 270Ab via the ridge line 270Aa and rising vertically upward.

The punch 280A includes a die groove (third die groove) m4 having a concave curved edge 280Aa curved in the same direction as the ridge line 270Aa of the holder 270A and adjacent to the die 240A in a plan view, and a flat upper surface 280Ab that is continuous with the edge 280Aa. When the punch 280A is raised, the edge 280Aa thereof hits a lower end portion of the vertical wall part 100*e* of the blank 100 to apply a bend there.

The pad 290A includes a flat lower surface 290Aa, a concave curved inclined surface 290Ab that is continuous with the lower surface 290Aa, and a concave curved lower surface 290Ac that is continuous with the inclined surface 290Ab. A step is formed between the lower surface 290Aa and the lower surface 290Ac via the inclined surface 290Ab. Also, an edge 290Ac1 of the lower surface 290Ac has a concave curved shape having the same radius of curvature in the same direction as the ridge line 270Aa.

In order to perform the third step using the dies described above, first, while the blank 100 after the second step remains placed on the top plate support surface 241A of the die 240A, the holder 270A is used instead of the holder 250A and the top plate part 202 is sandwiched between the holder 270A and the top plate support surface 241A. At this time, the holder 270A is disposed so that the vertical wall surface 270Ac thereof is retreated from the edge 241Aa of the die 240A by a predetermined width dimension t in a plan view. Thereby, a region of the width dimension t shown by hatching in FIG. 28 serves as a joint margin in a horizontal direction when the vertical wall part 100*e* is bent to form a closed cross section in the third step.

Figure 29:
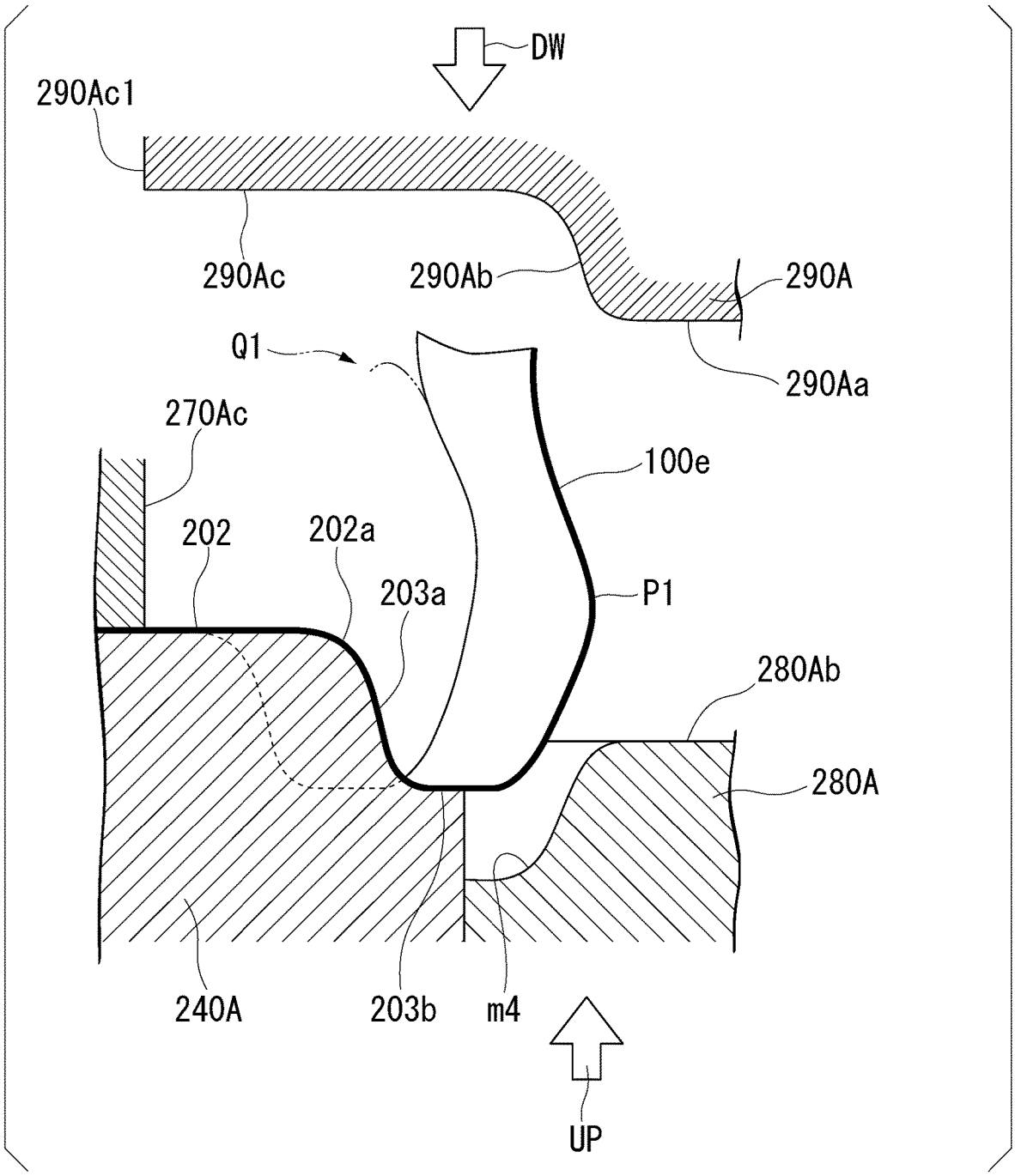
FIG. 29 is a view showing a shape of the blank before the third step of the second embodiment is started and is a view along line R-R indicated by the arrows in FIG. 27(*a*).

Next, in FIG. 29, the punch 280A is raised in a direction of an arrow UP to support the bottom wall 203*b* of the blank 100 and a portion of the vertical wall part 100*e* to be the outer wall 203*c* from outer peripheries thereof.

Thereafter, in FIG. 29, the pad 290A is lowered in a direction of an arrow DW to bring the lower surface 290Aa of the pad 290A into contact with the upper surface 280Ab of the punch 280A. At this time, the upper end edge of the vertical wall part 100*e* of the blank 100 is all below the inclined surface 290Ab or the lower surface 290Ac. Therefore, when the pad 290A is lowered, the inclined surface 290Ab and the lower surface 290Ac thereof can push down the upper end edge of the vertical wall part 100*e* while guiding it toward a joining position on the top plate part 202. At that time, the bend indicated by reference sign P1 of the vertical wall part 100*e* gradually increases, and as a result, a boundary between the outer wall 203*c* and the upper wall 203*d* is formed.

Moreover, even when the upper end edge of the vertical wall part 100*e* tries to pass the joining position with the top plate part 202 before the pad 290A reaches the bottom dead center, movement thereof is blocked by the vertical wall surface 270Ac. The vertical wall part 100*e* whose upper end edge is blocked forms a closed cross-sectional shape to be in close contact with inner wall surfaces of a closed space formed by the die 240A, the punch 280A, and the pad 290A because a force applied to the vertical wall surface 270Ac returns to the vertical wall part 100*e* itself as a reaction force.

Here, a gap at the bottom dead center of forming with respect to the top plate support surface 241A (first top plate support surface) of the die 240A is larger on the pressurizing surface (lower surface 290Ac) of the pad 290A than on the pressurizing surface (lower surface 270Ab) of the holder 270A. More specifically, when the holder 270A reaches the bottom dead center, a gap between the pressurizing surface of the holder 270A and the top plate support surface 241A of the die 240A is defined as g3. Further, when the pad 290A reaches the bottom dead center, a gap between the pressurizing surface of the pad 290A and the top plate support surface 241A of the die 240A is defined as g4. In this case, the gap g3 is substantially equal to a plate thickness of the top plate part 202, and the gap g4 is substantially equal to a dimension obtained by adding a plate thickness of the upper end edge of the vertical wall part 100*e* to the plate thickness of the top plate part 202. That is, gap g4>gap g3 is established. Therefore, in the holder 270A, the top plate part 202 can be firmly sandwiched between the holder 270A and the die 240A, and in the pad 290A, a joint margin for sandwiching the top plate part 202 and the upper end edge of the vertical wall part 100*e* can be obtained between the pad 290A and the die 240A.

Figure 30:
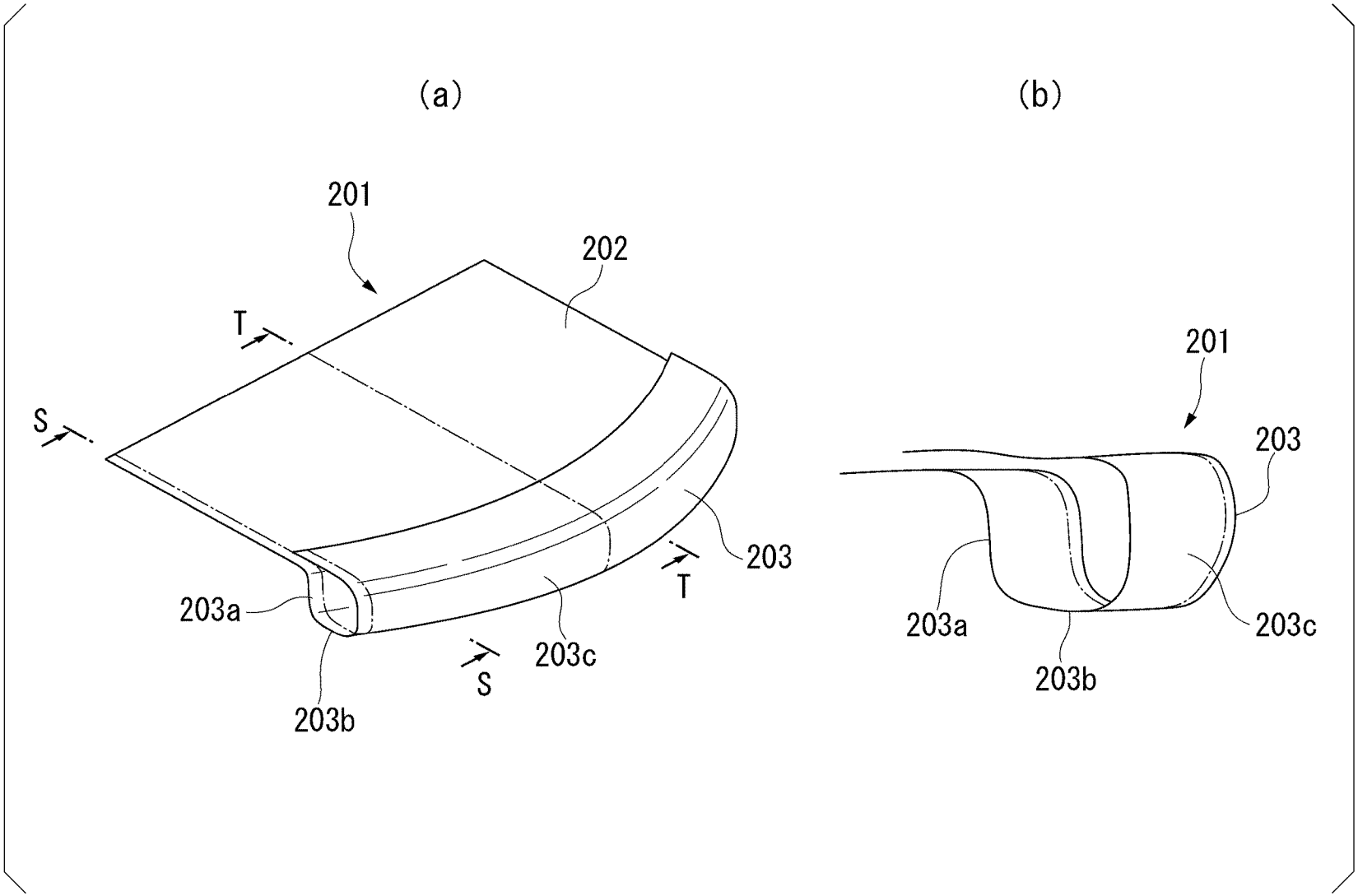
FIG. 30 is a view showing the blank after the third step of the second embodiment, in which FIG. 30(*a*) is a perspective view and FIG. 30(*b*) is a view along line S-S indicated by the arrows in FIG. 30(*a*).

Finally, when the upper wall 203*d* is joined to the joining position of the top plate part 202 using an appropriate joining method, the curved reinforcing part 203 shown in FIG. 30 is formed. The curved reinforcing part 203 has a uniform cross-sectional shape at any position in the extending direction thereof.

Figure 31:
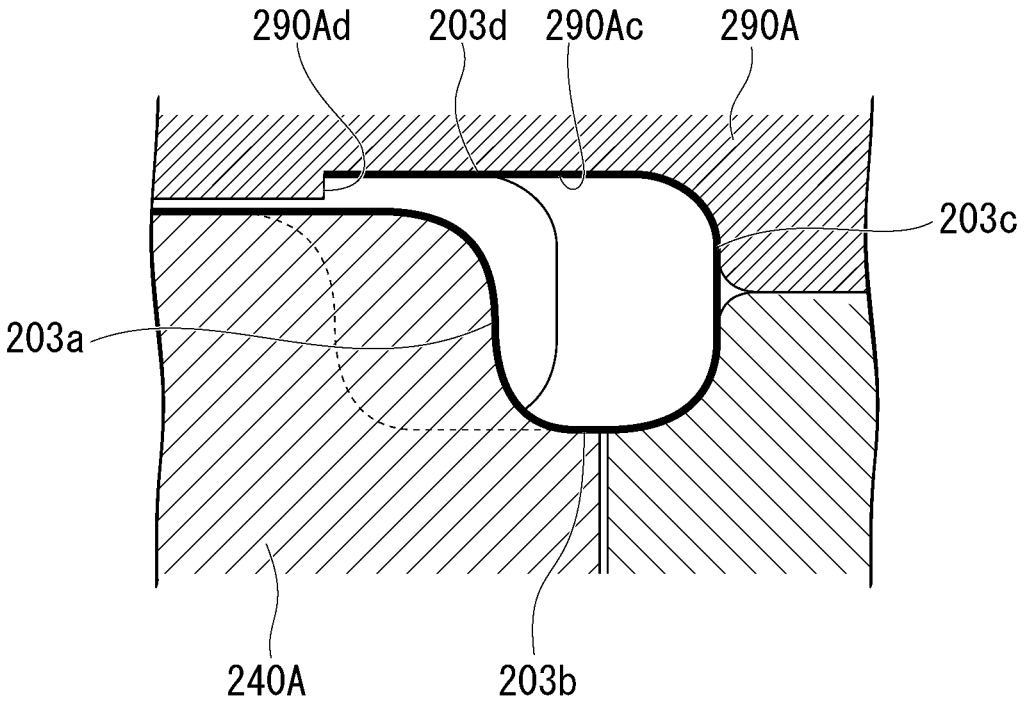
FIG. 31 is a view showing a modified example of the second embodiment and is a cross-sectional view of the blank in the third step along line T-T shown in FIG. 30(*a*).

Further, in the present step, excessive movement of the upper end edge of the vertical wall part 100*e* is restricted by the vertical wall surface 270Ac, but the present invention is not limited only to this form, and for example, a restricting surface 290Ad continuous with the lower surface 290Ac and formed downward from an end portion of the lower surface 290Ac may be provided to the pad 290A as shown in a modified example in FIG. 31. In this case, since the movement of the upper end edge of the vertical wall part 100*e* is blocked by the restricting surface 290Ad, the vertical wall surface 270Ac can be omitted from the holder 270A.

Also, in the present step, the third step is performed following the second step, but the present invention is not limited to this mode. For example, as shown in FIG. 29, an upper end edge bending step of forming a bent part Q1 by bending the upper end edge of the vertical wall part 100*e* toward the top plate part 202 may be further provided after the second step and before the third step. In this case, wear of the lower surface 290Ac of the pad 290A due to a sliding contact with the upper end edge of the vertical wall part 100*e* can be suppressed. In addition, when the pad 290A reaches the bottom dead center, since the lower surface 290Ac thereof presses and crushes the bent part Q1 flat, the bent part Q1 is not left in the following step.

Further, instead of providing the bent part Q1, a coating agent that imparts wear resistance to the inclined surface 290Ab and the lower surface 290Ac of the pad 290A may be applied in advance. Moreover, both the formation of the bent part Q1 and the application of a coating agent may also be employed.

Figure 32:
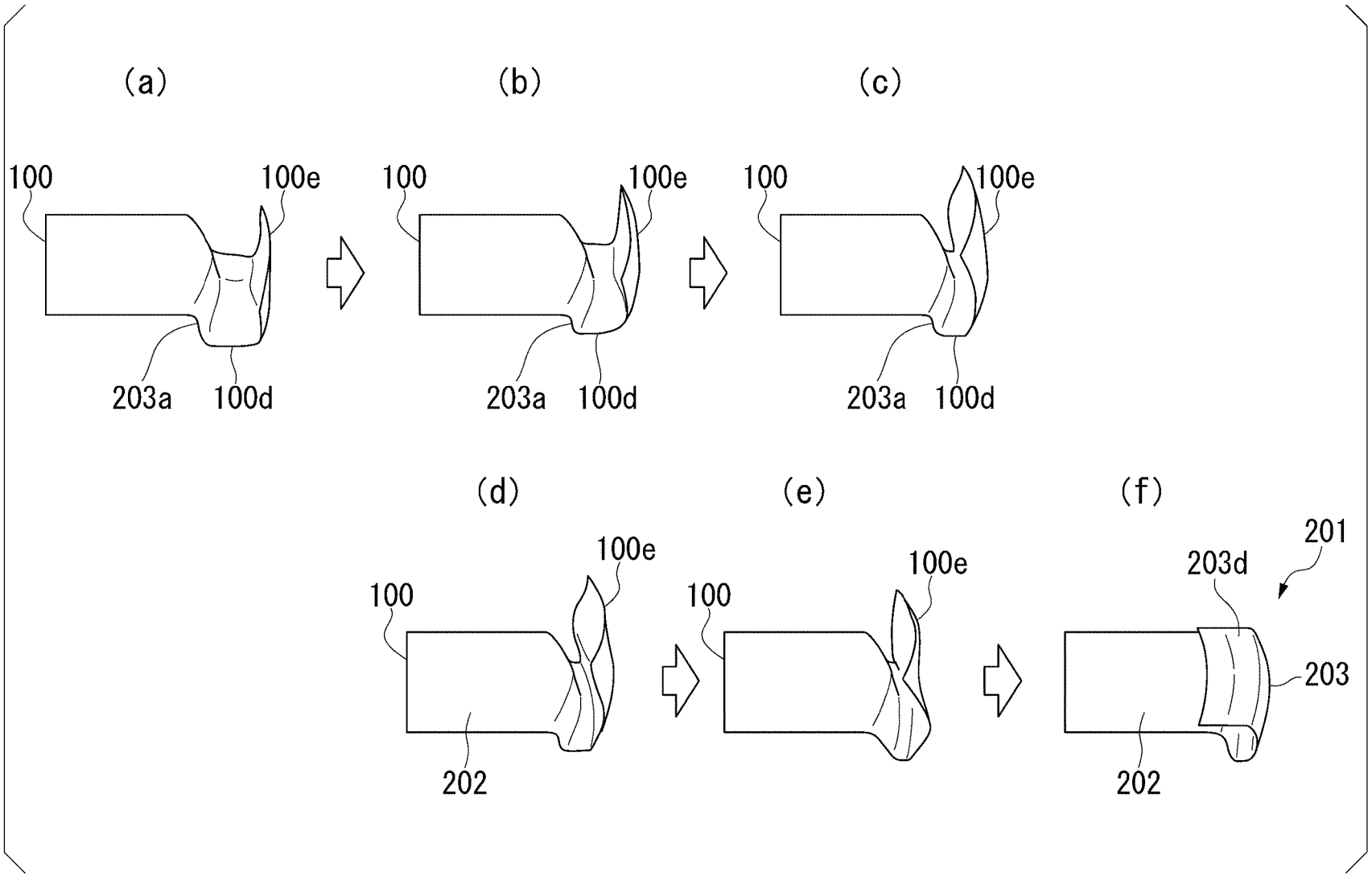
FIG. 32 is a perspective view in which changes in shape of the blank from the second step to the third step of the second embodiment are arranged in a time series in order from (a) to (f).

Of the steps described above, a perspective view in which changes in shape of the blank 100 from the second step to the third step are arranged in a time series in order from (a) to (f) is shown in FIG. 32. Further, in FIG. 32, FIG. 32(*a*) to FIG. 32(*c*) indicate the second step, and FIG. 32(*d*) to FIG. 32(*f*) indicate the third step. Also, illustration of each die is omitted.

First, in FIG. 32(*a*), the blank 100 after the first step is sandwiched between the die 240A and the holder 250A. Then, when the punch 260A is raised, the state shown in FIG. 32(*b*) is obtained. At this time, in order to incline the upper end edge of the vertical wall part 100*e* toward the top plate part 202, it is necessary to incline the upper portion of the vertical wall part 100*e* toward the curved edge 202*a* in advance, but since the bending processing for that has already been applied in the first step, the upper end edge of the vertical wall part 100*e* can be inclined with a margin. Therefore, a boundary (fold line) between the portion of the vertical wall part 100*e* to be the outer wall 203*c* and the portion thereof to be the upper wall 203*d* is maintained even when the punch 260A is further raised to be the state shown in FIG. 32(*b*).

In the following third step, since the upper end edge of the vertical wall part 100*e* is pushed down by the pad 290A in a state in which the vertical wall part 100*e* of the blank 100 is sufficiently collapsed, the vertical wall part 100*e* properly collapses toward the joining position with the top plate part 202 as shown in FIGS. 32(*d*) to 32(*e*). Then, when the upper wall 203*d* is fixed at the joining position using an appropriate joining method as shown in FIG. 32(*f*), the structural member 201 having the curved reinforcing part 203 is completed.

An outline of the present embodiment described above is summarized below.

The manufacturing method of a structural member of the present embodiment is a method of manufacturing the structural member 201 including the top plate part 202 having the curved edge 202*a*, and the curved reinforcing part 203 that is formed integrally with the top plate part 202 in the extending direction of the curved edge 202*a* and in which a cross section perpendicular to the extending direction of the curved edge 202*a* has a closed cross-sectional shape from the blank (flat plate material) 100.

Then, the manufacturing method includes the first step (intermediate step) of forming the groove part ma extending in the extending direction of the curved edge 202*a* and having a U-shaped cross section perpendicular to the above-described extending direction and the vertical wall part 100*e* that is continuous with the groove part ma in a state in which a portion (first portion) of the blank 100 corresponding to the top plate part 202 is sandwiched by pressing the other portion (second portion including the inner wall 203*a*, the band-shaped arcuate wall part 100*d*, and the vertical wall part 100*e*) of the blank 100 that is continuous with the curved edge 202*a* of the top plate part 202 in a depth direction with respect to a surface of the blank 100, and the third step (joining step) of forming the curved reinforcing part 203 by overlapping and joining an upper end edge of the vertical wall part 100*e* to the top plate part 202.

Then, in the pressing of the first step, a height difference is provided between a central position and an end portion position of the band-shaped arcuate wall part 100*d* (bottom wall) of the groove part ma in a longitudinal sectional view in the extending direction.

That is, as shown in FIG. 24, the band-shaped arcuate wall part 100*d* is formed in a convex curved shape in a plan view and a concave curved shape in a longitudinal sectional view by the pressing in the first step.

Further, the portion corresponding to the top plate part 202 is not completely fixed but is in a sandwiched state at the time of the press forming in the first step. Therefore, movement and deformation of the sandwiched portion out of the plane is restricted, but a metal flow in which some of the sandwiched portion is directed toward another portion such as the inner wall 203*a* is allowed.

In the third step, the upper end edge of the vertical wall part 100*e* is pushed down toward the groove part ma while movement thereof toward the top plate part 202 is allowed, and thereby the upper end edge is bent toward the top plate part 202. Then, movement of the upper end edge past a planned joining position on the top plate part 202 is restricted.

An upper end edge bending step of forming the bent part Q1 by bending the upper end edge toward the top plate part 202 may be further provided before the third step.

When a cross-sectional line length (a sum of perimeters which is a sum of lengths 117, 118, and 119 shown in FIG. 25) of the U-shape at the cross section perpendicular to the extending direction of the groove part ma is viewed, a ratio obtained by dividing the cross-sectional line length at the central position by the cross-sectional line length at the end portion position is preferably within a range of 0.7 to 1.3 by the pressing in the first step. Further, it is more preferable that the cross-sectional line lengths at the central position and the end portion position be the same as each other.

Further, it is most preferable that the cross-sectional line length at any position in the extending direction of the groove part ma be all made equal.

When the ratio of the cross-sectional line lengths is less than 0.7 or more than 1.3, a difference in the cross-sectional line length between the central position and the end portion position becomes too large. In this case, when the curved reinforcing part 203 having substantially the same cross-sectional area at any position in the extending direction of the groove part ma is formed, the difference in the cross-sectional line length may cause forming defects such as cracks or wrinkles at an end edge of the upper wall 203*d*. Therefore, the ratio of the cross-sectional line lengths is preferably in the range of 0.7 to 1.3.

Also, an R/R1 ratio obtained by dividing the radius of curvature R (mm) of the center line passing through the central position in a width direction of the band-shaped arcuate wall part 100*d* in a plan view by the radius of curvature R1 (mm) of the band-shaped arcuate wall part 100*d* in a longitudinal sectional view may be set within a range of 0.2 to 1.2 in the groove part ma by the pressing in the first step. In this case, a suitable forming result without constriction or dimensional errors can be obtained even when a high-strength steel sheet of 780 MPa class is used as the blank 100. Further, when a high-strength steel sheet of 980 MPa class or higher is used, the R/R1 ratio is more preferably within a range of 0.3 to 0.9, and in this case, a suitable forming result without constriction or dimensional errors can be obtained even if a high-strength steel sheet of 980 MPa class is used. Further, it is most preferable to set the R/R1 ratio to 0.5, and in this case, a suitable forming result without constriction or dimensional errors can be obtained even when a high-strength steel sheet of 1180 MPa class is used.

On the other hand, when this is viewed from another perspective, it is preferable that the radius of curvature R1 of the band-shaped arcuate wall part 100*d* in a longitudinal sectional view be made larger than the radius of curvature R of the center line CL passing through the central position in a width direction of the band-shaped arcuate wall part 100*d* in a plan view by the pressing in the first step (R1>R). In this case, it is possible to avoid unstable positioning when the structural member is transferred to another die in the next step.

The structural member 201 may be an automobile body part. More specifically, the present invention may be applied in manufacturing lower arms.

The manufacturing device of a structural member of the present embodiment can be suitably used in the above-described manufacturing method, and the structural member 201 is manufactured from the blank 100.

Then, the manufacturing device uses the die (first die) 210 in which the die groove (first die groove) 212 curved in a plan view is formed and the punch (first punch) 230 that moves relatively closer to and further away from the die groove 212 in the first step. Then, the die groove bottom surface (bottom surface) 212*b* of the die groove 212 has a height difference in a longitudinal sectional view between the central position and the end portion position in an extending direction of the die groove bottom surface 212*b*.

Further, the punch lower end surface 230*a*3 of the pressurizing surface 230*a* of the punch 230 has a height difference corresponding to that of the die groove bottom surface 212*b*. Further, the "corresponding height difference" in the punch lower end surface 230*a*3 means a height difference formed by the punch lower end surface 230*a*3 curved in the same direction as the die groove bottom surface 212*b* and is preferably the same as the height difference of the die groove bottom surface 212*b*.

The die groove bottom surface 212*b* of the die groove 212 has a convex curved shape in a plan view and a concave curved shape in a longitudinal sectional view.

When viewed along a cross-sectional line length of the U-shape which is a cross section perpendicular to the extending direction of the die groove 212, a ratio obtained by dividing the cross-sectional line length at the central position by the cross-sectional line length at the end portion position is preferably within a range of 0.7 to 1.3. Further, it is more preferable that the cross-sectional line lengths at the central position and the end portion position be the same as each other. Further, it is most preferable that the cross-sectional line length at any position in the extending direction of the die groove 212 be all made equal. Thereby, forming defects described above can be more reliably prevented.

In the die groove bottom surface 212*b*, the radius of curvature of the center line passing through the central position in a width direction in a plan view is smaller than the radius of curvature in a longitudinal sectional view.

Further, the manufacturing device further includes the following dies used in the second step including the die (second die) 240A having the die groove bottom surface (second die groove) 243A that is thinner than the die groove 212, the holder (first holder) 250A having the lower surface (curved convex part) 250Ad having a shape corresponding to the die groove bottom surface 243A, and the punch (second punch) 260A disposed adjacent to the die groove bottom surface 243A and configured to move relatively closer to and further away from the die groove bottom surface 243A.

Further, the manufacturing device further includes the following dies used in the third step including the holder (second holder) 270A disposed to overlap the die 240A, the punch (third punch) 280A having a third die groove that is adjacent to the die groove bottom surface 243A, and the pad 290A having the lower surface (pressurizing surface) 290Ac that moves relatively closer to and further away from both the die groove bottom surface 243A and the third die groove.

The holder 270A has the vertical wall surface (first restricting surface) 270Ac adjacent to the lower surface 290Ac of the pad 290A and intersecting the lower surface 290Ac. Alternatively, the pad 290A may have a restricting surface (second restricting surface) 290Ad continuous with the lower surface 290Ac and intersecting the lower surface 290Ac as shown in FIG. 31.

Third Embodiment

In the first embodiment, the concave curved reinforcing part 3 is formed in a plan view, and in the second embodiment, the convex curved reinforcing part 203 is formed in a plan view. In both the curved reinforcing parts 3 and 203, a cross-sectional shape intersecting each of them in an extending direction thereof was a closed cross-sectional shape. However, the present invention can also be applied to processing of a curved reinforcing part having an open cross-sectional shape. Therefore, a case of manufacturing a structural member including a curved reinforcing part that forms a concave shape in a plan view and has an open cross-sectional shape will be described in the present embodiment. Also, a case of manufacturing a structural member including a curved reinforcing part that forms a convex shape in a plan view and has an open cross-sectional shape will be described in a fourth embodiment to be described later.

Figure 33:
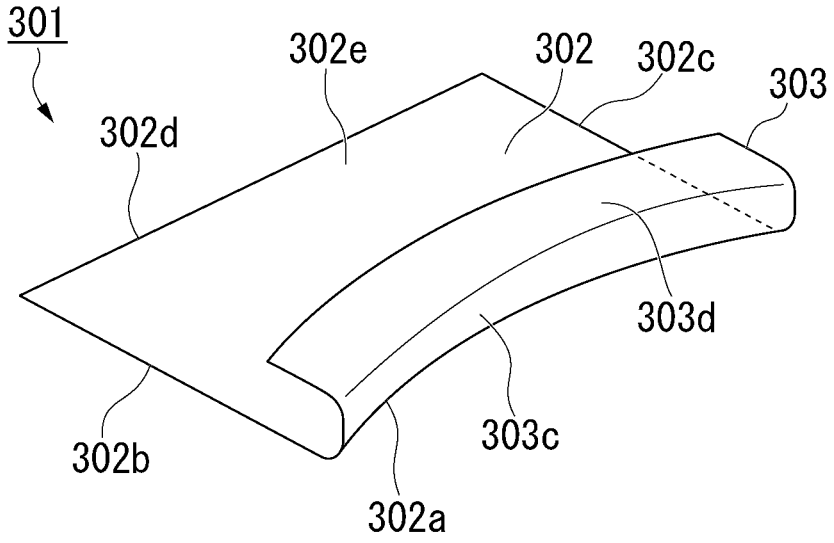
FIG. 33 is a perspective view showing a structural member manufactured by a manufacturing method of a structural member according to a third embodiment of the present invention.

A structural member 301 shown in FIG. 33 includes a top plate part 302 having a concave curved edge 302*a* in a bottom view, and a curved reinforcing part 303 that is formed integrally with the top plate part 302 at the curved edge 302*a* and in which a cross section perpendicular to an extending direction of the curved edge 302*a* has an open cross-sectional shape.

The top plate part 302 is a flat plate portion defined by a pair of both lateral edges 302*b* and 302*c* parallel to each other, the curved edge 302*a* continuous between the lateral edges 302*b* and 302*c* and forming a front edge, and a rear edge 302*d* facing the curved edge 302*a* and continuous between the lateral edges 302*b* and 302*c*. The lateral edges 302*b* and 302*c* and the rear edge 302*d* each have a linear shape. On the other hand, the curved edge 302*a* has a concave curved shape whose center is closer to the rear edge 302*d* with respect to both ends thereof. As a radius of curvature R of the concave curved shape in a plan view, 100 mm to 400 mm may be exemplified. However, the radius of curvature R is not limited to this range.

The curved reinforcing part 303 includes an outer wall 303*c* continuous with the curved edge 302*a* of the top plate part 302 and directed vertically upward, and an upper wall 303*d* continuous with the outer wall 303*c* and spaced apart from an upper surface 302*e* of the top plate part 302.

The outer wall 303*c* has a height dimension in a vertical direction that is the same at any position from one end to the other end in an extending direction of the curved reinforcing part 303. Then, the outer wall 303*c* has a concave curved shape that is curved in the same direction as the curved edge 302*a* in a plan sectional view.

The upper wall 303*d* has a width dimension in a horizontal direction that is the same at any position from one end to the other end in the extending direction of the curved reinforcing part 303. Then, the upper wall 303*d* is parallel to the top plate part 302 in a longitudinal sectional view and has a concave curved shape that is curved in the same direction as the curved edge 302*a* in a plan view.

Then, an open cross-sectional shape is formed by three wall parts including a part of the top plate part 302, the outer wall 303*c*, and the upper wall 303*d*. That is, in the present embodiment, a concave curved space is formed in the curved reinforcing part 303, and the space communicates with the outside in a total of three surfaces including two surfaces at one end and the other end in the extending direction of the curved reinforcing part 303 and one surface between an edge of the upper wall 303*d* close to the rear edge 302*d* and the upper surface 302*e*.

According to the structural member 301 having the configuration described above, out-of-plane deformation of the top plate part 302 can be prevented by rigidity of the curved reinforcing part 303 having an open cross-sectional shape. Also, high rigidity can be exhibited against a compressive load or a tensile load in the extending direction of the curved edge 302*a*.

Figure 34:
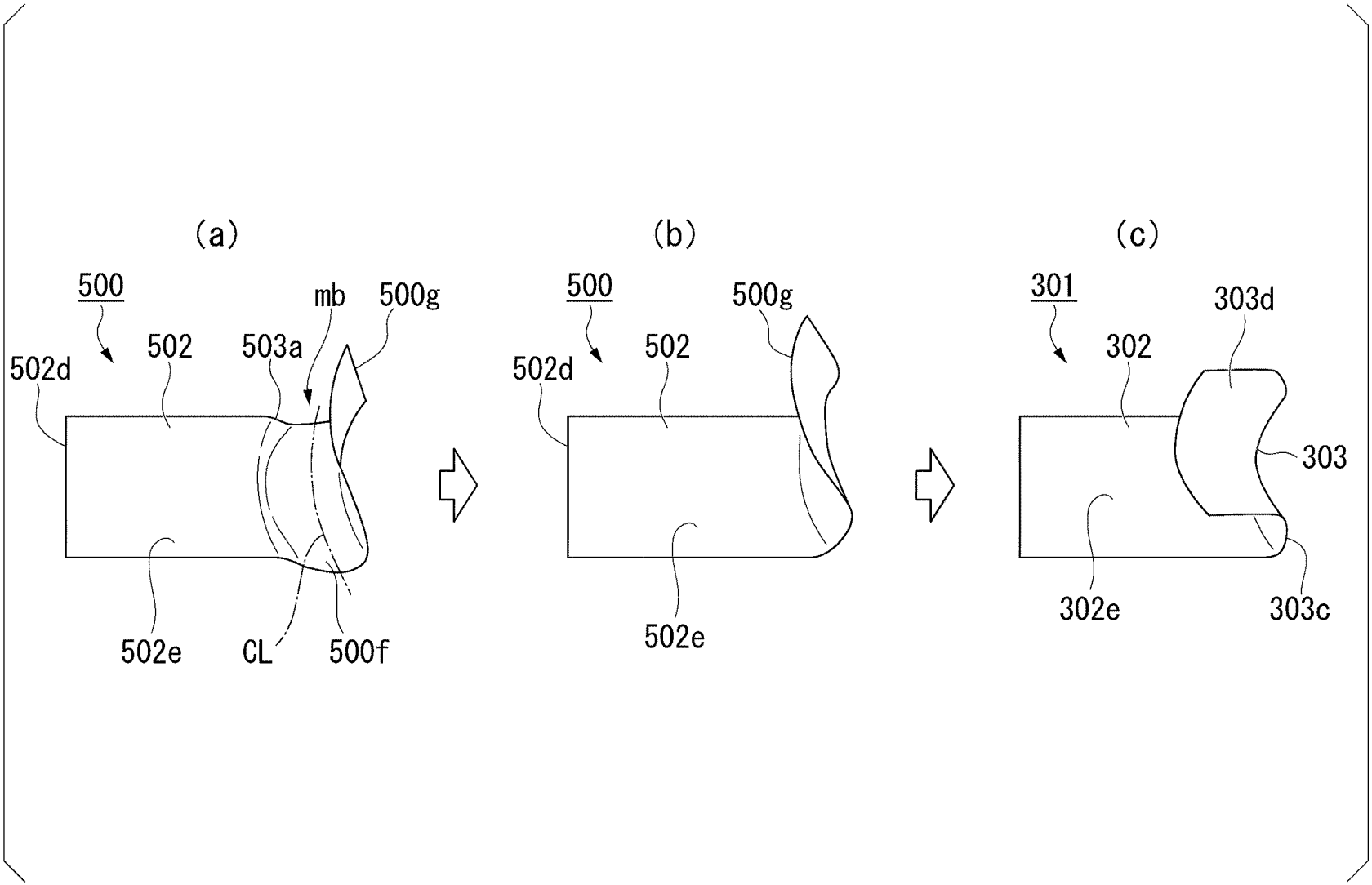
FIG. 34 is a schematic view for explaining the manufacturing method of a structural member according to the third embodiment and is a perspective view in which changes in shape of a blank are arranged in a time series in order from (a) to (c).

FIG. 34 is a schematic view for explaining a manufacturing method of a structural member according to the present embodiment and is a perspective view in which changes in shape from a blank 500 to the structural member 301 are arranged in a time series in order from (a) to (c). In each figure, illustration of dies is omitted to clearly specify the forming process. The dies and how to use them will be described later with reference to other drawings.

FIG. 34(*a*) shows the blank 500 at the time corresponding to FIG. 14 shown in the first embodiment described above. Further, the blank 500 of the present embodiment has a shape that is described with reference to FIG. 38(*a*), and description will be made by changing the product number to 500 because a shape thereof is different from that of the blank 100.

In the present embodiment, as a first step, first, the blank 500 is placed on a top plate support surface of a die, and then a holder is lowered to sandwich the blank 500 between the holder and the die.

Next, when a punch is lowered, the blank 500 is sandwiched between a lower die and the punch to be plastically deformed.

Thereafter, the punch is raised, and then the holder is raised. Then, the blank 500 after the first step is taken out from a top of the die, and thereby a state shown in FIG. 34(*a*) is obtained.

The blank 500 after the first step includes a groove part mb defined by an inner wall 503*a* and a vertical wall part 500*g*, and a band-shaped arcuate wall part 500*f* connecting lower end edges of them. The inner wall 503*a*, the vertical wall part 500*g*, and the band-shaped arcuate wall part 500*f* each have a concave curved shape that is curved in the same direction in a plan view.

The inner wall 503*a* and the vertical wall part 500*g* have a difference in height dimension of the lower end edges thereof between a central position and both end positions in an extending direction thereof. That is, the inner wall 503*a* and the vertical wall part 500*g* have the lower end edges formed in a curved line shape that is convex vertically upward in a side view.

In a plan view, a radius of curvature of the vertical wall part 500*g* is larger than a radius of curvature of the inner wall 503*a*. Due to the difference in radius of curvature, the difference in height dimension in the extending direction of the inner wall 503*a* and the vertical wall part 500*g* is absorbed.

The band-shaped arcuate wall part 500*f* has a curved shape that is curved in the same direction as the inner wall 503*a* in a plan view. Further, the band-shaped arcuate wall part 500*f* has a height difference between a central position and an end portion position in an extending direction thereof in a longitudinal sectional view. That is, the band-shaped arcuate wall part 500*f* has a convex curved shape that is curved so that both of the end positions are at a lower position relative to the central position in the extending direction thereof. Thereby, stretch flange deformation at an upper end edge of the vertical wall part 500*g* can be given before the second step. That is, the vertical wall part 500*g* is bent and deformed in an in-plane direction so that the upper end edge has a width larger than that of the lower end edge of the vertical wall part 500*g*. As a result, the vertical wall part 500*g* can be brought closer to a top plate part 502 in advance.

As described above, a height difference is provided in the band-shaped arcuate wall part (bottom wall) 500*f* of the groove part mb between the central position (intermediate position) and both of the end positions (positions on both sides) sandwiching the central position therebetween in a longitudinal sectional view in an extending direction of the groove part mb by the pressing in the first step (intermediate step). Thereby, a curved part (first curved part) having a concave curved shape in a plan view and a convex curved shape in a longitudinal sectional view is formed in the band-shaped arcuate wall part 500*f*. Further, in the present embodiment, the band-shaped arcuate wall part 500*f* is all formed as a curved part, but the present invention is not limited only to this form, and only a part of the band-shaped arcuate wall part 500*f* may be formed as a curved part.

In the following second step, the top plate part 502 is sandwiched and held between the die and the holder from above and below. Then, the die and holder are brought closer to the punch. Then, an outer surface of the band-shaped arcuate wall part 500*f* hits the punch that is fixed at a fixed position, and thereby the vertical wall part 500*g* is bent to come closer to the rear edge 502*d*. As a result, the height difference is eliminated, the upper edge of the vertical wall part 500*g* is brought closer to the rear edge 502*d*, and the state shown in FIG. 34(*b*) is obtained.

In the following third step, when the upper end edge of the vertical wall part 500*g* is pushed down using the pad, the structural member 301 including the curved reinforcing part 303 having an open cross-sectional shape is formed as shown in FIG. 34(*c*). The curved reinforcing part 303 includes the outer wall 303*c* continuous with the top plate part 302 and directed vertically upward, and the upper wall 303*d* continuous with the outer wall 303*c* and parallel to the upper surface 302*e* of the top plate part 302. Then, the outer wall 303*c* and the upper wall 303*d* have a concave curved shape in a plan view.

When folding-back processing according to the first to third steps as described above is performed, the structural member 301 including the curved reinforcing part 303 having a U-shaped open cross-sectional shape can be formed. In the folding-back processing, the vertical wall part 500*g* is bent to a state in which the upper end edge of the vertical wall part 500*g* is spaced apart from the top plate part 502 while the upper end edge of the vertical wall part 500*g* overlaps the top plate part 502 when viewed from a direction facing the top plate part 502, and thereby the curved reinforcing part 303 having a U-shaped open cross-sectional shape is formed.

Further, when the vertical wall part 500*g* is bent by the folding-back processing, the movement of the upper end edge past a predetermined position may be restricted. Also, an upper end edge bending step of forming a bent part (not shown) at which the upper end edge is directed toward the top plate part 502 during the third step may be further provided before the third step.

The first to third steps described above will be described below including correspondence relationship with dies. Specifically, the first step will be described with reference to FIG. 35, the second step will be described with reference to FIG. 36, and the third step will be described with reference to FIG. 37.

[Third Embodiment/First Step]

Figure 35:
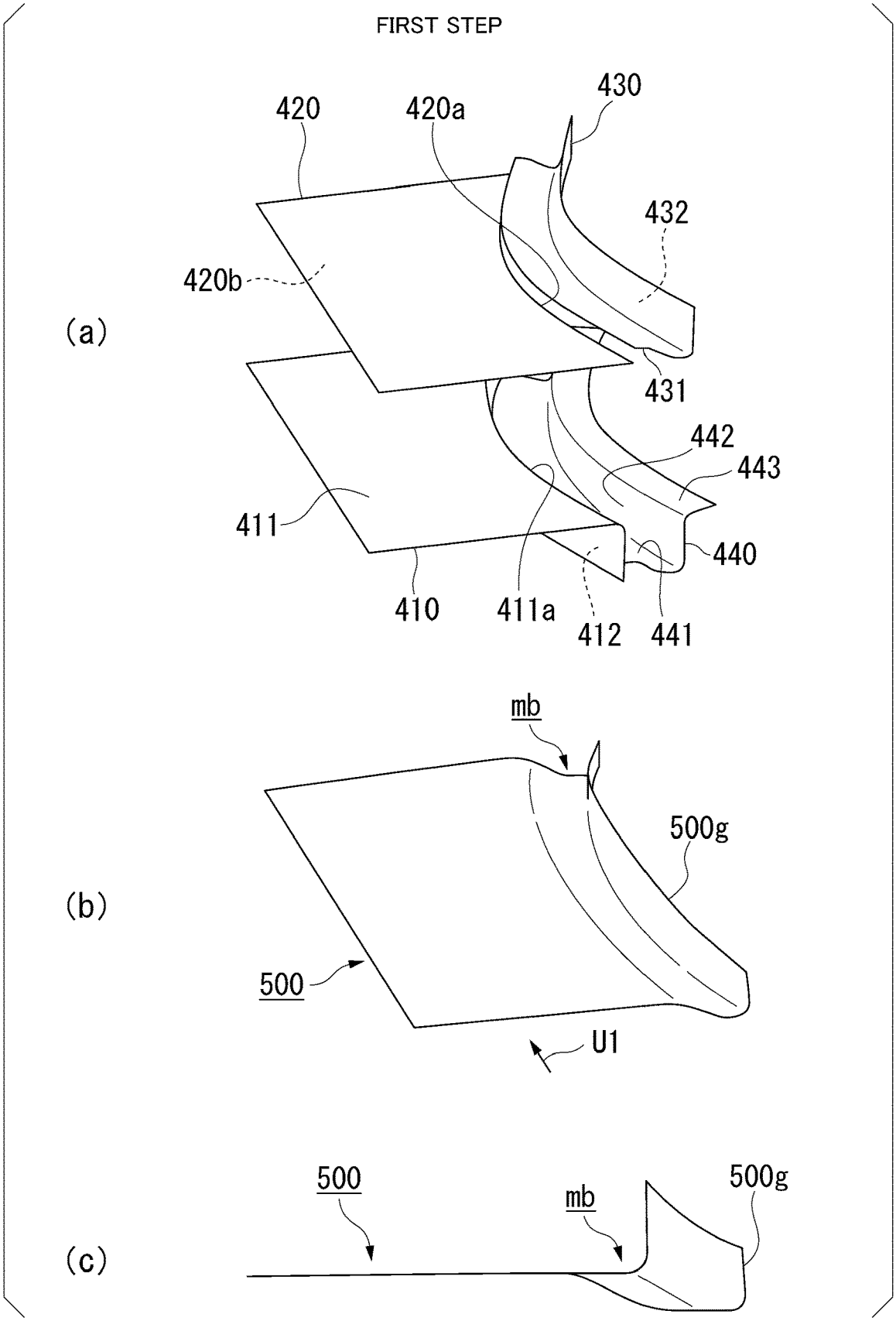
FIG. 35 is a view showing a first step of the manufacturing method of a structural member according to the third embodiment, in which FIG. 35(*a*) is a perspective view of dies used in the first step, FIG. 35(*b*) is a perspective view of a blank, and FIG. 35(*c*) is a side view of the blank from the arrow U1 of FIG. 35(*b*).

First, FIG. 35(*a*) is a perspective view of dies used in a first step of the present embodiment. As shown in FIG. 35(*a*), the manufacturing device of a structural member of the present embodiment includes a die 410 on which the blank 500 is placed, a holder 420 that presses down a portion of the blank 500 that will become the top plate part 302 from above, a punch 430 and a lower die 440 that form a recessed groove on a portion of the blank 500 that will become the curved reinforcing part 303, and a drive unit (not shown) that drives the die 410, the holder 420, and the punch 430 independently of each other. Further, the lower die 440 is fixed at a fixed position.

The die 410 includes a top plate support surface 411 that supports a portion of the blank 500 that will become the top plate part 502, and a vertical wall surface 412 that is continuous with the top plate support surface 411. The top plate support surface 411 is a horizontal plane having an edge 411*a* that is curved in the same direction as the curved edge 302*a* with the same radius of curvature. The vertical wall surface 412 is a wall surface continuous with the top plate support surface 411 at the edge 411*a* and extending vertically downward. The vertical wall surface 412 is a concave curved surface that is curved in the same direction as the edge 411*a* with the same radius of curvature in a plan view.

The lower die 440 includes a bottom wall surface 441, a vertical wall surface 442, and an upper wall surface 443.

The bottom wall surface 441 has a convex curved shape that is curved in the same direction as the edge 411*a* in a plan view. Further, the bottom wall surface 441 has a height difference in a longitudinal sectional view between a central position and an end portion position in an extending direction thereof. That is, the bottom wall surface 441 has a convex curved shape that is curved so that both of the end positions are at a lower position relative to the central position in the extending direction thereof. Further, the bottom wall surface 441 is slightly different in shape compared to the die groove bottom surface 112*b* described with reference to FIG. 13 in the first embodiment described above. Specifically, in a case of the die groove bottom surface 112*b* described above, the height has been substantially constant in a groove width direction, whereas the bottom wall surface 441 of the present embodiment has a depth that increases in a direction away from the die 410 in a groove width direction thereof.

The vertical wall surface 442 is a wall surface continuous with the bottom wall surface 441 and extending vertically upward. The vertical wall surface 442 is a convex curved surface that is curved in the same direction as the edge 411*a* in a plan view. The upper wall surface 443 is a flat surface continuous with an upper end edge of the vertical wall surface 442 and extending in a horizontal direction.

The holder 420 includes a concave curved edge 420*a* having the same radius of curvature in the same direction as the edge 411*a*, and a flat lower surface 420*b* that presses down an upper surface 502*e* of the blank 500.

The punch 430 includes a pressurizing surface 431 formed on a bottom part thereof, and a vertical wall surface 432 formed on a lateral part thereof.

The pressurizing surface 431 has substantially the same shape as the bottom wall surface 441. That is, the pressurizing surface 431 has a convex curved shape that is curved in the same direction as the edge 411*a* in a bottom view. Further, the pressurizing surface 431 has a height difference in a longitudinal sectional view between a central position and an end portion position in an extending direction thereof. That is, the pressurizing surface 431 has a concave curved shape that is curved so that the central position is at a lower position relative to both of the end positions in the extending direction thereof. Further, the pressurizing surface 431 is slightly different in shape compared to the punch lower end surface 130*a*3 described with reference to FIG. 12 in the first embodiment described above. Specifically, in a case of the punch lower end surface 130*a*3, the height has been substantially constant in a width direction thereof, whereas the pressurizing surface 431 of the present embodiment has a height that decreases in a direction away from the holder 420 in a width direction thereof.

The vertical wall surface 432 is a wall surface continuous with the pressurizing surface 431 and extending vertically upward. The vertical wall surface 432 is a concave curved surface that is curved in the same direction as the edge 411*a* in a plan view.

The above-described bottom wall surface (bottom surface of a fourth die groove) 441 has a height difference between a central position (intermediate position) and both end positions (positions on both sides) sandwiching the central position therebetween in a longitudinal sectional view in an extending direction of the bottom wall surface 441. Then, the pressurizing surface 431 of the punch 430 (fourth punch) has a height difference corresponding to the bottom wall surface 441. The bottom wall surface 441 forms a curved surface (third die curved surface) having a concave curved shape in a plan view and a convex curved shape in a longitudinal sectional view. Further, in the present embodiment, the bottom wall surface 441 is all formed as a curved surface, but the present invention is not limited only to this form, and only a part of the bottom wall surface 441 may be formed as a curved surface.

The drive unit includes a drive mechanism that brings the holder 420 closer to and further away from the die 410, a drive mechanism that raises and lowers the die 410, and a drive mechanism that raises and lowers the punch 430 with respect to the lower die 440.

Figure 38:
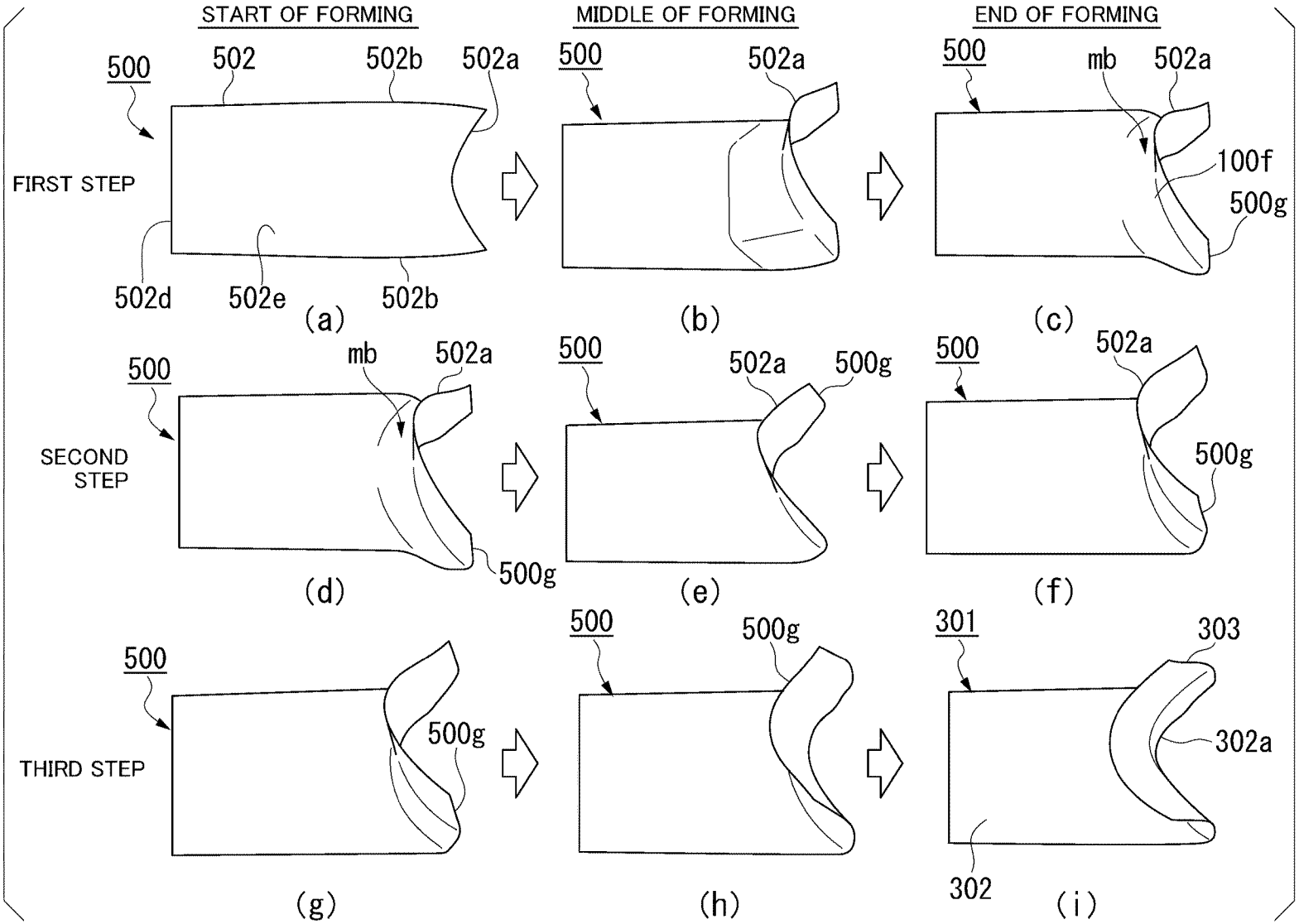
FIG. 38 is a perspective view in which changes in shape of the blank in the manufacturing method of a structural member according to the third embodiment are arranged in a time series in order from (a) to (i).

The blank 500 before processing has a shape shown in FIG. 38(*a*). That is, the blank 500 has a front edge 502*a* having a concave shape in a plan view, a pair of lateral edges 502*b* that are continuous with the front edge 502*a*, and a rear edge 502*d* continuous with the pair of lateral edges 502*b* and facing the front edge 502*a*. The pair of lateral edges 502*b* have portions that are parallel to each other and portions in which a distance therebetween decreases toward the front edge 502*a*. As a plate thickness of the blank 500, 0.8 mm to 6.0 mm is exemplified, but the present invention is not limited to the thickness range. As a material of the blank 500, a metal material such as steel, an aluminum alloy, or a magnesium alloy, or a resin material such as glass fibers or carbon fibers can be used. Further, a composite material of a metal material and a resin material may be used as a material of the blank 500.

In order for the manufacturing device of a structural member having the above-described configuration to perform the first step, first, the blank 500 is placed on the top plate support surface 411 of the die 410, and then the holder 420 is lowered by the drive mechanism to sandwich the blank 500 between the holder 420 and the die 410. At that time, the front edge 502*a* of the blank 500 is disposed to protrude past the edge 411*a* of the die 410 and then fixed.

Next, the drive mechanism lowers the punch 430 toward the lower die 440. Also, the die 410 is lowered with the blank 500 sandwiched between the die 410 and the holder 420. Then, when the punch 430 reaches a bottom dead center, a peripheral portion of the blank 500 including the front edge 502*a* is bent vertically upward. That is, the blank 500 reaches the end of forming shown in FIG. 38(*c*) from the start of forming shown in FIG. 38(*a*) through the middle of forming in FIG. 38(*b*). As shown in FIGS. 35(*b*) and 35(*c*), the vertical wall part 500*g* having a concave shape in a plan view with the front edge 502*a* as the upper end edge, and the groove part mb positioned at a base portion of the vertical wall part 500*g*, having a concave shape in a plan view, and having a height difference in a width direction of the blank 500 are formed in the blank 500 at the end of forming in the first step. The band-shaped arcuate wall part 100*f* (bottom wall) of the groove part mb has a height difference between a central position and an end portion position in a longitudinal sectional view in the extending direction of the groove part mb. That is, a height difference in which the central position is higher than the end portion position is formed. Due to the first step, the upper end edge of the vertical wall part 500*g* is subjected to stretch flange deformation.

Thereafter, the punch 430 is raised and then the holder 420 is raised by the drive mechanism. Then, the blank 500 is taken out from a top of the die 410. As described above, the first step is completed.

[Third Embodiment/Second Step]

A second step following the first step will be described with reference to FIG. 36 and FIGS. 38(*d*) to 38(*f*).

Figure 36:
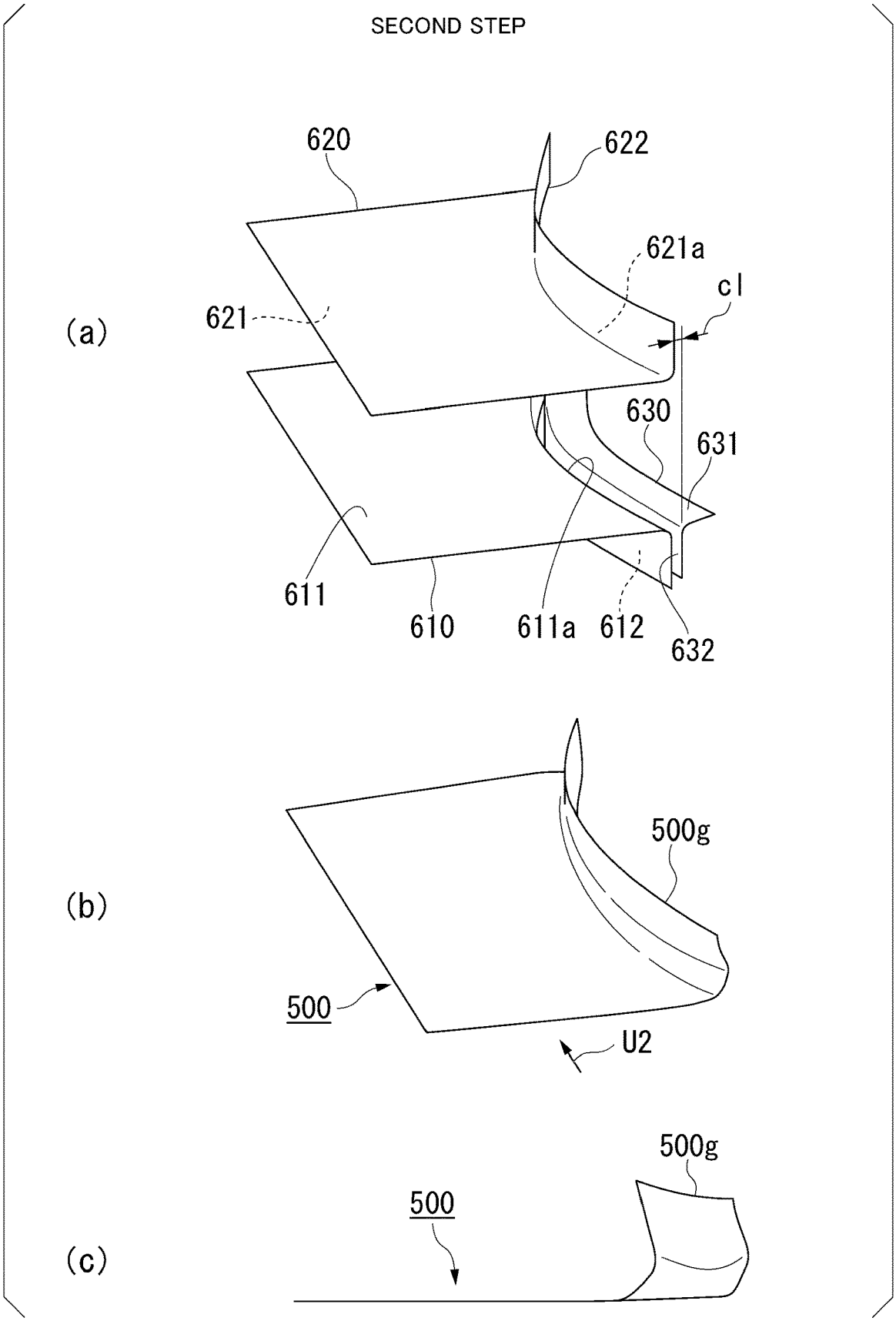
FIG. 36 is a view showing a second step of the manufacturing method of a structural member according to the third embodiment, in which FIG. 36(*a*) is a perspective view of dies used in the second step, FIG. 36(*b*) is a perspective view of a blank, and FIG. 36(*c*) is a side view of the blank from the arrow U2 of FIG. 36(*b*).

First, FIG. 36(*a*) is a perspective view of dies used in the second step of the present embodiment. As shown in FIG. 36(*a*), the manufacturing device of a structural member according to the present embodiment includes a die 610 on which the blank 500 after the first step is placed, a holder 620 that moves closer to and further away from the die 610, a punch 630 fixedly disposed on a lateral side of the die 610, and a drive unit (not shown) that drives the die 610 and the holder 620 independently of each other.

The die 610 includes a top plate support surface 611 that supports the blank 500 including an outer surface of a portion corresponding to the groove part mb thereof, and a vertical wall surface 612 that is continuous with the top plate support surface 611. The top plate support surface 611 is a horizontal plane having an edge 611*a* curved in the same direction as the edge 411*a* of the die 410. The vertical wall surface 612 is a wall surface continuous with the top plate support surface 611 at the edge 611*a* and extending vertically downward. The vertical wall surface 612 is a concave curved surface that is curved in the same direction as the edge 611*a* with the same radius of curvature in a plan view.

The punch 630 includes an upper wall surface 631 and a vertical wall surface 632.

The upper wall surface 631 is a flat surface having a convex curved shape curved in the same direction as the edge 611*a* in a plan view.

The vertical wall surface 632 is a wall surface continuous with the upper wall surface 631 and extending vertically downward. The vertical wall surface 632 is a convex curved surface that is curved in the same direction as the edge 611*a* with the same radius of curvature in a plan view.

The holder 620 includes a bottom wall surface 621 and a vertical wall surface 622.

The bottom wall surface 621 is a flat surface including a concave curved edge 621*a* having the same radius of curvature in the same direction as the edge 611*a* in a bottom view and configured to press down the upper surface 502*e* of the blank 500.

The vertical wall surface 622 is continuous with the bottom wall surface 621 at the edge 621*a* and extends vertically upward. The vertical wall surface 622 is a concave curved surface that is curved in the same direction as the edge 621*a* with the same radius of curvature in a plan view.

In order to perform the second step by the manufacturing device of a structural member having the above-described configuration, first, the blank 500 is placed on the top plate support surface 611 of the die 610, and then the holder 620 is lowered by the drive mechanism to sandwich the blank 500 between the holder 620 and the die 610. Thereby, the height difference at the groove part mb formed in the first step is gradually reduced, and in accordance with this deformation, the upper end edge of the vertical wall part 500*g* of the blank 500 comes closer to the rear edge 502*d*. When the holder 620 is pushed down together with the die 610 with the blank 500 sandwiched therebetween, the outer surface of the portion of the blank 500 corresponding to the groove part mb hits the upper wall surface 631 of the punch 630. As a result, the blank 500 is subjected to a reaction force of a force applied to the upper wall surface 631 and is bent so that the upper end edge of the vertical wall part 500*g* comes further closer to the rear edge 502*d*.

That is, the blank 500 reaches the end of forming shown in FIG. 38(*f*) from the start of forming of the second step shown in FIG. 38(*d*) through the middle of forming in FIG. 38(*e*). As shown in FIGS. 36(*b*) and 36(*c*), the groove part mb is eliminated and the height difference is disappeared in the blank 500 at the end of forming. Therefore, a lower surface of the blank 500 is flat. Also, since the lower end portion of the vertical wall part 500*g* is subjected to the reaction force from the punch 630 in addition to the reduction in the height difference, the vertical wall part 500*g* can be inclined in advance to be reliably collapsed in the next third step.

Thereafter, the holder 620 is raised by the drive mechanism. Then, the blank 500 is taken out from a top of the die 610. As described above, the second step is completed.

Further, as shown in FIG. 36, the vertical wall surface 632 (fourth vertical wall surface) of the punch 630 is preferably disposed to face the vertical wall surface 622 (third vertical wall surface) of the holder 620 at a distance cl of 5 mm or more and 50 mm or less in a horizontal direction. In this case, the upper end edge of the vertical wall part 500*g* can be more reliably inclined to come closer to the top plate part 502 in the manner of leaning forward while leaving the bent portion formed in the first step at the intermediate position in the height direction of the vertical wall part 500*g*. The reason is the same as the reason described with reference to FIG. 6(*b*) in the first embodiment described above, and description thereof will be omitted here.

[Third Embodiment/Third Step]

A third step following the second step will be described with reference to FIG. 37 and FIGS. 38(*g*) to 38(*i*).

Figure 37:
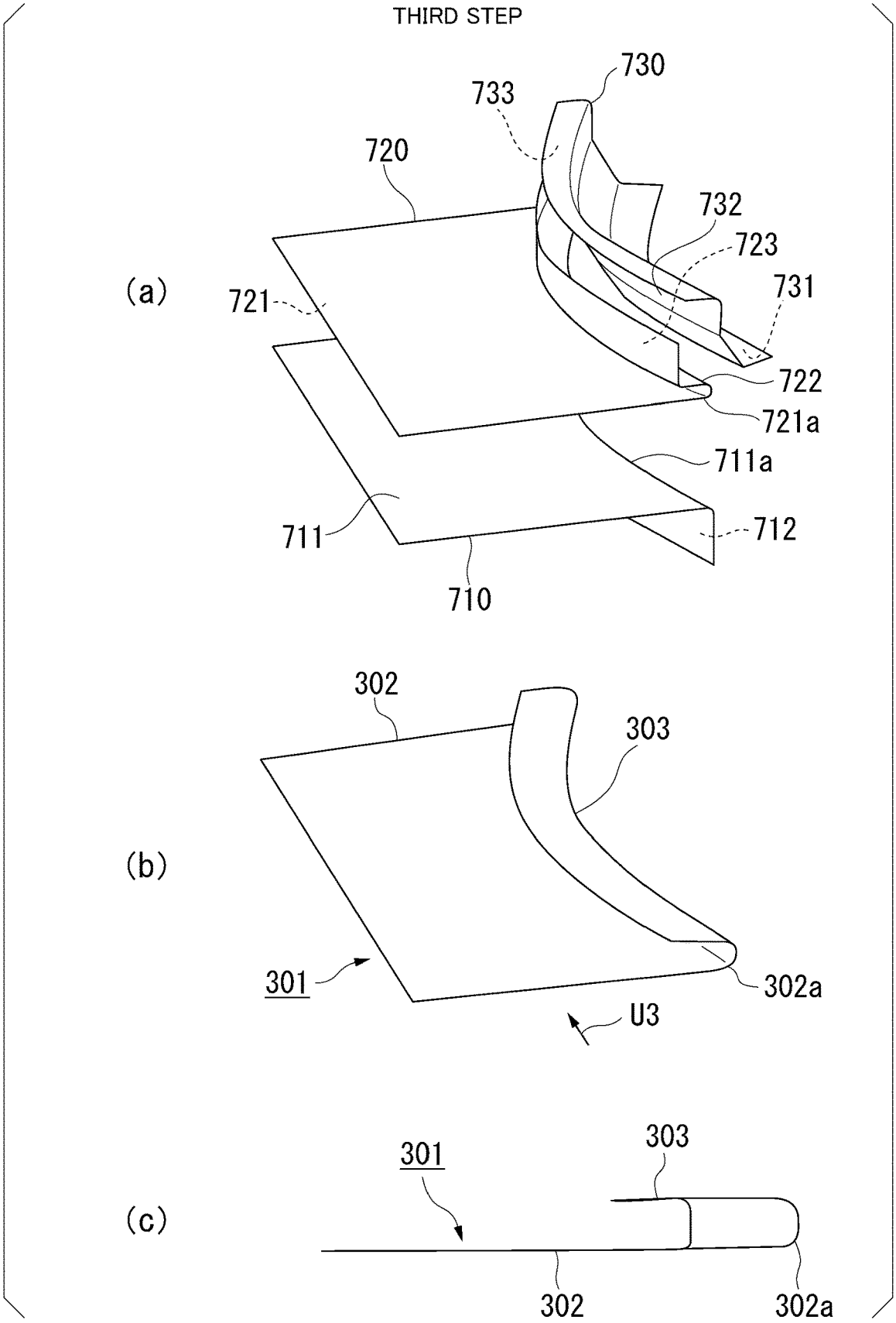
FIG. 37 is a view showing a third step of the manufacturing method of a structural member according to the third embodiment, in which FIG. 37(*a*) is a perspective view of dies used in the third step, FIG. 37(*b*) is a perspective view of a blank, and FIG. 37(*c*) is a side view of the blank from the arrow U3 of FIG. 37(*b*).

First, FIG. 37(*a*) is a perspective view of dies used in the third step of the present embodiment. As shown in FIG. 37(*a*), the manufacturing device of a structural member according to the present embodiment includes a die 710 on which the blank 500 after the second step is placed, a holder 720 that moves closer to and further away from the die 710, a pad 730 that moves closer to and further away from the die 710, and a drive unit (not shown) that drives the holder 720 and the pad 730 independently of each other.

The die 710 includes a top plate support surface 711 that supports the blank 500, and a vertical wall surface 712 that is continuous with the top plate support surface 711. The top plate support surface 711 is a horizontal plane having an edge 711*a* curved in the same direction as the edge 611*a* of the die 610 with the same radius of curvature. The vertical wall surface 712 is a wall surface continuous with the top plate support surface 711 at the edge 711*a* and extending vertically downward. The vertical wall surface 712 is a concave curved surface that is curved in the same direction as the edge 711*a* with the same radius of curvature in a plan view.

The holder 720 includes a bottom wall surface 721, a folded-back surface 722, and a vertical wall surface 723.

The bottom wall surface 721 is a flat surface including a concave curved edge 721*a* having the same radius of curvature in the same direction as the edge 711*a* in a bottom view and configured to press down the upper surface 502*e* of the blank 500.

The folded-back surface 722 is a bent surface continuous with the bottom wall surface 721 at the edge 721*a* and folded back from the edge 721*a* in a direction that overlaps the bottom wall surface 721 in a plan view. The folded-back surface 722 has a curved shape having the same radius of curvature in the same direction as the edge 721*a* in a plan view. The folded-back surface 722 is a concave curved surface that is curved in the same direction as the edge 621*a* with the same radius of curvature in a plan view.

The vertical wall surface 723 is continuous with the bottom wall surface 721 via the folded-back surface 722 and extends vertically upward. The vertical wall surface 723 is a concave curved surface that is curved in the same direction as the edge 721*a* in a plan view.

The pad 730 has a first lower surface 731, an inclined surface 732, and a second lower surface 733.

The first lower surface 731 is a flat surface having a curved shape that is convex toward the holder 720 in a bottom view.

The inclined surface 732 is continuous with the first lower surface 731 and is formed obliquely upward. The inclined surface 732 is a curved surface having a curved shape that is convex toward the holder 720 in a bottom view.

The second lower surface 733 is a flat surface continuous with the inclined surface 732 and having a curved shape that is convex toward the holder 720 in a bottom view.

In order to perform the third step by the manufacturing device of a structural member having the above-described configuration, first, the blank 500 after the second step is placed on the top plate support surface 711 of the die 710, and then the holder 720 is lowered by the drive mechanism to sandwich the blank 500 between the holder 720 and the die 710. Next, the pad 730 is lowered by the drive mechanism. Then, the second lower surface 733 of the pad 730 comes into contact with an upper edge of the vertical wall part 500*g* and then bends the vertical wall part 500*g* while bring it down. At the time of the bending, the vertical wall part 500*g* has been inclined in advance in the first step and the second step, and in addition, stretch flange deformation has been applied to the upper edge of the vertical wall part 500*g* in advance, the vertical wall part 500*g* can be bent with a margin. As a result of the bending, the structural member 301 can be obtained.

Here, a gap at a bottom dead center of forming with respect to the top plate support surface 711 (fourth top plate support surface) of the die 710 is larger on the pressurizing surface (second lower surface 733) of the pad 730 than on the pressurizing surface (bottom wall surface 721) of the holder 720. More specifically, when the holder 720 reaches the bottom dead center, a gap between the pressurizing surface of the holder 720 and the top plate support surface 711 of the die 710 is defined as g5. Further, when the pad 730 reaches the bottom dead center, a gap between the pressurizing surface of the pad 730 and the top plate support surface 711 of the die 710 is defined as g6. In this case, the gap g5 is substantially equal to a plate thickness of the top plate part 502, and the gap g6 is substantially equal to a thickness dimension of the curved reinforcing part 303. That is, gap g6>gap g5 is established. Therefore, in the holder 720, the top plate part 502 can be firmly sandwiched between the holder 720 and the die 710, and in the pad 730, the curved reinforcing part 303 having an open cross-sectional shape can be obtained between the pad 730 and the die 710.

Thereafter, the pad 730 is first raised by the drive mechanism. Then, the holder 720 is slightly raised by the drive mechanism to be spaced apart from the top plate support surface 711 of the die 710. Thereby, the structural member 301 is released from being fixed. In that state, the structural member 301 can be removed by pulling out the structural member 301 horizontally from between the holder 720 and the die 710. As described above, the third step is completed.

The blank 500 of the present embodiment becomes the structural member 301 when the blank 500 reaches the end of forming shown in FIG. 38(*i*) from the start of forming of the third step shown in FIG. 38(*g*) through the middle of forming in FIG. 38(*h*). As shown in FIGS. 37(*b*) and 37(*c*), the structural member 301 at the end of forming includes the top plate part 302 having the concave curved edge 302*a* in a bottom view, and the curved reinforcing part 303 that is formed integrally with the top plate part 302 in the extending direction of the curved edge 302*a* and in which a cross section perpendicular to the above-described extending direction has an open cross-sectional shape.

An outline of the present embodiment described above is summarized below.

The manufacturing method of a structural member of the present embodiment is a method of manufacturing the structural member 301 including the top plate part 302 having the curved edge 302*a*, and the curved reinforcing part 303 that is formed integrally with the top plate part 302 in the extending direction of the curved edge 302*a* and in which a cross section perpendicular to the extending direction of the curved edge 302*a* has an open cross-sectional shape from the blank 500 (flat plate material). Specifically, the manufacturing method includes the first step (intermediate step) of forming the groove part mb and the vertical wall part 500*g* that is continuous with the groove part mb along a portion of the blank 500 that will become the curved edge 302*a* in a state in which a portion (first portion) of the blank 500 corresponding to the top plate part 302 is sandwiched by pressing the other portion (second portion) that is continuous with the above-described portion in a direction intersecting the upper surface 502*e* of the blank 500.

Due to the pressing in the first step, a height difference is provided on the band-shaped arcuate wall part 500*f* (bottom wall) of the groove part nib between the central position and the end portion position in a longitudinal sectional view in the extending direction of the groove part nb. The band-shaped arcuate wall part 500*f* has a concave curved shape in a plan view and a convex curved shape in a longitudinal sectional view.

Further, the portion corresponding to the top plate part 2 is not completely fixed but is in a sandwiched state at the time of the press forming in the first step. Therefore, movement and deformation of the sandwiched portion out of the plane is restricted, but a metal flow in which some of the sandwiched portion is directed toward another portion is allowed.

In addition, the manufacturing method of a structural member in the present embodiment may be configured as follows.

That is, when viewed along a cross-sectional line length of the groove part mb along an inner shape of a cross section perpendicular to the extending direction of the groove part mb, a ratio obtained by dividing the cross-sectional line length at the central position by the cross-sectional line length at the end portion position may be set within a range of 0.7 to 1.3 by the pressing in the first step. Further, the cross-sectional line lengths at the central position and the end portion position may be the same as each other. Further, the cross-sectional line length at any position in the extending direction of the groove part mb may be all equal.

When the ratio of the cross-sectional line lengths is less than 0.7 or more than 1.3, a difference in the cross-sectional line length between the central position and the end portion position becomes too large. In this case, when the curved reinforcing part 303 having substantially the same cross-sectional area at any position in the extending direction of the groove part ma is formed, the difference in the cross-sectional line length may cause forming defects such as cracks or wrinkles at an end edge of the upper wall 303*d*. Therefore, the ratio of the cross-sectional line lengths is preferably in the range of 0.7 to 1.3.

Also, an R/R1 ratio obtained by dividing the radius of curvature R (mm) of a center line CL passing through a central position in a width direction of the band-shaped arcuate wall part 500*f* in a plan view by the radius of curvature R1 (mm) of the band-shaped arcuate wall part 500*f* in a longitudinal sectional view may be set within a range of 0.2 to 1.2 in the groove part nb by the pressing in the first step. In this case, a suitable forming result without constriction or dimensional errors can be obtained even when a high-strength steel sheet of 780 MPa class is used as the blank 500. Further, when a high-strength steel sheet of 980 MPa class or higher is used, the R/R1 ratio is more preferably within a range of 0.3 to 0.9, and in this case, a suitable forming result without constriction or dimensional errors can be obtained even if a high-strength steel sheet of 980 MPa class is used. Further, it is most preferable to set the R/R1 ratio to 0.5, and in this case, a suitable forming result without constriction or dimensional errors can be obtained even when a high-strength steel sheet of 1180 MPa class is used.

On the other hand, when this is viewed from another perspective, it is preferable that the radius of curvature R1 of the band-shaped arcuate wall part 500*f* in a longitudinal sectional view be made larger than the radius of curvature R of the center line CL passing through the central position in a width direction of the band-shaped arcuate wall part 500*f* in a plan view by the pressing in the first step (R1>R). In this case, it is possible to avoid unstable positioning when the structural member is transferred to another die in the next step.

In the manufacturing method of a structural member of the present embodiment, the third step, which is performed after the pressing of the first step and then through the second step, further includes a bending step of bending the upper end edge of the vertical wall part 500*g* toward the top plate part 502 by pushing down the upper end edge toward the groove part mb while movement thereof toward the top plate part 502 is allowed.

The bending step includes a folding-back step. In the folding-back step, the vertical wall part 500*g* is bent to a state in which the upper end edge of the vertical wall part 500*g* is spaced apart from the top plate part 502 in a side view while the upper end edge overlaps the top plate part 502 when viewed from a direction facing the top plate part 502. As a result, the curved reinforcing part 303 having an open cross-sectional shape can be formed.

Further, when the vertical wall part 500*g* is further bent in the folding-back step, the movement of the upper end edge past a predetermined position is restricted. That is, when the upper end edge comes into contact with the vertical wall surface 723 of the holder 720 and is restricted, the curved reinforcing part 303 having an appropriate open cross section can be formed.

Further, an upper end edge bending step of forming a bent part (not shown. a bend corresponding to the bent part Q1 referred to in the first embodiment) at which the upper end edge is directed toward the top plate part 502 during the folding-back step may be performed before the folding-back step.

The structural member 301 may be an automobile body part. More specifically, the present invention may be applied in manufacturing lower arms.

The manufacturing device of a structural member of the present embodiment can be appropriately used in the above-described manufacturing method, and the structural member 301 is manufactured from the blank 500.

Then, the manufacturing device includes the die 410 (third die) having the top plate support surface 411 (second top plate support surface) including the curved edge 411*a* (first die curved edge) in a plan view, the holder 420 (third holder) that moves closer to and further away from the top plate support surface 411, the lower die 440 (fourth die) having the bottom wall surface 441 (fourth die groove) disposed adjacent to the edge 411*a* in a plan view, and the punch 430 (fourth punch) that moves closer to and further away from the bottom wall surface 441.

The bottom wall surface 441 has a height difference between the central position and the end portion position in a longitudinal sectional view in an extending direction thereof. Similarly, the pressurizing surface 431 of the punch 430 also has a height difference corresponding to the bottom wall surface 441. That is, the pressurizing surface 431 has a height difference between the central position and the end portion position in a longitudinal sectional view in an extending direction thereof.

The bottom wall surface 441 has a concave curved shape in a plan view and a convex curved shape in a longitudinal sectional view.

The manufacturing device of a structural member of the present embodiment may employ the following configuration.

That is, when viewed along a cross-sectional line length of the bottom wall surface 441 along an inner shape of a cross section perpendicular to the extending direction thereof, a ratio obtained by dividing the cross-sectional line length at the central position by the cross-sectional line length at the end portion position may be set within a range of 0.7 to 1.3. Further, the cross-sectional line lengths at the central position and the end portion position may be the same as each other. Further, the cross-sectional line length at any position in the extending direction of the groove part ma may be all equal. Thereby, forming defects described above can be more reliably prevented.

An R/R1 ratio of the bottom wall surface 441 obtained by dividing the radius of curvature R (mm) of a center line passing through a central position in a width direction in a plan view by the radius of curvature R1 (mm) in a longitudinal sectional view may be set within a range of 0.2 to 1.2. In this case, a suitable forming result without constriction or dimensional errors can be obtained even when a high-strength steel sheet of 780 MPa class is used as the blank 500. Further, when a high-strength steel sheet of 980 MPa class or higher is used, the R/R1 ratio is more preferably within a range of 0.3 to 0.9, and in this case, a suitable forming result without constriction or dimensional errors can be obtained even if a high-strength steel sheet of 980 MPa class is used. Further, it is most preferable to set the R/R1 ratio to 0.5, and in this case, a suitable forming result without constriction or dimensional errors can be obtained even when a high-strength steel sheet of 1180 MPa class is used.

On the other hand, when this is viewed from another perspective, it is preferable that the radius of curvature R1 of the bottom wall surface 441 in a longitudinal sectional view be made larger than the radius of curvature R of the center line passing through the central position in a width direction of the bottom wall surface 441 in a plan view (R1>R). In this case, it is possible to avoid unstable positioning when the structural member is transferred to another die in the next step.

The manufacturing device of a structural member of the present embodiment uses the following dies in the second step following the first step.

That is, the die 610 (fifth die) having the top plate support surface 611 (third top plate support surface) including the curved edge 611*a* (second die curved edge) in a plan view, the holder 620 (fourth holder) that moves closer to and further away from the top plate support surface 611, and the punch 630 (fifth punch) that is disposed adjacent to the edge 611*a* in a plan view are used.

The manufacturing device of a structural member of the present embodiment uses the following dies in the third step following the second step.

That is, the die 710 (sixth die) having the top plate support surface 711 (fourth top plate support surface) including the curved edge 711*a* (third die curved edge) in a plan view, the holder 720 (fifth holder) that moves closer to and further away from the top plate support surface 711, and the pad 730 (sixth punch) having the second lower surface 733 (pressurizing surface) that overlaps a top of the edge 711*a* in a plan view and configured to move closer to and further away from the die 710 are used.

In the manufacturing device of a structural member of the present embodiment, the holder 720 has the vertical wall surface 723 (third restricting surface) adjacent to the second lower surface 733 of the pad 730 and extending in a direction intersecting the second lower surface 733.

Instead of providing the vertical wall surface 723, the pad 730 may have a vertical wall surface (not shown, a fourth restricting surface) continuous with the second lower surface 733 of the pad 730 and extending in a direction intersecting the second lower surface 733.

Fourth Embodiment

In the third embodiment, the concave curved reinforcing part 303 has been formed in a plan view. In the present embodiment, a case in which the curved reinforcing part 303 having an open cross-sectional shape that is convex in a plan view is formed will be described.

Figure 39:
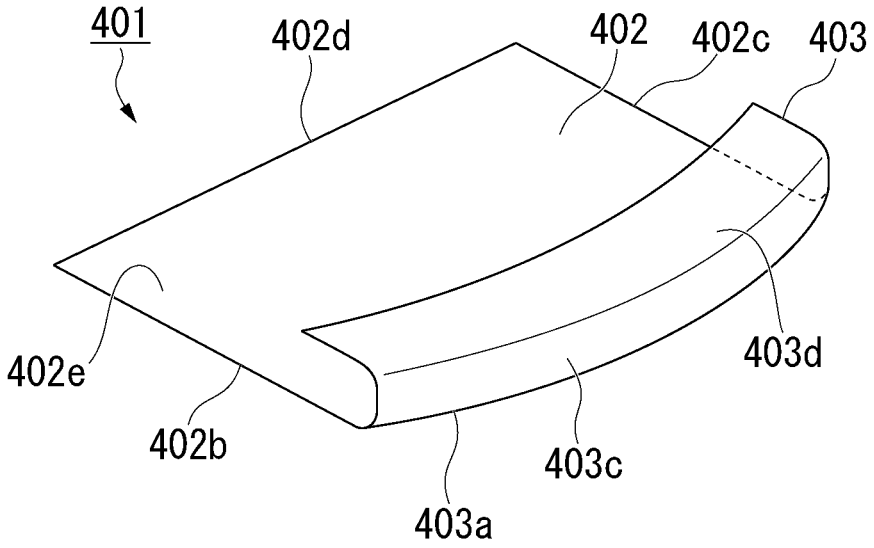
FIG. 39 is a perspective view showing a structural member manufactured by a manufacturing method of a structural member according to a fourth embodiment of the present invention.

A structural member 401 shown in FIG. 39 includes a top plate part 402 having a convex curved edge 402*a* in a bottom view, and a curved reinforcing part 403 that is formed integrally with the top plate part 402 at the curved edge 402*a* and in which a cross section perpendicular to an extending direction of the curved edge 402*a* has an open cross-sectional shape.

The top plate part 402 is a flat plate portion defined by a pair of both lateral edges 402*b* and 402*c* parallel to each other, the curved edge 402*a* continuous between the lateral edges 402*b* and 402*c* and forming a front edge, and a rear edge 402*d* facing the curved edge 402*a* and continuous between the lateral edges 402*b* and 402*c*. The lateral edges 402*b* and 402*c* and the rear edge 402*d* each have a linear shape. On the other hand, the curved edge 402*a* has a convex curved shape whose center is farther from the rear edge 402*d* with respect to both ends thereof. As a radius of curvature R of the convex curved shape in a plan view, 100 mm to 400 mm may be exemplified. However, the radius of curvature R is not limited to this range.

The curved reinforcing part 403 includes an outer wall 403*c* continuous with the curved edge 402*a* of the top plate part 402 and directed vertically upward, and an upper wall

403*d* continuous with the outer wall 403*c* and spaced apart from an upper surface 402*e* of the top plate part 402.

The outer wall 403*c* has a height dimension in a vertical direction that is the same at any position from one end to the other end in an extending direction of the curved reinforcing part 403. Then, the outer wall 403*c* has a convex curved shape that is curved in the same direction as the curved edge 402*a* in a plan sectional view.

The upper wall 403*d* has a width dimension in a horizontal direction that is the same at any position from one end to the other end in the extending direction of the curved reinforcing part 403. Then, the upper wall 403*d* is parallel to the top plate part 402 in a longitudinal sectional view and has a convex curved shape that is curved in the same direction as the curved edge 402*a* in a plan view.

Then, an open cross-sectional shape is formed by three wall parts including a part of the top plate part 402, the outer wall 403*c*, and the upper wall 403*d*. That is, in the present embodiment, a concave curved space is formed in the curved reinforcing part 403, and the space communicates with the outside in a total of three surfaces including two surfaces at one end and the other end in the extending direction of the curved reinforcing part 403 and one surface between an edge of the upper wall 403*d* close to the rear edge 402*d* and the upper surface 402*e*.

According to the structural member 401 having the configuration described above, out-of-plane deformation of the top plate part 402 can be prevented by rigidity of the curved reinforcing part 403 having an open cross-sectional shape. Also, high rigidity can be exhibited against a compressive load or a tensile load in the extending direction of the curved edge 402*a*.

Figure 40:
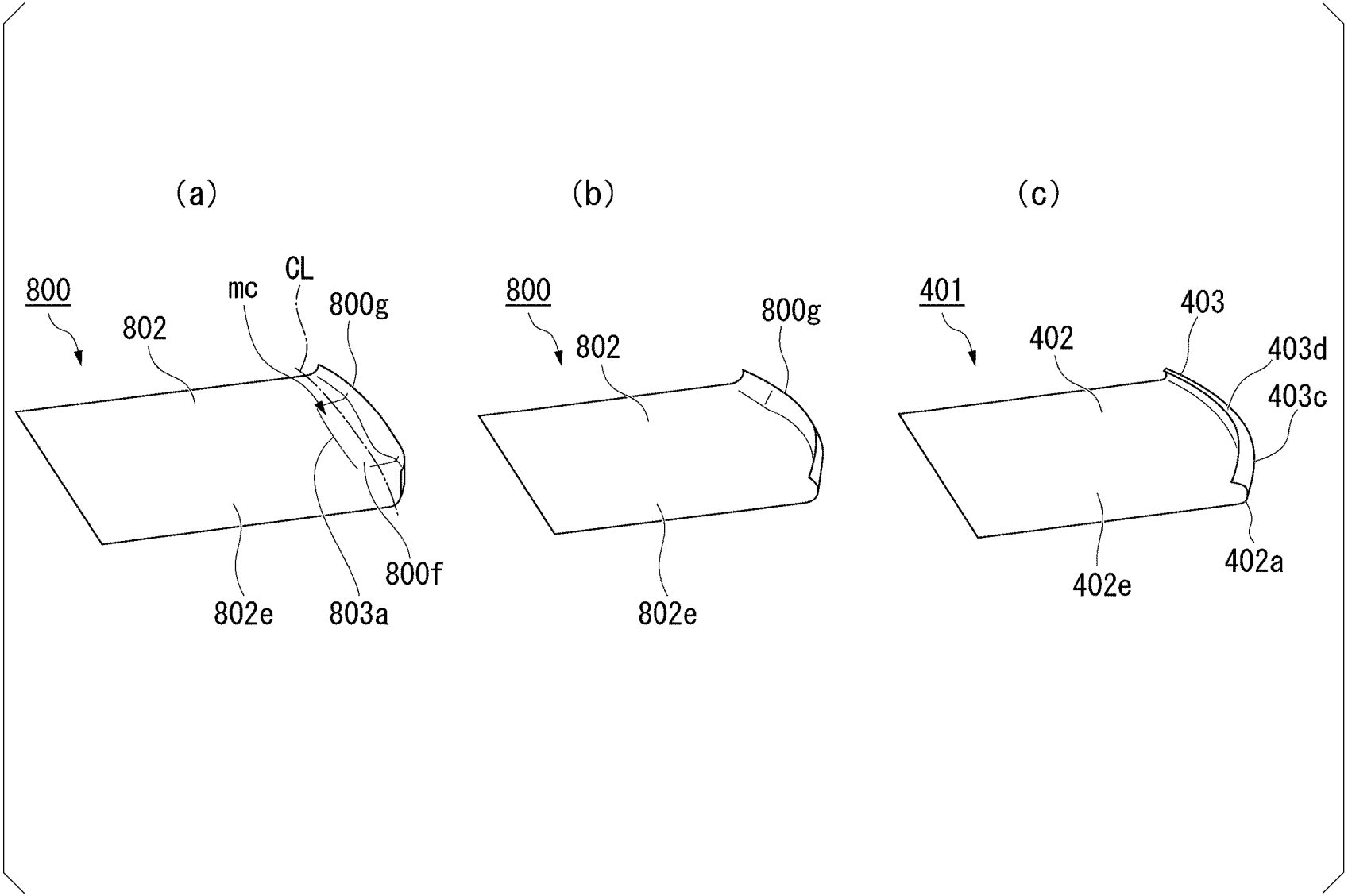
FIG. 40 is a schematic view for explaining the manufacturing method of a structural member according to the fourth embodiment and is a perspective view in which changes in shape of a blank are arranged in a time series in order from (a) to (c).

FIG. 40 is a schematic view for explaining a manufacturing method of a structural member according to the present embodiment and is a perspective view in which changes in shape from a blank 800 to the structural member 401 are arranged in a time series in order from (a) to (c). In each figure, illustration of dies is omitted to clearly specify the forming process. The dies and how to use them will be described later with reference to other drawings.

FIG. 40(*a*) shows the blank 800 at the time corresponding to FIG. 24 shown in the second embodiment described above. Further, the blank 800 of the present embodiment has a shape that is described with reference to FIG. 44(*a*), and description will be made by changing the product number to 800 because a shape thereof is different from that of the blank 100 and the blank 500.

In the present embodiment, as a first step, first, the blank 800 is placed on a top plate support surface of a die, and then a holder is lowered to sandwich the blank 800 between the holder and the die.

Next, when a punch is lowered, the blank 800 is sandwiched between a lower die and the punch to be plastically deformed.

Thereafter, the punch is raised, and then the holder is raised. Then, the blank 800 after the first step is taken out from a top of the die, and thereby a state shown in FIG. 40(*a*) is obtained.

The blank 800 after the first step includes a groove part mc defined by an inner wall 803*a* and a vertical wall part 800*g*, and a band-shaped arcuate wall part 800*f* connecting lower end edges of them. The inner wall 803*a*, the vertical wall part 800*g*, and the band-shaped arcuate wall part 800*f* each have a convex curved shape that is curved in the same direction in a plan view.

The inner wall 803*a* and the vertical wall part 800*g* have a difference in height dimension of the lower end edges thereof between a central position and both end positions in an extending direction thereof. That is, the inner wall 803*a* and the vertical wall part 800*g* have the lower end edges formed in a curved line shape that is convex vertically downward in a side view.

In a plan view, a radius of curvature of the vertical wall part 800*g* is larger than a radius of curvature of the inner wall 803*a*. Due to the difference in radius of curvature, the difference in height dimension in the extending direction of the inner wall 803*a* and the vertical wall part 800*g* is absorbed.

The band-shaped arcuate wall part 800*f* has a curved shape that is curved in the same direction as the inner wall 803*a* in a plan view. Further, the band-shaped arcuate wall part 800*f* has a height difference between a central position and an end portion position in an extending direction thereof in a longitudinal sectional view. That is, the band-shaped arcuate wall part 800*f* has a concave curved shape that is curved so that both of the end positions are at a higher position relative to the central position in the extending direction thereof. Thereby, the upper end edge of the vertical wall part 800*g* is brought closer to a top plate part 802 before the second step.

As described above, a height difference is provided in the band-shaped arcuate wall part (bottom wall) 800*f* of the groove part me between the central position (intermediate position) and both of the end positions (positions on both sides) sandwiching the central position therebetween in a longitudinal sectional view in an extending direction of the groove part me by the pressing in the first step (intermediate step). Thereby, a curved part (second curved part) having a convex curved shape in a plan view and a concave curved shape in a longitudinal sectional view is formed in the band-shaped arcuate wall part 800*f*. Further, in the present embodiment, only the central portion of the band-shaped arcuate wall part 100*d* is formed as a curved portion, but the present invention is not limited to this form, and the band-shaped arcuate wall part 100*d* may all be formed as a curved part.

In the following second step, the top plate part 802 is sandwiched and held between the die and the holder from above and below. Then, the die and holder are brought closer to the punch. Then, an outer surface of the band-shaped arcuate wall part 800*f* hits the punch that is fixed at a fixed position, and thereby the vertical wall part 800*g* is bent to come closer to the rear edge 802*d*. As a result, the height difference is eliminated, the upper edge of the vertical wall part 800*g* is brought closer to the rear edge 802*d*, and the state shown in FIG. 40(*b*) is obtained.

In the following third step, when the upper end edge of the vertical wall part 800*g* is pushed down using the pad, the structural member 401 including the curved reinforcing part 403 having an open cross-sectional shape is formed as shown in FIG. 40(*c*). The curved reinforcing part 403 includes the outer wall 403*c* continuous with the top plate part 402 and directed vertically upward, and the upper wall 403*d* continuous with the outer wall 403*c* and parallel to the upper surface 402*e* of the top plate part 402. Then, the outer wall 403*c* and the upper wall 403*d* have a convex curved shape in a plan view.

When folding-back processing according to the first to third steps as described above is performed, the structural member 401 including the curved reinforcing part 403 having a U-shaped open cross-sectional shape can be formed. In the folding-back processing, the vertical wall part 800*g* is bent to a state in which the upper end edge of the vertical wall part 800*g* is spaced apart from the top plate part 802 while the upper end edge of the vertical wall part 800g overlaps the top plate part 802 when viewed from a direction facing the top plate part 802, and thereby the curved reinforcing part 403 having a U-shaped open cross-sectional shape is formed.

Further, when the vertical wall part 800g is bent by the folding-back processing, the movement of the upper end edge past a predetermined position may be restricted. Also, an upper end edge bending step of forming a bent part (not shown) at which the upper end edge is directed toward the top plate part 802 during the third step may be further provided before the third step.

Figure 41:
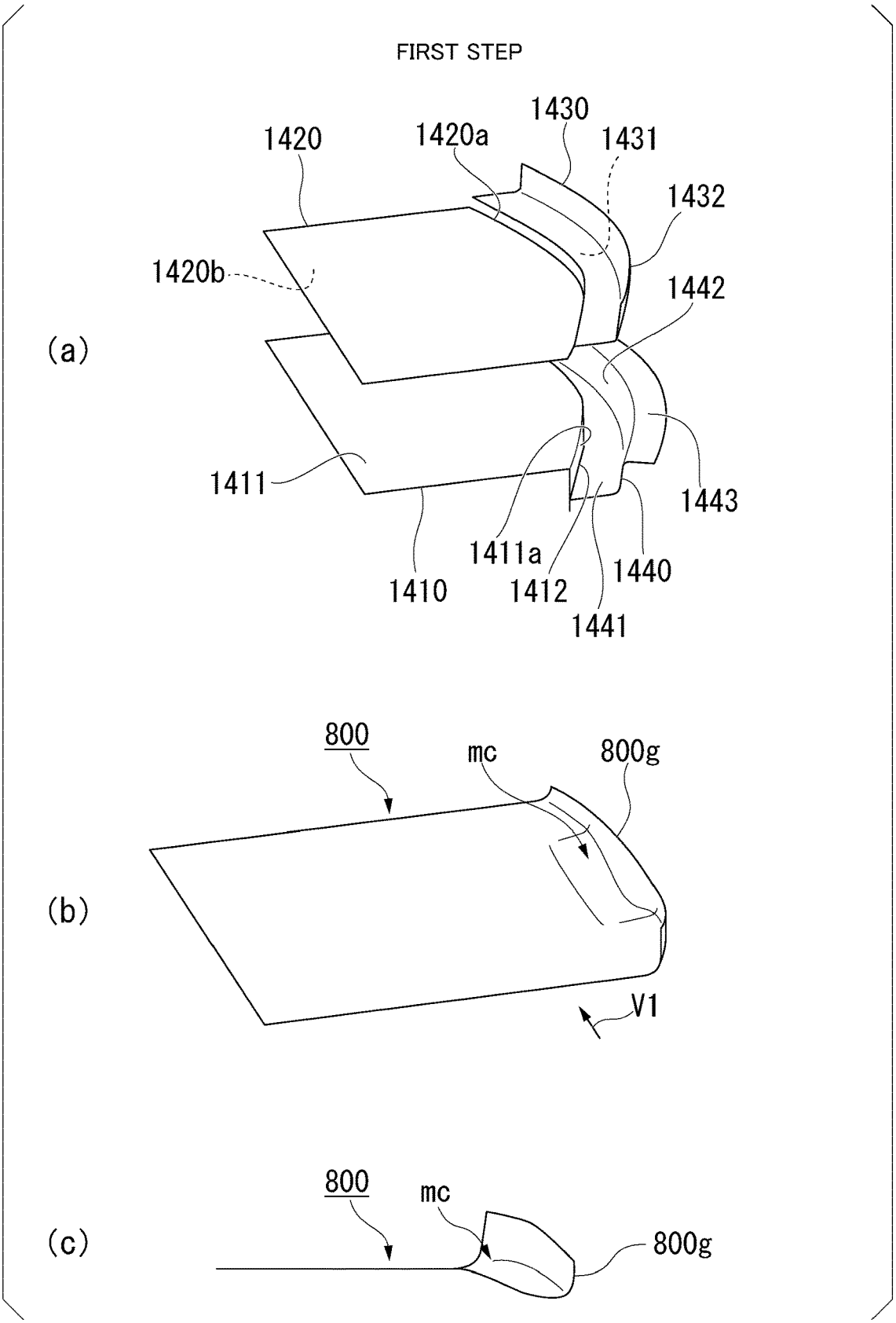
FIG. 41 is a view showing a first step of the manufacturing method of a structural member according to the fourth embodiment, in which FIG. 41(*a*) is a perspective view of dies used in the first step, FIG. 41(*b*) is a perspective view of a blank, and FIG. 41(*c*) is a side view of the blank from the arrow V1 of FIG. 41(*b*).

The first to third steps described above will be described below including a correspondence relationship between the dies. Specifically, the first step will be described with reference to FIG. 41, the second step will be described with reference to FIG. 42, and the third step will be described with reference to FIG. 43.

[Fourth Embodiment/First Step]

First, FIG. 41(a) is a perspective view of dies used in the first step of the present embodiment. As shown in FIG. 41(a), the manufacturing device of a structural member of the present embodiment includes a die 1410 on which the blank 800 is placed, a holder 1420 that presses down a portion of the blank 800 that will become the top plate part 402 from above, a punch 1430 and a lower die 1440 that form a recessed groove on a portion of the blank 800 that will become the curved reinforcing part 403, and a drive unit (not shown) that drives the die 1410, the holder 1420, and the punch 1430 independently of each other. Further, the lower die 1440 is fixed at a fixed position.

The die 1410 includes a top plate support surface 1411 that supports a portion of the blank 800 that will become the top plate part 802, and a vertical wall surface 1412 that is continuous with the top plate support surface 1411. The top plate support surface 1411 is a horizontal plane having an edge 1411a that is curved in the same direction as the curved edge 402a with the same radius of curvature. The vertical wall surface 1412 is a wall surface continuous with the top plate support surface 1411 at the edge 1411a and extending vertically downward. The vertical wall surface 1412 is a convex curved surface that is curved in the same direction as the edge 1411a with the same radius of curvature in a plan view.

The lower die 1440 includes a bottom wall surface 1441, a vertical wall surface 1442, and an upper wall surface 1443.

The bottom wall surface 1441 has a concave curved shape that is curved in the same direction as the edge 1411a in a plan view. Further, the bottom wall surface 1441 has a height difference in a longitudinal sectional view between a central position and an end portion position in an extending direction thereof. That is, the bottom wall surface 1441 has a concave curved shape that is curved so that the central position is deeper (lower) relative to both of the end positions in the extending direction thereof. Further, the bottom wall surface 1441 is slightly different in shape compared to the die groove bottom surface 212b described with reference to FIG. 23 in the second embodiment described above. Specifically, in a case of the die groove bottom surface 212b, the height has been substantially constant in a groove width direction, whereas the bottom wall surface 1441 of the present embodiment has a depth that increases in a direction away from the die 1410 in a groove width direction thereof.

The vertical wall surface 1442 is a wall surface continuous with the bottom wall surface 1441 and extending vertically upward. The vertical wall surface 1442 is a concave curved surface that is curved in the same direction as the edge 1411a in a plan view. The upper wall surface 1443 is a wall surface continuous with an upper end edge of the vertical wall surface 1442 and extending in a horizontal direction.

The holder 1420 includes a convex curved edge 1420a having the same radius of curvature in the same direction as the edge 1411a, and a flat lower surface 1420b that presses down an upper surface 802e of the blank 800.

The punch 1430 includes a pressurizing surface 1431 formed on a bottom part thereof, and a vertical wall surface 1432 formed on a lateral part thereof.

The pressurizing surface 1431 has substantially the same shape as the bottom wall surface 1441. That is, the pressurizing surface 1431 has a concave curved shape that is curved in the same direction as the edge 1411a in a bottom view. Further, the pressurizing surface 1431 has a height difference in a longitudinal sectional view between a central position and an end portion position in an extending direction thereof. That is, the pressurizing surface 1431 has a convex curved shape that is curved so that the central position is deeper (lower) relative to both of the end positions in the extending direction thereof. Further, the pressurizing surface 1431 is slightly different in shape compared to the punch lower end surface 230a3 described with reference to FIG. 22 in the second embodiment described above. Specifically, in a case of the punch lower end surface 230a3, the height has been substantially constant in a width direction thereof, whereas the pressurizing surface 1431 of the present embodiment has a height that decreases in a direction away from the holder 1420 in a width direction thereof.

The vertical wall surface 1432 is a wall surface continuous with the pressurizing surface 1431 and extending vertically upward. The vertical wall surface 1432 is a convex curved surface that is curved in the same direction as the edge 1411a in a plan view.

The above-described bottom wall surface (bottom surface of a fourth die groove) 1441 has a height difference between a central position (intermediate position) and both end positions (positions on both sides) sandwiching the central position therebetween in a longitudinal sectional view in an extending direction of the bottom wall surface 1441. Then, the pressurizing surface 1431 of the punch 1430 (fourth punch) has a height difference corresponding to the bottom wall surface 1441. The bottom wall surface 1441 forms a curved surface (fourth die curved surface) having a convex curved shape in a plan view and a concave curved shape in a longitudinal sectional view. Further, the bottom wall surface 1441 may all be formed as a curved surface, or only a part of the bottom wall surface 1441 may be formed as a curved surface.

The drive unit includes a drive mechanism that brings the holder 1420 closer to and further away from the die 1410, a drive mechanism that raises and lowers the die 1410, and a drive mechanism that raises and lowers the punch 1430 with respect to the lower die 1440.

The blank 800 before processing has a shape shown in FIG. 44(a). That is, the blank 800 has a front edge 802a having a convex shape in a plan view, a pair of lateral edges 802b that are continuous with the front edge 802a, and a rear edge 802d continuous with the pair of lateral edges 802b and facing the front edge 802a. The pair of lateral edges 802b have a linear shape and are parallel to each other. As a plate thickness of the blank 800, 0.8 mm to 6.0 mm is exemplified, but the present invention is not limited to the thickness range. As a material of the blank 800, a metal material such as steel, an aluminum alloy, or a magnesium alloy, or a resin material such as glass fibers or carbon fibers can be used.

Further, a composite material of a metal material and a resin material may also be used as a material of the blank 800.

In order for the manufacturing device of a structural member having the above-described configuration to perform the first step, first, the blank 800 is placed on the top plate support surface 1411 of the die 1410, and then the holder 1420 is lowered by the drive mechanism to sandwich the blank 800 between the holder 1420 and the die 1410. At that time, the front edge 802*a* of the blank 800 is disposed to protrude past the edge 1411*a* of the die 1410 and then fixed.

Figure 44:
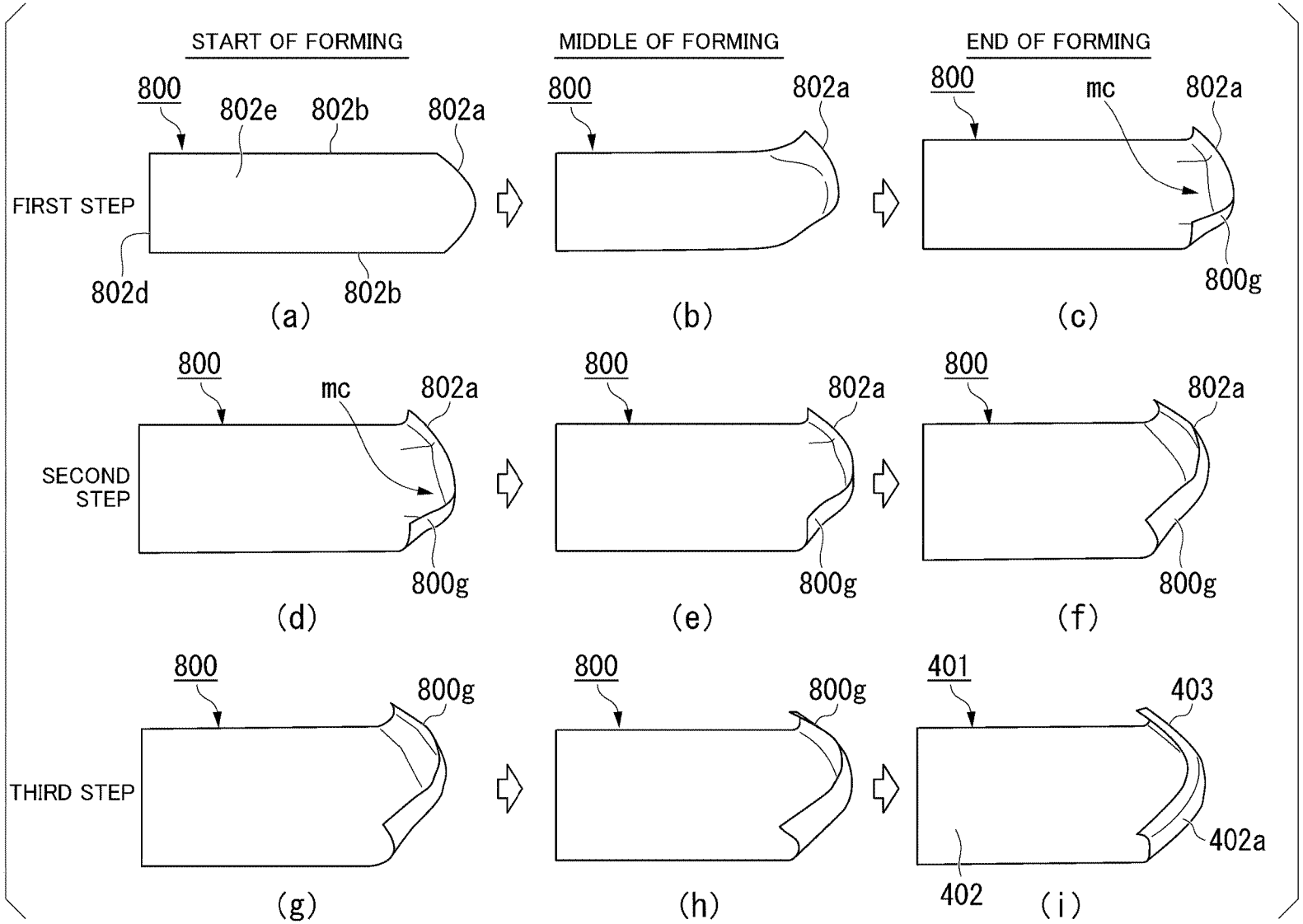
FIG. 44 is a perspective view in which changes in shape of the blank in the manufacturing method of a structural member according to the fourth embodiment are arranged in a time series in order from (a) to (i).

Next, the drive mechanism lowers the punch 1430 toward the lower die 1440. Also, the die 1410 is lowered with the blank 800 sandwiched between the die 1410 and the holder 1420. Then, when the punch 1430 reaches a bottom dead center, a peripheral portion of the blank 800 including the front edge 802*a* is bent vertically upward. That is, the blank 800 reaches the end of forming shown in FIG. 44(*c*) from the start of forming shown in FIG. 44(*a*) through the middle of forming in FIG. 44(*b*). As shown in FIGS. 44(*b*) and 44(*c*), the vertical wall part 800*g* having a convex shape in a plan view with the front edge 802*a* as the upper end edge, and the groove part me positioned at a base portion of the vertical wall part 800*g*, having a convex shape in a plan view, and having a height difference in a width direction of the blank 800 are formed in the blank 800 at the end of forming in the first step. As described above, the upper end edge of the vertical wall part 800*g* is subject to shrink flange deformation Thereafter, the punch 1430 is raised and then the holder 1420 is raised by the drive mechanism. Then, the blank 800 is taken out from a top of the die 1410. As described above, the first step is completed.

[Fourth Embodiment/Second Step]

A second step following the first step will be described with reference to FIG. 42 and FIGS. 44(*d*) to 44(*f*).

Figure 42:
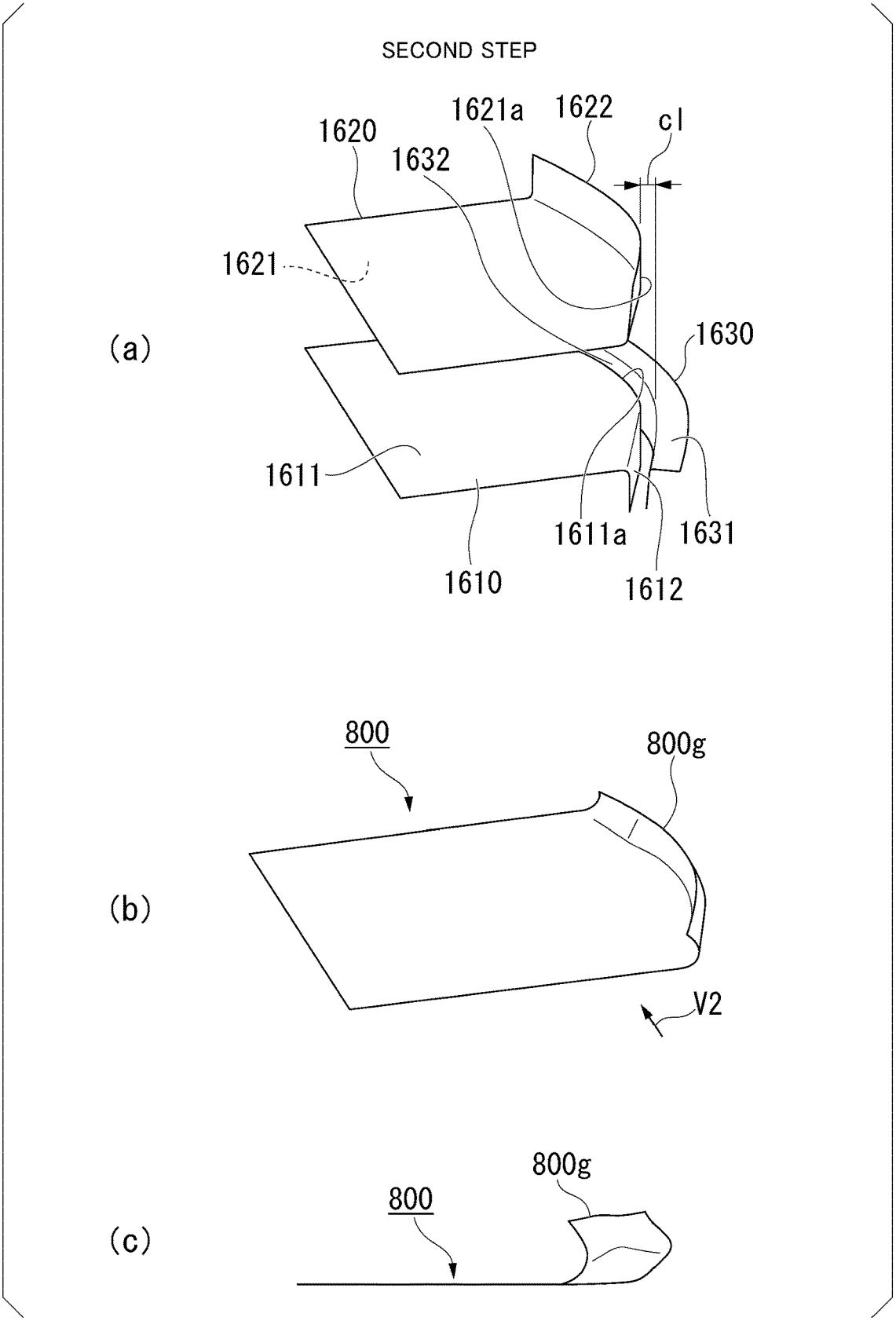
FIG. 42 is a view showing a second step of the manufacturing method of a structural member according to the fourth embodiment, in which FIG. 42(*a*) is a perspective view of dies used in the second step, FIG. 42(*b*) is a perspective view of a blank, and FIG. 42(*c*) is a side view of the blank from the arrow V2 of FIG. 42(*b*).

First, FIG. 42 is a perspective view of dies used in the second step of the present embodiment. As shown in FIG. 42(*a*), the manufacturing device of a structural member according to the present embodiment includes a die 1610 on which the blank 800 after the first step is placed, a holder 1620 that moves closer to and further away from the die 1610, a punch 1630 fixedly disposed on a lateral side of the die 1610, and a drive unit (not shown) that drives the die 1610 and the holder 1620 independently of each other.

The die 1610 includes a top plate support surface 1611 that supports the blank 800 including an outer surface of a portion corresponding to the groove part me thereof, and a vertical wall surface 1612 that is continuous with the top plate support surface 1611. The top plate support surface 1611 is a horizontal plane having an edge 1611*a* curved in the same direction as the edge 1411*a* of the die 1410. The vertical wall surface 1612 is a wall surface continuous with the top plate support surface 1611 at the edge 1611*a* and extending vertically downward. The vertical wall surface 1612 is a convex curved surface that is curved in the same direction as the edge 1611*a* with the same radius of curvature in a plan view.

The punch 1630 includes an upper wall surface 1631 and a vertical wall surface 1632.

The upper wall surface 1631 is a flat surface having a concave curved shape curved in the same direction as the edge 1611*a* in a plan view.

The vertical wall surface 1632 is a wall surface continuous with the upper wall surface 1631 and extending vertically downward. The vertical wall surface 1632 is a concave curved surface that is curved in the same direction as the edge 1611*a* with the same radius of curvature in a plan view.

The holder 1620 includes a bottom wall surface 1621 and a vertical wall surface 1622.

The bottom wall surface 1621 is a flat surface including a convex curved edge 1621*a* having the same radius of curvature in the same direction as the edge 1611*a* in a bottom view and configured to press down the upper surface 802*e* of the blank 800.

The vertical wall surface 1622 is continuous with the bottom wall surface 1621 at the edge 1621*a* and extends vertically upward. The vertical wall surface 1622 is a convex curved surface that is curved in the same direction as the edge 1621*a* with the same radius of curvature in a plan view.

In order to perform the second step by the manufacturing device of a structural member having the above-described configuration, first, the blank 800 is placed on the top plate support surface 1611 of the die 1610, and then the holder 1620 is lowered by the drive mechanism to sandwich the blank 800 between the holder 1620 and the die 1610. Thereby, the height difference at the groove part me formed in the first step is gradually reduced, and in accordance with this deformation, the upper end edge of the vertical wall part 800*g* of the blank 800 comes closer to the rear edge 802*d*. When the holder 1620 is pushed down together with the die 1610 with the blank 800 sandwiched therebetween, the outer surface of the portion of the blank 800 corresponding to the groove part me hits the upper wall surface 1631 of the punch 1630. As a result, the blank 800 is subjected to a reaction force of a force applied to the upper wall surface 1631 and is bent so that the upper end edge of the vertical wall part 800*g* comes further closer to the rear edge 802*d*.

That is, the blank 800 reaches the end of forming shown in FIG. 44(*f*) from the start of forming of the second step shown in FIG. 44(*d*) through the middle of forming in FIG. 44(*e*). As shown in FIGS. 42(*b*) and 42(*c*), the groove part me is eliminated and the height difference is disappeared in the blank 800 at the end of forming. Therefore, a lower surface of the blank 800 is flat. Also, the vertical wall part 800*g* is subjected to the reaction force from the punch 1630 in addition to the reduction in the height difference. Therefore, the vertical wall part 800*g* can be inclined in advance to be reliably collapsed in the next third step.

Thereafter, the holder 1620 is raised by the drive mechanism. Then, the blank 800 is taken out from a top of the die 1610. As described above, the second step is completed.

Further, as shown in FIG. 42, the vertical wall surface 1632 (fourth vertical wall surface) of the punch 1630 is preferably disposed to face the vertical wall surface 1622 (third vertical wall surface) of the holder 1620 at a distance cl of 5 mm or more and 50 mm or less in a horizontal direction. In this case, the upper end edge of the vertical wall part 800*g* can be more reliably inclined to come closer to the top plate part 802 in the manner of leaning forward while leaving the bent portion formed in the first step at the intermediate position in the height direction of the vertical wall part 800*g*. The reason is the same as the reason described with reference to FIG. 6(*b*) in the first embodiment described above, and description thereof will be omitted here.

[Fourth Embodiment/Third Step]

A third step following the second step will be described with reference to FIG. 43 and FIGS. 44(*g*) to 44(*i*).

Figure 43:
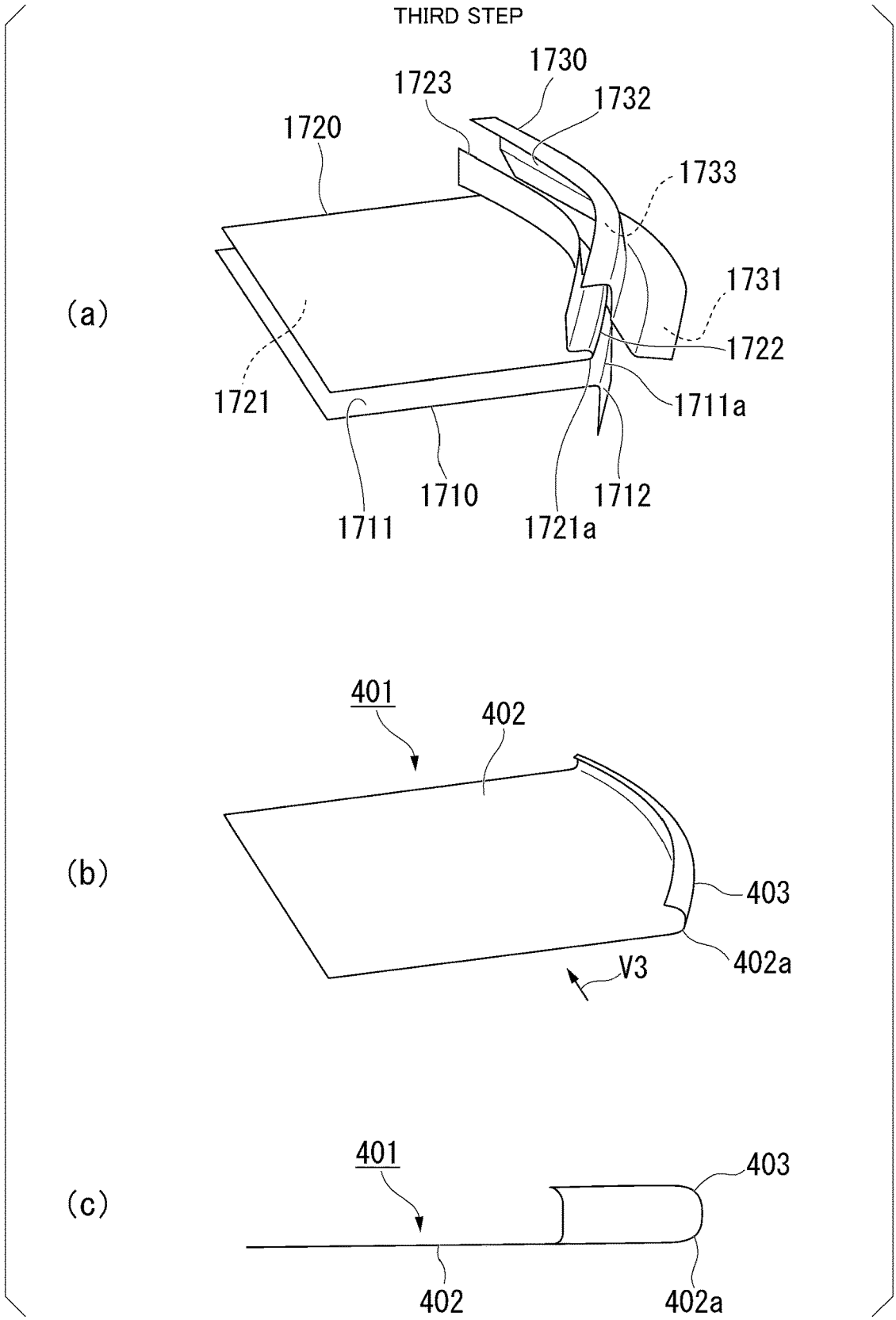
FIG. 43 is a view showing a third step of the manufacturing method of a structural member according to the fourth embodiment, in which FIG. 43(*a*) is a perspective view of dies used in the third step, FIG. 43(*b*) is a perspective view of a blank, and FIG. 43(*c*) is a side view of the blank from the arrow V3 of FIG. 43(*b*).

First, FIG. 43(*a*) is a perspective view of dies used in the third step of the present embodiment. As shown in FIG. 43(*a*), the manufacturing device of a structural member according to the present embodiment includes a die 1710 on which the blank 800 after the second step is placed, a holder 1720 that moves closer to and further away from the die 1710, a pad 1730 that moves closer to and further away from the holder 1720, and a drive unit (not shown) that drives the holder 1720 and the pad 1730 independently of each other.

The die 1710 includes a top plate support surface 1711 that supports the blank 800, and a vertical wall surface 1712 that is continuous with the top plate support surface 1711. The top plate support surface 1711 is a horizontal plane having an edge 1711*a* curved in the same direction as the edge 1611*a* of the die 1610 with the same radius of curvature. The vertical wall surface 1712 is a wall surface continuous with the top plate support surface 1711 at the edge 1711*a* and extending vertically downward. The vertical wall surface 1712 is a convex curved surface that is curved in the same direction as the edge 1711*a* with the same radius of curvature in a plan view.

The holder 1720 includes a bottom wall surface 1721, a folded-back surface 1722, and a vertical wall surface 1723.

The bottom wall surface 1721 is a flat surface including a convex curved edge 1721*a* having the same radius of curvature in the same direction as the edge 1711*a* in a bottom view and configured to press down the upper surface 802*e* of the blank 800.

The folded-back surface 1722 is a bent surface continuous with the bottom wall surface 1721 at the edge 1721*a* and folded back from the edge 1721*a* in a direction that overlaps the bottom wall surface 1721 in a plan view. The folded-back surface 1722 has a curved shape having the same radius of curvature in the same direction as the edge 1721*a* in a plan view. The folded-back surface 1722 is a convex curved surface that is curved in the same direction as the edge 1621*a* with the same radius of curvature in a plan view.

The vertical wall surface 1723 is continuous with the bottom wall surface 1721 via the folded-back surface 1722 and extends vertically upward. The vertical wall surface 1723 is a convex curved surface that is curved in the same direction as the edge 1721*a* in a plan view.

The pad 1730 has a first lower surface 1731, an inclined surface 1732, and a second lower surface 1733.

The first lower surface 1731 is a flat surface having a curved shape that is concave in a direction away from the holder 1720 in a bottom view.

The inclined surface 1732 is continuous with the first lower surface 1731 and is formed obliquely upward. The inclined surface 1732 is a curved surface having a curved shape that is concave in a direction away from the holder 1720 in a bottom view.

The second lower surface 1733 is a flat surface continuous with the inclined surface 1732 and having a curved shape that is concave in a direction away from the holder 1720 in a bottom view.

In order to perform the third step by the manufacturing device of a structural member having the above-described configuration, first, the blank 800 after the second step is placed on the top plate support surface 1711 of the die 1710, and then the holder 1720 is lowered by the drive mechanism to sandwich the blank 800 between the holder 1720 and the die 1710. Next, the pad 1730 is lowered by the drive mechanism. Then, the second lower surface 1733 of the pad 1730 comes into contact with an upper edge of the vertical wall part 800*g* and then bends the vertical wall part 800*g* while bring it down. At the time of the bending, the vertical wall part 800*g* has been inclined in advance in the first step and the second step, and in addition, shrink flange deformation has been applied to the upper edge of the vertical wall part 800*g* in advance, the vertical wall part 800*g* can be bent with a margin. As a result of the bending, the structural member 401 can be obtained.

Here, a gap at a bottom dead center of forming with respect to the top plate support surface 1711 (fourth top plate support surface) of the die 1710 is larger on the pressurizing surface (second lower surface 1733) of the pad 1730 than on the pressurizing surface (bottom wall surface 1721) of the holder 1720. More specifically, when the holder 1720 reaches the bottom dead center, a gap between the pressurizing surface of the holder 1720 and the top plate support surface 1711 of the die 1710 is defined as g7. Further, when the pad 1730 reaches the bottom dead center, a gap between the pressurizing surface of the pad 1730 and the top plate support surface 1711 of the die 1710 is defined as g8. In this case, the gap g7 is substantially equal to a plate thickness of the top plate part 402, and the gap g6 is substantially equal to a thickness dimension of the curved reinforcing part 403. That is, gap g8>gap g7 is established. Therefore, in the holder 1720, the top plate part 402 can be firmly sandwiched between the holder 1720 and the die 1710, and in the pad 1730, the curved reinforcing part 403 having an open cross-sectional shape can be obtained between the pad 1730 and the die 1710.

Thereafter, the pad 1730 is first raised by the drive mechanism. Then, the holder 1720 is slightly raised by the drive mechanism to be spaced apart from the top plate support surface 1711 of the die 1710. Thereby, the structural member 401 is released from being fixed. In that state, the structural member 401 can be removed by pulling out the structural member 401 horizontally from between the holder 1720 and the die 1710. As described above, the third step is completed.

The blank 800 of the present embodiment becomes the structural member 401 when the blank 800 reaches the end of forming shown in FIG. 44(*i*) from the start of forming of the third step shown in FIG. 44(*g*) through the middle of forming in FIG. 44(*h*). As shown in FIGS. 43(*b*) and 43(*c*), the structural member 401 at the end of forming includes the top plate part 402 having the convex curved edge 402*a* in a bottom view, and the curved reinforcing part 403 that is formed integrally with the top plate part 402 in the extending direction of the curved edge 402*a* and in which a cross section perpendicular to the above-described extending direction has an open cross-sectional shape.

An outline of the present embodiment described above is summarized below.

The manufacturing method of a structural member of the present embodiment is a method of manufacturing the structural member 401 including the top plate part 402 having the curved edge 402*a*, and the curved reinforcing part 403 that is formed integrally with the top plate part 402 in the extending direction of the curved edge 402*a* and in which a cross section perpendicular to the extending direction of the curved edge 402*a* has an open cross-sectional shape from the blank 800 (flat plate material). Specifically, the manufacturing method includes the first step (intermediate step) of forming the groove part me and the vertical wall part 800*g* that is continuous with the groove part me along a portion of the blank 800 that will become the curved edge 402*a*, in a state in which a portion (first portion) of the blank 800 corresponding to the top plate part 402 is sandwiched, by pressing the other portion (second portion) that is continuous with the above-described portion in a direction intersecting the upper surface 802*e* of the blank 800.

Due to the pressing in the first step, a height difference is provided on the band-shaped arcuate wall part 800*f* (bottom wall) of the groove part mc between the central position and the end portion position in a longitudinal sectional view in the extending direction of the groove part mc. The band-shaped arcuate wall part 800*f* has a convex curved shape in a plan view and a concave curved shape in a longitudinal sectional view.

Further, the portion corresponding to the top plate part 402 is not completely fixed but is in a sandwiched state at the time of the press forming in the first step. Therefore, movement and deformation of the sandwiched portion out of the plane is restricted, but a metal flow in which some of the sandwiched portion is directed toward another portion is allowed.

In addition, the manufacturing method of a structural member in the present embodiment may be configured as follows.

That is, when viewed along a cross-sectional line length of the groove part me along an inner shape of a cross section perpendicular to the extending direction of the groove part mc, a ratio obtained by dividing the cross-sectional line length at the central position by the cross-sectional line length at the end portion position may be set within a range of 0.7 to 1.3 by the pressing in the first step. Further, the cross-sectional line lengths at the central position and the end portion position may be the same as each other. Further, the cross-sectional line length at any position in the extending direction of the groove part mc may be all equal.

When the ratio of the cross-sectional line lengths is less than 0.7 or more than 1.3, a difference in the cross-sectional line length between the central position and the end portion position becomes too large. In this case, when the curved reinforcing part 403 having substantially the same cross-sectional area at any position in the extending direction of the groove part mc is formed, the difference in the cross-sectional line length may cause forming defects such as cracks or wrinkles at an end edge of the upper wall 403*d*. Therefore, the ratio of the cross-sectional line lengths is preferably in the range of 0.7 to 1.3.

Also, in the band-shaped arcuate wall part 800*f* (bottom wall) of the groove part mc, an R/R1 ratio obtained by dividing the radius of curvature R (mm) of a center line CL passing through a central position in a width direction in a plan view by the radius of curvature R1 (mm) in a longitudinal sectional view may be set within a range of 0.2 to 1.2. In this case, a suitable forming result without constriction or dimensional errors can be obtained even when a high-strength steel sheet of 780 MPa class is used as the blank 800. Further, when a high-strength steel sheet of 980 MPa class or higher is used, the R/R1 ratio is more preferably within a range of 0.3 to 0.9, and in this case, a suitable forming result without constriction or dimensional errors can be obtained even if a high-strength steel sheet of 980 MPa class is used. Further, it is most preferable to set the R/R1 ratio to 0.5, and in this case, a suitable forming result without constriction or dimensional errors can be obtained even when a high-strength steel sheet of 1180 MPa class is used.

On the other hand, when this is viewed from another perspective, it is preferable that the radius of curvature of the band-shaped arcuate wall part 800*f* in a longitudinal sectional view be made larger than the radius of curvature of the center line passing through the central position in a width direction of the band-shaped arcuate wall part 800*f* in a plan view by the pressing in the first step (R1>R). In this case, it is possible to avoid unstable positioning when the structural member is transferred to another die in the next step.

In the manufacturing method of a structural member of the present embodiment, the third step, which is performed after the pressing of the first step and then through the second step, further includes a bending step of bending the upper end edge of the vertical wall part 800*g* toward the top plate part 802 by pushing down the upper end edge toward the groove part me while movement thereof toward the top plate part 802 is allowed.

The bending step includes a folding-back step. In the folding-back step, the vertical wall part 800*g* is bent to a state in which the upper end edge of the vertical wall part 800*g* is spaced apart from the top plate part 802 in a side view while the upper end edge overlaps the top plate part 802 when viewed from a direction facing the top plate part 802. As a result, the curved reinforcing part 403 having an open cross-sectional shape can be formed.

Further, when the vertical wall part 800*g* is further bent in the folding-back step, the movement of the upper end edge past a predetermined position is restricted. That is, when the upper end edge comes into contact with the vertical wall surface 1723 of the holder 1720 and is restricted, the curved reinforcing part 403 having an appropriate open cross section can be formed.

Further, an upper end edge bending step of forming a bent part (not shown, a bend corresponding to the bent part Q1 referred to in the first embodiment) at which the upper end edge is directed toward the top plate part 802 during the folding-back step may be performed before the folding-back step.

The structural member 401 may be an automobile body part. More specifically, the present invention may be applied in manufacturing lower arms.

The manufacturing device of a structural member of the present embodiment can be appropriately used in the above-described manufacturing method, and the structural member 401 is manufactured from the blank 800.

Then, the manufacturing device includes the die 1410 (third die) having the top plate support surface 1411 (second top plate support surface) including the curved edge 1411*a* (first die curved edge) in a plan view, the holder 1420 (third holder) that moves closer to and further away from the top plate support surface 1411, the lower die 1440 (fourth die) having the bottom wall surface 1441 (fourth die groove) disposed adjacent to the edge 1411*a* in a plan view, and the punch 1430 (fourth punch) that moves closer to and further away from the bottom wall surface 1441.

The bottom wall surface 1441 has a height difference between the central position and the end portion position in a longitudinal sectional view in an extending direction thereof. Similarly, the pressurizing surface 1431 of the punch 1430 also has a height difference corresponding to the bottom wall surface 1441. That is, the pressurizing surface 1431 has a height difference between the central position and the end portion position in a longitudinal sectional view in an extending direction thereof.

The bottom wall surface 1441 has a convex curved shape in a plan view and a concave curved shape in a longitudinal sectional view.

The manufacturing device of a structural member of the present embodiment may employ the following configuration.

That is, when viewed along a cross-sectional line length of the bottom wall surface 1441 along an inner shape of a cross section perpendicular to the extending direction thereof, a ratio obtained by dividing the cross-sectional line length at the central position by the cross-sectional line length at the end portion position may be set within a range of 0.7 to 1.3. Further, the cross-sectional line lengths at the central position and the end portion position may be the same as each other. Further, the cross-sectional line length at any position in the extending direction of the bottom wall surface 1441 may be all equal. Thereby, forming defects described above can be more reliably prevented.

An R/R1 ratio of the bottom wall surface 1441 obtained by dividing the radius of curvature R (mm) of a center line passing through a central position in a width direction in a plan view by the radius of curvature R1 (mm) in a longitudinal sectional view may be set within a range of 0.2 to 1.2. In this case, a suitable forming result without constriction or dimensional errors can be obtained even when a high-strength steel sheet of 780 MPa class is used as the blank 500. Further, when a high-strength steel sheet of 980 MPa class or higher is used, the R/R1 ratio is more preferably within a range of 0.3 to 0.9, and in this case, a suitable forming result without constriction or dimensional errors can be obtained even if a high-strength steel sheet of 980 MPa class is used. Further, it is most preferable to set the R/R1 ratio to 0.5, and in this case, a suitable forming result without constriction or dimensional errors can be obtained even when a high-strength steel sheet of 1180 MPa class is used.

On the other hand, when this is viewed from another perspective, it is preferable that the radius of curvature R1 of the bottom wall surface 1441 in a longitudinal sectional view be made larger than the radius of curvature R of the center line passing through the central position in a width direction of the bottom wall surface 1441 in a plan view (R1>R). In this case, it is possible to avoid unstable positioning when the structural member is transferred to another die in the next step.

The manufacturing device of a structural member of the present embodiment uses the following dies in the second step following the first step.

That is, the die 1610 (fifth die) having the top plate support surface 1611 (third top plate support surface) including the curved edge 1611*a* (second die curved edge) in a plan view, the holder 1620 (fourth holder) that moves closer to and further away from the top plate support surface 1611, and the punch 1630 (fifth punch) that is disposed adjacent to the edge 1611*a* in a plan view are used.

The manufacturing device of a structural member of the present embodiment uses the following dies in the third step following the second step.

That is, the die 1710 (sixth die) having the top plate support surface 1711 (fourth top plate support surface) including the curved edge 1711*a* (third die curved edge) in a plan view, the holder 1720 (fifth holder) that moves closer to and further away from the top plate support surface 1711, and the pad 1730 (sixth punch) having the second lower surface 1733 (pressurizing surface) that overlaps a top of the edge 1711*a* in a plan view and configured to move closer to and further away from the die 1710 are used.

In the manufacturing device of a structural member of the present embodiment, the holder 1720 has the vertical wall surface 1723 (third restricting surface) adjacent to the second lower surface 1733 of the pad 1730 and extending in a direction intersecting the second lower surface 1733.

Instead of providing the vertical wall surface 1723, the pad 1730 may have a vertical wall surface (not shown, a fourth restricting surface) continuous with the second lower surface 1733 of the pad 1730 and extending in a direction intersecting the second lower surface 1733.

EXAMPLES

First Example

A first example of the manufacturing method and the manufacturing device of a structural member according to the present invention will be described below with reference to FIGS. 45 and 46.

Figure 45:
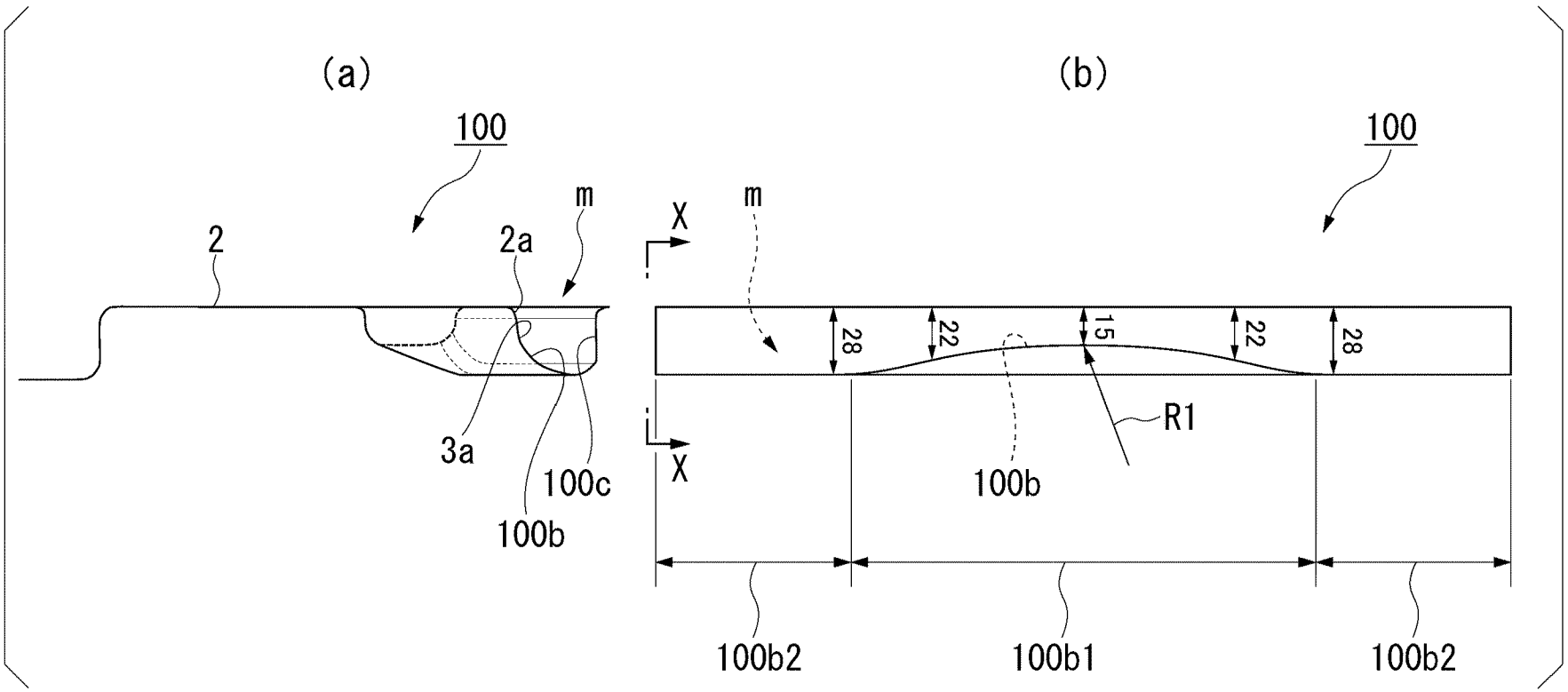
FIG. 45 is a view showing a blank after an intermediate step in a first example, in which FIG. 45(*a*) is a side view along line X-X indicated by the arrows in FIG. 45(*b*) and FIG. 45(*b*) is a front view.

FIG. 45 is a view showing a blank 100 after an intermediate step in the present example, in which FIG. 45(*a*) is a side view along line X-X indicated by the arrows in FIG. 45(*b*), and FIG. 45(*b*) is a front view. FIG. 46 is a view showing the structural member 1 in the present example, in which FIG. 46(*a*) is a side view along line Y-Y indicated by the arrows in FIG. 46(*b*), and FIG. 46(*b*) is a front view.

Since a structural member 1 of the present example has substantially the same configuration as the structural member 1 of the first embodiment described above with reference to FIG. 1, the same reference signs are used for details of the parts and description thereof will be omitted.

Figure 46:
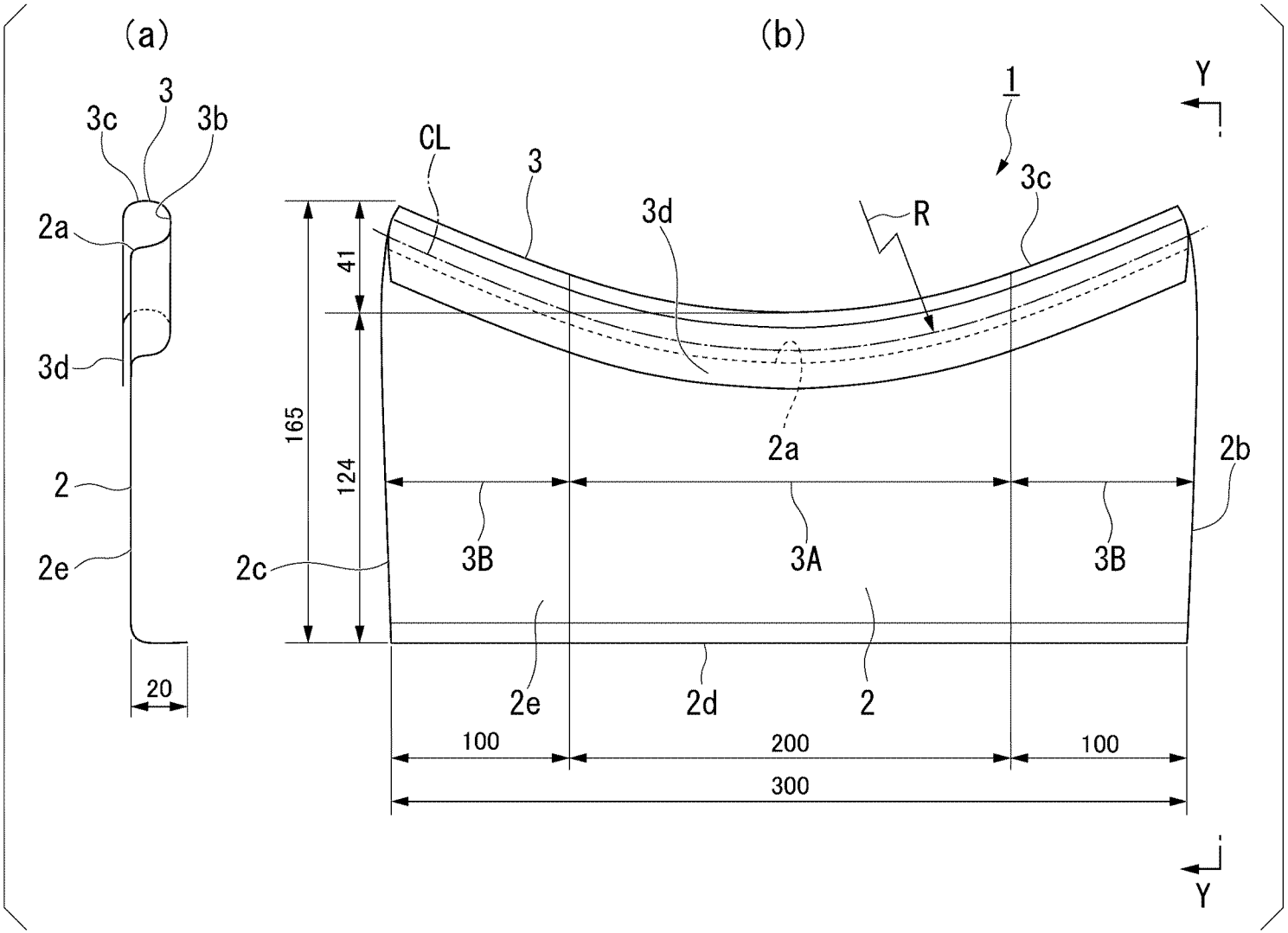
FIG. 46 is a view showing a structural member in the first example, in which FIG. 46(*a*) is a side view along line Y-Y indicated by the arrows in FIG. 46(*b*) and FIG. 46(*b*) is a front view.

The structural member 1 shown in FIGS. 46(*a*) and 46(*b*) includes the top plate part 2 having the curved edge 2*a*, and the curved reinforcing part 3 that is formed integrally with the top plate part 2 in an extending direction of the curved edge 2*a* and in which a cross section perpendicular to the above-described extending direction has a closed cross-sectional shape.

Further, in FIG. 46(*a*), a joint portion is shown to be slightly open so that shapes of the curved edge 2*a* and the curved reinforcing part 3 can be easily understood, but in practice, the joint portion is joined without gaps and the curved reinforcing part 3 forms a closed cross-sectional shape.

As shown in FIG. 46(*b*), the curved reinforcing part 3 includes an arc part 3A positioned at a central position in an extending direction and a pair of linear parts 3B that are integrally continuous with positions on both sides of the arc part 3A. The arc part 3A is concavely curved toward the top plate part 2 in a plan view and has a radius of curvature of R (mm). Then, upper and lower surfaces of the are part 3A are substantially parallel to the upper surface 2*e* of the top plate part 2. The linear parts 3B are integrally continuous with both left and right ends of the arc part 3A without a height difference. The linear parts 3B have a linear shape in both a plan view and a front view. Upper and lower surfaces of the linear parts 3B are substantially parallel to the upper surface 2*e* of the top plate part 2.

The structural member 1 described above can be obtained by subjecting the blank 100 which is a flat plate material to the intermediate step and the bending step. As shown in FIGS. 45(*a*) and 45(*b*), the blank 100 after the intermediate step includes the top plate part 2 and the groove part m that is integrally continuous with the top plate part 2 via the curved edge 2*a*. The groove part m is formed by the inner wall 3*a* and the vertical wall part 100*c*, and the band-shaped arcuate wall part (bottom wall) 100*b* connecting lower end edges of them. As shown in FIG. 45(*b*), the inner wall 3*a*, the vertical wall part 100*c*, and the band-shaped arcuate wall part 100*b* have a curved shape curved in the same direction as each other in a plan view.

The band-shaped arcuate wall part 100*b* in a longitudinal sectional view in an extending direction thereof includes an arcuate bottom wall part 100*b*1 positioned at a center in the extending direction, and a pair of linear bottom wall parts 100*b*2 that are continuous with positions on both sides of the arcuate bottom wall part 100*b*1.

The arcuate bottom wall part **100*b*1 has a convex curved shape vertically upward in a longitudinal sectional view and has a radius of curvature of R1 (mm). Therefore, the groove part m has a height difference between a central position (intermediate position) and both end positions (positions on both sides) sandwiching the central position therebetween in a longitudinal sectional view in an extending direction thereof. The groove part m is highest at the central position in a longitudinal direction of the arcuate bottom wall part 100*b*1 and is lowest at both of the end positions in the longitudinal direction of the arcuate bottom wall part 100*b*1**.

The arcuate bottom wall part **100*b*1 is concavely curved toward the top plate part 2 in a plan view, and a radius of curvature of a center line CL passing through a central position in a width direction in the plan view is R (mm). The arcuate bottom wall part 100*b*1 is a portion to be a part of the arc part 3A when the flat plate material 100 is subjected to the bending step to be formed into the structural member 1**.

The linear bottom wall parts **100*b*2 are integrally continuous with both left and right ends of the arcuate bottom wall part 100*b*1 without a height difference. The linear bottom wall parts 100*b*2 have a linear shape in both a plan view and a longitudinal sectional view. Upper and lower surfaces of the linear bottom wall parts 100*b*2 are substantially parallel to the upper surface 2*e* of the top plate part 2**.

For a case of obtaining the structural member 1 of FIG. 46 by subjecting the blank of FIG. 45 having the configuration described above to a bending step, numerical calculations were performed by changing radii of curvature R and R1 and a steel sheet strength (tensile strength). Further, plate thicknesses were all set to 2.3 mm in common.

Specifically, for the radius of curvature R, two cases of 250 mm and 60 mm were used.

Also, when the radius of curvature R was 250 mm, a total of six cases of the radius of curvature R1 including 160 mm, 200 mm, 250 mm, 500 mm, 1000 mm, and 2000 mm were used. Also, when the radius of curvature R was 60 mm, a total of six cases of the radius of curvature R1 including 40 mm, 50 mm, 60 mm, 120 mm, 400 mm, and 600 mm were used. Thereby, the same ratios of R/R1 of 1.5, 1.2, 1.0, 0.5, 0.2, and 0.1 were used in common for both the cases in which the radii of curvature R were 250 mm and 60 mm. Further, values other than the radii of curvature R and R1 were as shown in FIGS. 45 and 46.

Further, three cases of steel sheet strengths including a steel sheet of 780 MPa class, a steel sheet of 980 MPa class, and a steel sheet of 1180 MPa class were used.

Numerical calculations were performed by appropriately combining the above parameters, and results of investigation on presence or absence of forming defects were shown in Table 1 below.

TABLE 1

| Radius of curvature R (mm) in plan view | Radius of curvature R1 (mm) in longitudinal sectional view (Examples only) | Ratio of radius of curvature R/R1(—) (Examples only) | Steel sheet of 780 MPa class | | Steel sheet of 980 MPa class | | Steel sheet of 1180 MPa class | |
|---|---|---|---|---|---|---|---|---|
| | | | Comparative example | Examples | Comparative example | Examples | Comparative example | Examples |
| 250 | 160 | 1.5 | BAD (Dimensional error) | NOT GOOD (Constriction) | BAD (Breakage) | BAD (Breakage) | BAD (Breakage) | BAD (Breakage) |
| | 200 | 1.2 | | GOOD | | NOT GOOD (Constriction) | | BAD (Breakage) |
| | 250 | 1.0 | | GOOD | | GOOD | | NOT GOOD (Constriction) |
| | 500 | 0.5 | | GOOD | | GOOD | | GOOD |
| | 1000 | 0.2 | | GOOD | | BAD (Dimensional error) | | BAD (Dimensional error) |
| | 2000 | 0.1 | | BAD (Dimensional error) | | BAD (Dimensional error) | | BAD (Dimensional error) |
| 60 | 40 | 1.5 | BAD (Breakage) | NOT GOOD (Constriction) | BAD (Breakage) | BAD (Breakage) | BAD (Breakage) | BAD (Breakage) |
| | 50 | 1.2 | | GOOD | | NOT GOOD (Constriction) | | BAD (Breakage) |
| | 60 | 1.0 | | GOOD | | NOT GOOD (Constriction) | | NOT GOOD (Constriction) |
| | 120 | 0.5 | | GOOD | | GOOD | | GOOD |
| | 400 | 0.2 | | GOOD | | BAD (Dimensional error) | | BAD (Dimensional error) |
| | 600 | 0.1 | | BAD (Dimensional error) | | BAD (Dimensional error) | | BAD (Dimensional error) |

As shown in Table 1, in a case of the steel sheet of 780 MPa class, the R/R1 ratio was within the range of 0.2 to 1.2 in both the cases having the radii of curvature R of 250 mm and 60 mm, and a suitable forming result without constriction or dimensional errors could be obtained.

In a case of the steel sheet of 980 MPa class, the R/R1 ratio was 0.2 or less or 1.2 or more in the case in which the radius of curvature R was 250 mm, and problems such as breakage, constriction, and dimensional errors occurred. On the other hand, the R/R1 ratio was 0.2 or less or 1.0 or more in the case in which the radius of curvature R was 60 mm, and problems such as breakage, constriction, and dimensional errors occurred.

In a case of the steel sheet of 1180 MPa class, the R/R1 ratio was 0.2 or less or 1.0 or more in both the cases with the radius of curvature R of 250 mm and 60 mm, and problems such as breakage, constriction, and dimensional errors occurred.

From the above results, a result could be obtained that the R/R1 ratio was preferably within a range of 0.2 to 1.2. Further, when a steel sheet having an even higher strength of 980 MPa class or higher is used, a result could be obtained that the R/R1 ratio was preferably within a range of 0.3 to 0.9, and the R/R1 ratio was most preferably 0.5.

As described above, according to the present example, it was ascertained that the present invention was also effective for high-strength steel sheets such as a steel sheet of 780 MPa class, a steel sheet of 980 MPa class, and furthermore a steel sheet of 1180 MPa class.

Further, in the present example, it is the result of a case in which the curved reinforcing part 3 has a closed cross-sectional shape. When the same numerical calculation was performed for a case in which the curved reinforcing part 3 had an open cross-sectional shape, the result of the R1/R ratio was the same as that in the case of the closed cross-sectional shape. Therefore, also in the case of the open cross-sectional shape, the R/R1 ratio is preferably within the above-described ranges.

Second Example

A second example of a manufacturing method and a manufacturing device of a structural member according to the present invention will be described below with reference to FIGS. 47 and 48.

Figure 47:
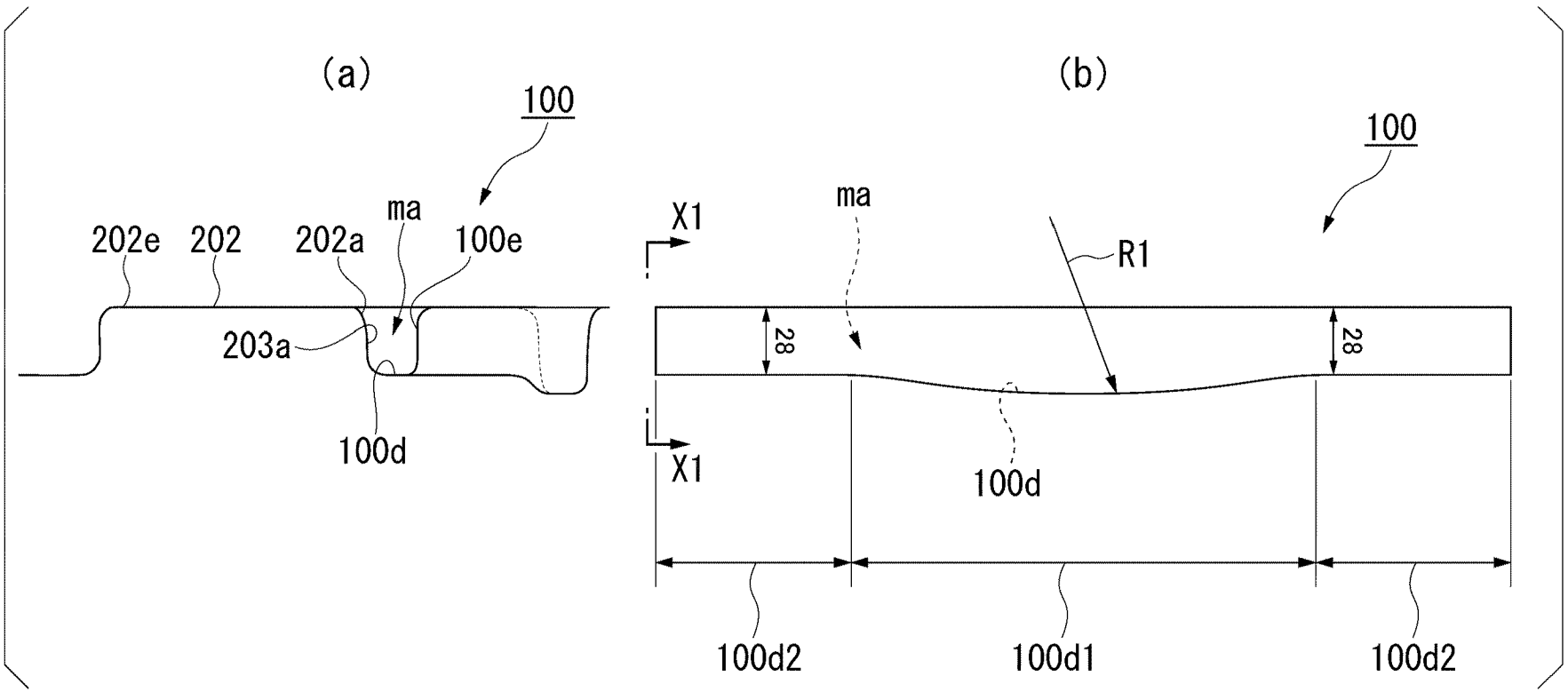
FIG. 47 is a view showing a blank after an intermediate step in a second example, in which FIG. 47(*a*) is a side view along line X1-X1 indicated by the arrows in FIG. 47(*b*) and FIG. 47(*b*) is a front view.

FIG. 47 is a view showing a blank 100 after an intermediate step in the present example, in which FIG. 47(*a*) is a side view along line X1-X1 indicated by the arrows in FIG. 47(*b*), and FIG. 47(*b*) is a front view. FIG. 48 is a view showing a structural member 201 in the present example, in which FIG. 48(*a*) is a side view along line Y1-Y1 indicated by the arrows in FIG. 48(*b*), and FIG. 48(*b*) is a front view.

Since a structural member 201 of the present example has substantially the same configuration as the structural member 201 of the second embodiment described above with reference to FIG. 30, the same reference signs are used for details of the parts and description thereof will be omitted.

Figure 48:
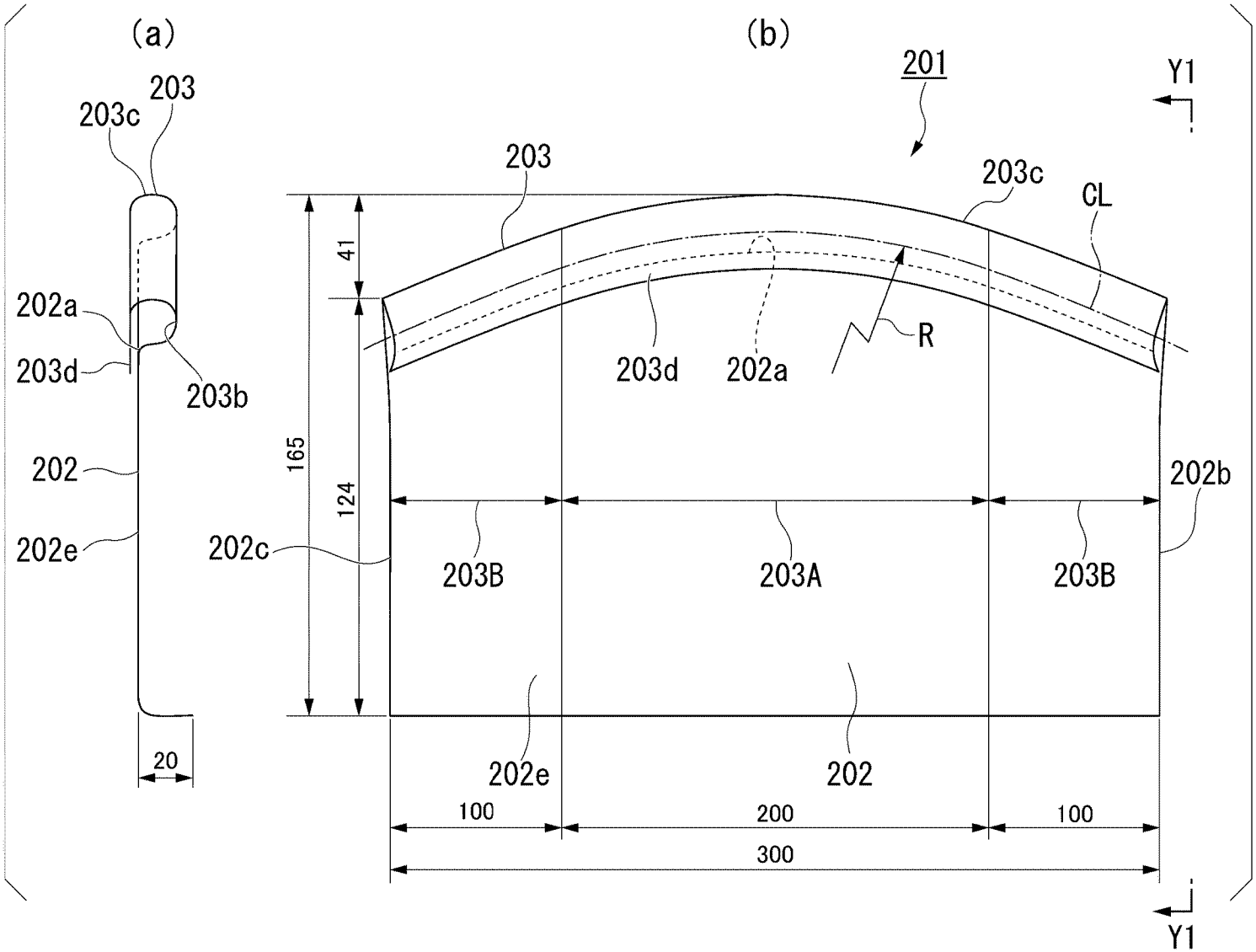
FIG. 48 is a view showing a structural member in the second example, in which FIG. 48(*a*) is a side view along line Y1-Y1 indicated by the arrows in FIG. 48(*b*) and FIG. 48(*b*) is a front view.

The structural member 201 shown in FIGS. 48(*a*) and 48(*b*) includes the top plate part 202 having the curved edge 202*a*, and the curved reinforcing part 203 that is formed integrally with the top plate part 202 in an extending direction of the curved edge 202*a* and in which a cross section perpendicular to the above-described extending direction has a closed cross-sectional shape.

Further, in FIG. 48(*a*), a joint portion is shown to be slightly open so that shapes of the curved edge 202*a* and the curved reinforcing part 203 can be easily understood, but in practice, the joint portion is joined without gaps and the curved reinforcing part 203 forms a closed cross-sectional shape.

As shown in FIG. 48(*b*), the curved reinforcing part 203 includes an arc part 203A positioned at a central position in an extending direction and a pair of linear parts 203B that are integrally continuous with positions on both sides of the arc part 203A. The arc part 203A is convexly curved in a direction away from the top plate part 202 in a plan view and has a radius of curvature of R (mm). Then, upper and lower surfaces of the arc part 203A are substantially parallel to the upper surface 202*e* of the top plate part 202. The linear parts 203B are integrally continuous with both left and right ends of the arc part 203A without a height difference. The linear parts 203B have a linear shape in both a plan view and a front view. Upper and lower surfaces of the linear parts 203B are substantially parallel to the upper surface 202*e* of the top plate part 202.

The structural member 201 described above can be obtained by subjecting the blank 100 which is a flat plate material to the intermediate step and the bending step. As shown in FIGS. 47(*a*) and 47(*b*), the blank 100 after the intermediate step includes the top plate part 202 and the groove part ma that is integrally continuous with the top plate part 202 via the curved edge 202*a*. The groove part ma is formed by the inner wall 203*a* and the vertical wall part 100*e*, and the band-shaped arcuate wall part (bottom wall) 100*d* connecting lower end edges of them. The inner wall 203*a*, the vertical wall part 100*e*, and the band-shaped arcuate wall part 100*d* have a curved shape curved in the same direction as each other in a plan view.

The band-shaped arcuate wall part 100*d*, in a longitudinal sectional view in an extending direction thereof, includes an arcuate bottom wall part 100*d*1 positioned at a center in the extending direction, and a pair of linear bottom wall parts 100*d*2 that are continuous with positions on both sides of the arcuate bottom wall part 100*d*1.

The arcuate bottom wall part 100*d*1 has a convex curved shape vertically downward in a longitudinal sectional view and has a radius of curvature of R1 (mm). Therefore, the groove part ma has a height difference between a central position (intermediate position) and both end positions (positions on both sides) sandwiching the central position therebetween in a longitudinal sectional view in an extending direction thereof. The groove part ma is highest at the central position in a longitudinal direction of the arcuate bottom wall part 100*d*1 and is lowest at both of the end positions in the longitudinal direction of the arcuate bottom wall part 100*d*1.

The arcuate bottom wall part 100*d*1 is convexly curved toward the top plate part 202 in a plan view, and a radius of curvature of a center line CL passing through a central position in a width direction in the plan view is R (nn). The arcuate bottom wall part 100*d*1 is a portion to be a part of the arc part 203A when the blank (flat plate material 100) of FIG. 47 is subjected to the bending step to be formed into the structural member 201.

The linear bottom wall parts 100*d*2 are integrally continuous with both left and right ends of the arcuate bottom wall part 100*d*1 without a height difference. The linear bottom wall parts 100*d*2 have a linear shape in both a plan view and a longitudinal sectional view. Upper and lower surfaces of the linear bottom wall parts 100*d*2 are substantially parallel to the upper surface 202*e* of the top plate part 202.

For a case of obtaining the structural member 201 of FIG. 48 by subjecting the blank of FIG. 47 having the configuration described above to a bending step, numerical calculations were performed by changing the radii of curvature R and R1 and a steel sheet strength (tensile strength). Further, plate thicknesses were all set to 2.3 mm in common.

Specifically, for the radius of curvature R, two cases of 250 mm and 60 mm were used.

Also, when the radius of curvature R was 250 mm, a total of six cases of the radius of curvature R1 including 160 mm, 200 mm, 250 mm, 500 mm, 1000 mm, and 2000 mm were used. Also, when the radius of curvature R was 60 mm, a total of six cases of the radius of curvature R1 including 40 mm, 50 mm, 60 mm, 120 mm, 400 mm, and 600 mnm were used. Thereby, the same ratios of R/R1 of 1.5, 1.2, 1.0, 0.5, 0.2, and 0.1 were used in common for both the cases in which the radii of curvature R were 250 mm and 60 mm. Further, values other than the radii of curvature R and R1 were as shown in FIGS. 47 and 48.

Further, three cases of steel sheet strengths including a steel sheet of 780 MPa class, a steel sheet of 980 MPa class, and a steel sheet of 1180 MPa class were used.

Numerical calculations were performed by appropriately combining the above parameters, and results of investigation on presence or absence of forming defects were shown in Table 2 below.

As described above, according to the present example, it was ascertained that the present invention was also effective for high-strength steel sheets such as a steel sheet of 780 MPa class, a steel sheet of 980 MPa class, and furthermore a steel sheet of 1180 MPa class.

Further, in the present example, it is the result of a case in which the curved reinforcing part 203 has a closed cross-sectional shape. When the same numerical calculation was performed for a case in which the curved reinforcing part 203 had an open cross-sectional shape, the result of the R1/R ratio was the same as that in the case of the closed cross-sectional shape. Therefore, even in the case of the open cross-sectional shape, the R/R1 ratio is preferably within the above-described range.

TABLE 2

| Radius of curvature R (mm) in plan view | Radius of curvature R1 (mm) in longitudinal sectional view (Examples only) | Ratio of radius of curvature R/R1(—) (Examples only) | Steel sheet of 780 MPa class | | Steel sheet of 980 MPa class | | Steel sheet of 1180 MPa class | |
|---|---|---|---|---|---|---|---|---|
| | | | Comparative example | Examples | Comparative example | Examples | Comparative example | Examples |
| 250 | 160 | 1.5 | BAD (Dimensional error) | BAD (Dimensional error) | BAD (Dimensional error) | BAD (Dimensional error) | BAD (Dimensional error) | BAD (Dimensional error) |
| | 200 | 1.2 | | GOOD | | BAD (Dimensional error) | | BAD (Dimensional error) |
| | 250 | 1.0 | | GOOD | | GOOD | | GOOD |
| | 500 | 0.5 | | GOOD | | GOOD | | GOOD |
| | 1000 | 0.2 | | GOOD | | BAD (Dimensional error) | | BAD (Dimensional error) |
| | 2000 | 0.1 | | BAD (Dimensional error) | | BAD (Dimensional error) | | BAD (Dimensional error) |
| 60 | 40 | 1.5 | BAD (Dimensional error) | BAD (Dimensional error) | BAD (Dimensional error) | BAD (Dimensional error) | BAD (Dimensional error) | BAD (Dimensional error) |
| | 50 | 1.2 | | GOOD | | BAD (Dimensional error) | | BAD (Dimensional error) |
| | 60 | 1.0 | | GOOD | | GOOD | | GOOD |
| | 120 | 0.5 | | GOOD | | GOOD | | GOOD |
| | 400 | 0.2 | | GOOD | | BAD (Dimensional error) | | BAD (Dimensional error) |
| | 600 | 0.1 | | BAD (Dimensional error) | | BAD (Dimensional error) | | BAD (Dimensional error) |

As shown in Table 2, in a case of the steel sheet of 780 MPa class, the R/R1 ratio was within the range of 0.2 to 1.2 in both the cases having the radii of curvature R of 250 mm and 60 mm, and a suitable forming result without dimensional errors could be obtained.

In a case of the steel sheet of 980 MPa class, the R/R1 ratio was 0.2 or less or 1.2 or more in both the cases having the radii of curvature R of 250 mm and 60 mm, and dimensional errors were occurred.

Also, in a case of the steel sheet of 1180 MPa class, the R/R1 ratio was 0.2 or less or 1.2 or more in both the cases having the radii of curvature R of 250 mm and 60 mm, and dimensional errors occurred.

From the above results, a result could be obtained that the R/R1 ratio was preferably within a range of 0.2 to 1.2. Further, a result could be obtained that the R/R1 ratio was more preferably within a range of 0.3 to 1.1 in addition to the above-described result, and the R/R1 ratio was most preferably 0.5. Further, when it is considered in combination with the results of the first example, it is preferable to employ 0.3 to 0.9 as a preferable range of the R/R1 ratio.

INDUSTRIAL APPLICABILITY

According to the manufacturing method and the manufacturing device of a structural member according to the present invention, a structural member having high rigidity can be manufactured by reinforcing the curved edge. Therefore, industrial applicability is high.

BRIEF DESCRIPTION OF THE REFERENCE SYMBOLS

1, 201, 301, 401 Structural member
2, 202, 302, 402 Top plate part
2*a*, 202*a* Curved edge
3, 203, 303, 403 Curved reinforcing part
40A, 240A Die (second die)
41A, 241A Top plate support surface (first top plate support surface)

50Ad, 250Ad Lower surface (curved convex part)
50A, 250A Holder (first holder)
50Ae, 250Ae Vertical wall surface (first vertical wall surface)
60A, 260A Punch (second punch)
60Ae, 260Ae Vertical wall surface (second vertical wall surface)
70A, 270A Holder (second holder)
70Ac, 270Ac Vertical wall surface (first restricting surface)
80A, 280A Punch (third punch)
90A, 290A Pad
90Ad, 290Ad Restricting surface (second restricting surface)
100 Flat plate material
100*b*, 100*d*, 100*f*, 100*h* Band-shaped arcuate wall part (bottom wall)
100*c*, 100*e*, 100*g*, 100*i* Vertical wall part
112, 212 Die groove (first die groove)
112*b*, 212*b* Die groove bottom surface (bottom surface)
110, 210 Die (first die)
130, 230 Punch (first punch)
130*a*, 230*a* Pressurizing surface
410, 1410 Die (third die)
411, 1411 Top plate support surface (second top plate support surface)
411*a*, 1411*a* Edge (first die curved edge)
420, 1420 Holder (third holder)
430, 1430 Punch (fourth punch)
431, 1431 Pressurizing surface (pressurizing surface of fourth punch)
440, 1440 Lower die (fourth die)
441, 1441 Bottom wall surface (fourth die groove, bottom surface of fourth die groove)
610, 1610 Die (fifth die)
611, 1611 Top plate support surface (third top plate support surface)
611*a*, 1611*a* Edge (second die curved edge)
620, 1620 Holder (fourth holder)
622, 1622 Vertical wall surface (third vertical wall surface)
630, 1630 Punch (fifth punch)
632, 1632 Vertical wall surface (fourth vertical wall surface)
710, 1710 Die (sixth die)
711, 1711 Top plate support surface (fourth top plate support surface)
711*a*, 1711*a* Edge (third die curved edge)
720, 1720 Holder (fifth holder)
723, 1723 Vertical wall surface (third restricting surface)
730, 1730 Pad (sixth punch)
733, 1733 Second lower surface (pressurizing surface)
CL Center line
m, ma Groove part
m1, m3 Die groove (second die groove)
m2, m4 Die groove (third die groove)
Q, Q1 Bent part

The invention claimed is:

1. A manufacturing method of a structural member which is a method for manufacturing a structural member including a top plate part having a curved edge and a curved reinforcing part which is formed integrally with the top plate part in an extending direction of the curved edge and in which a cross section perpendicular to the extending direction of the curved edge has a closed cross-sectional shape or an open cross-sectional shape from a flat plate material, the manufacturing method of a structural member comprising:

an intermediate step of forming a groove part and a vertical wall part which is continuous with the groove part along a portion of the flat plate material that will become the curved edge by pressing a second portion continuous with a first portion in a direction intersecting a surface of the flat plate material with the first portion of the flat plate material corresponding to the top plate part sandwiched; and a bending step of bending an upper end edge of the vertical wall part toward the top plate part by pushing down the upper end edge toward the groove part while movement thereof toward the top plate part is allowed after the intermediate step, wherein a height difference is provided on a bottom wall of the groove part between an intermediate position and both end positions sandwiching the intermediate position therebetween in a longitudinal sectional view in an extending direction of the groove part by the pressing in the intermediate step, and thereby at least one of a first curved part which has a concave curved shape in a plan view and a convex curved shape in the longitudinal sectional view and a second curved part which has a convex curved shape in the plan view and a concave curved shape in the longitudinal sectional view is formed on the bottom wall.

2. The manufacturing method of a structural member according to claim 1, wherein, when viewed along a cross-sectional line length of the groove part along an inner shape of a cross section perpendicular to the extending direction of the groove part, a ratio obtained by dividing the cross-sectional line length at the intermediate position by the cross-sectional line length at both of the end positions falls within a range of 0.7 to 1.3 due to the pressing in the intermediate step.

3. The manufacturing method of a structural member according to claim 1, wherein an R/R1 ratio obtained by dividing a radius of curvature R (mm) of a center line passing through a central position in a width direction of the bottom wall in a plan view by a radius of curvature R1 (mm) of the bottom wall in the longitudinal sectional view in at least one of the first curved part and the second curved part falls within a range of 0.2 to 1.2 due to the pressing in the intermediate step.

4. The manufacturing method of a structural member according to claim 1, further comprising a joining step of, after the bending step, overlapping and joining at least a part of the upper end edge of the vertical wall part and the top plate part to form the curved reinforcing part having the closed cross-sectional shape.

5. The manufacturing method of a structural member according to claim 4, wherein movement of the upper end edge past a planned joining position on the top plate part is restricted in the joining step.

6. The manufacturing method of a structural member according to claim 4, further comprising an upper end edge bending step of, before the joining step, forming a bent part at which the upper end edge is directed toward the top plate part at the time of the joining step.

7. The manufacturing method of a structural member according to claim 1, wherein the bending step includes a folding-back step of forming the curved reinforcing part having the open cross-sectional shape by further bending the vertical wall part to a state in which the upper end edge is spaced apart from the top plate part in a side view while at least a part of the upper end edge overlaps the top plate part in a plan view facing the top plate part.

8. The manufacturing method of a structural member according to claim 7, wherein the movement of the upper end edge past a predetermined position is restricted when the vertical wall part is further bent in the folding-back step.

9. The manufacturing method of a structural member according to claim 7, further comprising an upper end edge bending step of, before the folding-back step, forming a bent part at which the upper end edge is directed toward the top plate part at the time of the folding-back step.

10. The manufacturing method of a structural member according to claim 1, wherein the curved reinforcing part including both a concave curved shape and a convex curved shape in a plan view facing the top plate part is formed after the bending step by forming both the first curved part and the second curved part by the pressing in the intermediate step.

11. A manufacturing device of a structural member which is a device for manufacturing a structural member including a top plate part having a curved edge and a curved reinforcing part which is formed integrally with the top plate part in an extending direction of the curved edge and in which a cross section perpendicular to the extending direction of the curved edge has a closed cross-sectional shape from a flat plate material, the manufacturing device of a structural member comprising:

a first die on which a first die groove curved in a plan view is formed;

a first punch which moves relatively closer to and further away from the first die groove;

a second die having a second die groove which is thinner than the first die groove in a plan view;

a first holder including a curved convex part having a shape corresponding to the second die groove;

a second punch having a second vertical wall surface disposed to face a first vertical wall surface of the first holder at a distance of 5 mm or more and 50 mm or less in a horizontal direction in a plan view and configured to move relatively closer to and further away from the second die groove;

a second holder disposed to overlap the second die; and a pad having a pressurizing surface which moves closer to and further away from the second die groove, wherein a bottom surface of the first die groove has a height difference between an intermediate position and both end positions sandwiching the intermediate position therebetween in a longitudinal sectional view in an extending direction of the first die groove, a pressurizing surface of the first punch has a height difference corresponding to that of the bottom surface of the first die groove, the bottom surface of the first die groove includes at least one of a first die curved surface which has a concave curved shape in the plan view and a convex curved shape in the longitudinal sectional view and a second die curved surface which has a convex curved shape in the plan view and a concave curved shape in the longitudinal sectional view, and a gap at a bottom dead center of forming with respect to a first top plate support surface of the second die is larger on the pressurizing surface of the pad than on a pressurizing surface of the second holder.

12. The manufacturing device of a structural member according to claim 11, wherein, when viewed along a cross-sectional line length of the first die groove along an inner shape of a cross section perpendicular to the extending direction of the first die groove, a ratio obtained by dividing the cross-sectional line length at the intermediate position by the cross-sectional line length at both of the end positions falls within a range of 0.7 to 1.3.

13. The manufacturing device of a structural member according to claim 11, wherein an R/R1 ratio of the bottom surface of the first die groove obtained by dividing a radius of curvature R (mm) of a center line passing through a central position in a width direction in a plan view by a radius of curvature R1 (mm) in the longitudinal sectional view in at least one of the first die curved surface and the second die curved surface falls within a range of 0.2 to 1.2.

14. A manufacturing device of a structural member which is a device for manufacturing a structural member including a top plate part having a curved edge and a curved reinforcing part which is formed integrally with the top plate part in an extending direction of the curved edge and in which a cross section perpendicular to the extending direction of the curved edge has an open cross-sectional shape from a flat plate material, the manufacturing device of a structural member comprising:

a third die having a second top plate support surface which includes a first die curved edge curved in a plan view;

a third holder which moves closer to and further away from the second top plate support surface;

a fourth die including a fourth die groove which is disposed adjacent to the first die curved edge in a plan view;

a fourth punch which moves closer to and further away from the fourth die groove;

a fifth die having a third top plate support surface which includes a second die curved edge curved in a plan view;

a fourth holder which moves closer to and further away from the third top plate support surface;

a fifth punch having a fourth vertical wall surface disposed to face a third vertical wall surface of the fourth holder at a distance of 5 mm or more and 50 mm or less in a horizontal direction in a plan view;

a sixth die having a fourth top plate support surface which includes a third die curved edge curved in a plan view;

a fifth holder which moves closer to and further away from the fourth top plate support surface; and a sixth punch having a pressurizing surface which overlaps a top of the third die curved edge in a plan view and configured to move closer to and further away from the sixth die, wherein a bottom surface of the fourth die groove has a height difference between an intermediate position and both end positions sandwiching the intermediate position therebetween in a longitudinal sectional view in an extending direction of the fourth die groove, a pressurizing surface of the fourth punch has a height difference corresponding to the bottom surface of the fourth die groove, the bottom surface of the fourth die groove includes at least one of a third die curved surface which has a concave curved shape in the plan view and a convex curved shape in the longitudinal sectional view and a fourth die curved surface which has a convex curved shape in the plan view and a concave curved shape in the longitudinal sectional view, and a gap at a bottom dead center of forming with respect to the fourth top plate support surface of the sixth die is larger on a pressurizing surface of the sixth punch than on a pressurizing surface of the fifth holder.

15. The manufacturing device of a structural member according to claim 14, wherein, when viewed along a cross-sectional line length of the fourth die groove along an inner shape of a cross section perpendicular to the extending direction of the fourth die groove is, a ratio obtained by dividing the cross-sectional line length at the intermediate position by the cross-sectional line length at both of the end positions falls within a range of 0.7 to 1.3.

16. The manufacturing device of a structural member according to claim 14, wherein an R/R1 ratio of the bottom surface of the fourth die groove obtained by dividing a radius of curvature R (mm) of a center line passing through a central position in a width direction in a plan view by a radius of curvature R1 (mm) in the longitudinal sectional view in at least one of the third die curved surface and the fourth die curved surface falls within a range of 0.2 to 1.2.

* * * * *